US008609310B2

(12) United States Patent
Takimoto et al.

(10) Patent No.: US 8,609,310 B2
(45) Date of Patent: Dec. 17, 2013

(54) ELECTROPHOTOGRAPHIC PHOTORECEPTOR, PROCESS CARTRIDGE, AND IMAGE FORMING APPARATUS

(75) Inventors: Hitoshi Takimoto, Kanagawa (JP); Akira Hirano, Kanagawa (JP); Takatsugu Doi, Kanagawa (JP); Wataru Yamada, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 381 days.

(21) Appl. No.: 12/541,521

(22) Filed: Aug. 14, 2009

(65) Prior Publication Data

US 2010/0233601 A1 Sep. 16, 2010

(30) Foreign Application Priority Data

Mar. 16, 2009 (JP) ..... 2009-063427

(51) Int. Cl.
*G03G 15/00* (2006.01)

(52) U.S. Cl.
USPC ..... 430/58.7; 430/56; 430/58.05; 430/58.65; 430/58.8; 430/58.4

(58) Field of Classification Search
USPC ..... 430/58.3–58.8
See application file for complete search history.

(56) References Cited

U.S. PATENT DOCUMENTS

| | | | |
|---|---|---|---|
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |
| 5,358,813 | A | 10/1994 | Iijima et al. |
| 5,378,569 | A | 1/1995 | Nukada et al. |
| 5,393,629 | A | 2/1995 | Nukada et al. |
| 5,411,827 | A | 5/1995 | Tamura et al. |
| 5,416,207 | A | 5/1995 | Imai et al. |
| 5,427,880 | A | 6/1995 | Tamura et al. |
| 5,456,989 | A | 10/1995 | Nogami et al. |
| 5,459,004 | A | 10/1995 | Daimon et al. |
| 5,463,043 | A | 10/1995 | Nukada et al. |
| 5,496,671 | A | 3/1996 | Tamura et al. |

(Continued)

FOREIGN PATENT DOCUMENTS

| | | | |
|---|---|---|---|
| CN | 1577114 | A | 2/2005 |
| CN | 1869824 | A * | 11/2006 |

(Continued)

OTHER PUBLICATIONS

English translation of specification of CN 1869824A, Nov. 2006, Asano M et al.*

(Continued)

*Primary Examiner* — Mark F Huff
*Assistant Examiner* — Rashid Alam
(74) *Attorney, Agent, or Firm* — Oliff & Berridge, PLC

(57) ABSTRACT

An electrophotographic photoreceptor has at least an electroconductive substrate, and a photosensitive layer formed on or above the electroconductive substrate, wherein an outermost layer of the photoreceptor is a cured membrane of a composition containing at least one compound (a) having in a single molecule thereof a charge transporting skeleton and a chain polymerizable functional group, and at least one thermopolymerizable or photopolymerizable silicone polymeric radical polymerization initiator (b).

10 Claims, 3 Drawing Sheets

(56) References Cited

U.S. PATENT DOCUMENTS

| | | | | |
|---|---|---|---|---|
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,416,915 | B1 | 7/2002 | Kikuchi et al. | |
| 2002/0119382 | A1 | 8/2002 | Nakata et al. | |
| 2004/0043312 | A1 | 3/2004 | Kikuchi et al. | |
| 2004/0248024 | A1 | 12/2004 | Suzuki et al. | |
| 2004/0253527 | A1 | 12/2004 | Suzuki et al. | |
| 2005/0019684 | A1 | 1/2005 | Sekiya et al. | |
| 2005/0181292 | A1 | 8/2005 | Fujii et al. | |
| 2006/0269857 | A1 | 11/2006 | Hayata et al. | |
| 2007/0122724 | A1 | 5/2007 | Suzuki et al. | |
| 2007/0154828 | A1 | 7/2007 | Fujii et al. | |
| 2007/0178400 | A1 | 8/2007 | Kikuchi et al. | |
| 2008/0020305 | A1 | 1/2008 | Suzuki et al. | |
| 2009/0162763 | A1* | 6/2009 | Li et al. | 430/58.2 |

FOREIGN PATENT DOCUMENTS

| | | | |
|---|---|---|---|
| JP | A-62-251757 | | 11/1987 |
| JP | A-4-189873 | | 7/1992 |
| JP | A-5-40360 | | 2/1993 |
| JP | A-5-43823 | | 2/1993 |
| JP | A-5-98181 | | 4/1993 |
| JP | A-5-140472 | | 6/1993 |
| JP | A-5-140473 | | 6/1993 |
| JP | A-5-216249 | | 8/1993 |
| JP | A-5-263007 | | 10/1993 |
| JP | A-5-279591 | | 10/1993 |
| JP | A-5-323630 | | 12/1993 |
| JP | A-7-72640 | | 3/1995 |
| JP | A-7-146564 | | 6/1995 |
| JP | A-8-176293 | | 7/1996 |
| JP | A-8-208820 | | 8/1996 |
| JP | A-11-52603 | | 2/1999 |
| JP | A-2000-19749 | | 1/2000 |
| JP | A-2000-206715 | | 7/2000 |
| JP | A-2000-206717 | | 7/2000 |
| JP | A-2000-264961 | | 9/2000 |
| JP | A-2001-166510 | | 6/2001 |
| JP | A-2001-175016 | | 6/2001 |
| JP | A-2002-82469 | | 3/2002 |
| JP | B2-3287678 | | 6/2002 |
| JP | A-2004-12986 | | 1/2004 |
| JP | A-2004-78147 | | 3/2004 |
| JP | A-2004-302450 | | 10/2004 |
| JP | A-2005-181992 | | 7/2005 |
| JP | A-2006-84711 | | 3/2006 |
| JP | A-2006-178351 | | 7/2006 |
| JP | 2007004134 | A * | 1/2007 |
| JP | A-2007-4134 | | 1/2007 |
| JP | A-2007-86522 | | 4/2007 |
| JP | A-2009-133992 | | 6/2009 |

OTHER PUBLICATIONS

English translation of claims of CN 1869824A, Nov. 2006, Asano M et al.*

Japanese Office Action issued in Japanese Patent Application No. 2009-063427 on Jan. 5, 2011 (with translation).

Tanaka et al.; "Hybrid Sol-gel Coating with Dispersed Fluoropolymer Latex;" The Society of Polymer Science; Oct. 13, 1999; pp. 89-91.

Mar. 23, 2012 First Notification of Office Action issued in Chinese Patent Application No. 200910173159.2 with English-language Translation.

* cited by examiner

FIG. 3
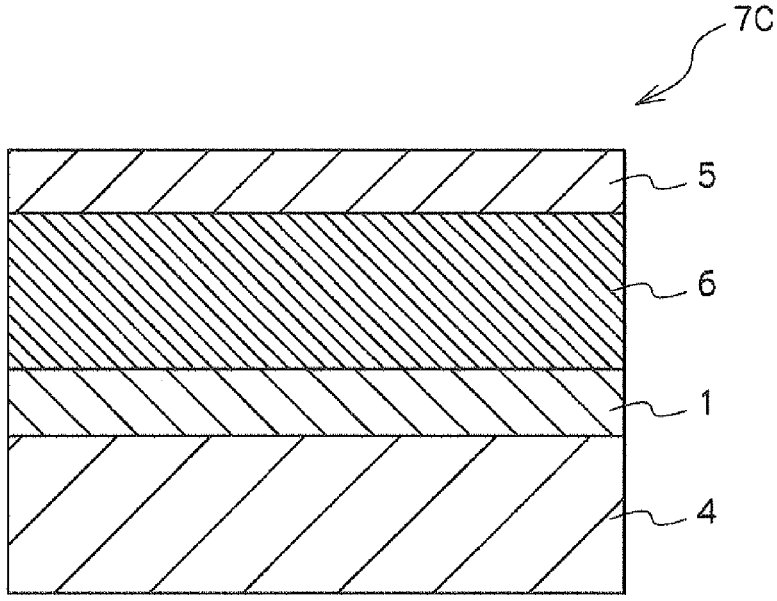
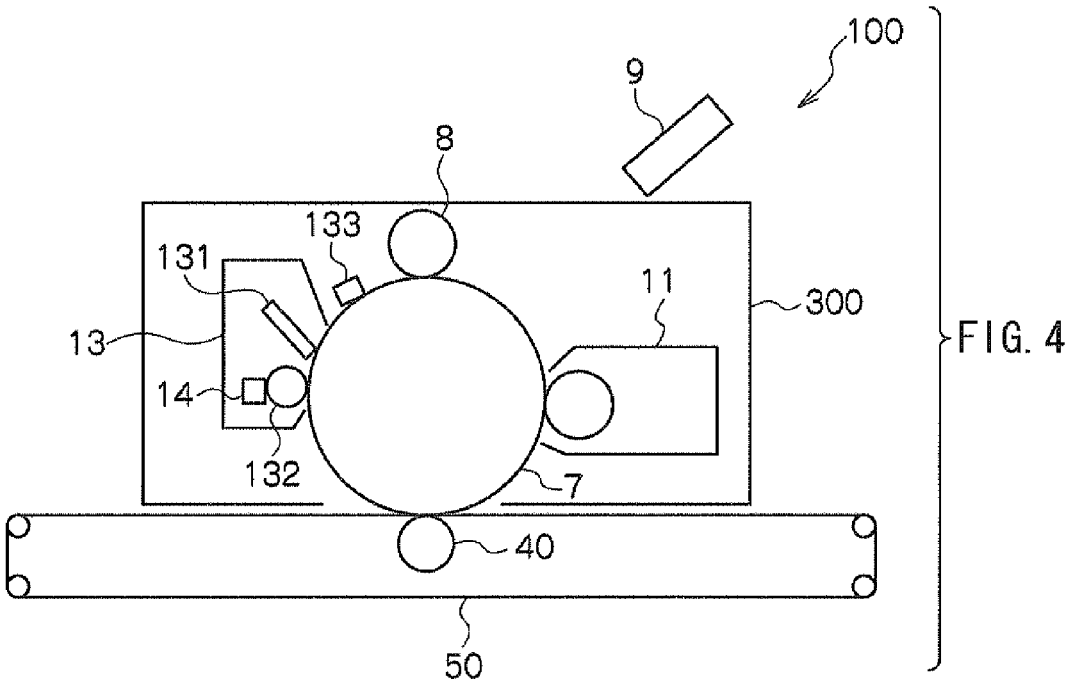
FIG. 4

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2009-063427 filed on Mar. 16, 2009.

BACKGROUND

1. Technical Field

The present invention relates to an electrophotographic photoreceptor, a process cartridge, and an image forming apparatus.

2. Related Art

Image forming apparatuses in an electrophotographic system generally have the below-described structure and are operated according to the below-described process.

The surface of an electrophotographic photoreceptor is electrified to a predetermined polarity and a predetermined electric potential by an electrifier, and the electrified electrophotographic photoreceptor surface is imagewise exposed to light so as to remove the electric charge selectively, thereby forming an electrostatic latent image. Thereafter, a toner is adhered to the electrostatic latent image by a developing unit, and the latent image is developed as a toner image. The toner image is transferred to an image-receiving medium via a transfer unit, and the image-receiving medium is discharged as an image formed product.

Electrophotographic photoreceptors have the advantage that a high-quality image is obtained at high-speed. In recent years, therefore, the use thereof has been increasing in the field of copying machines, laser beam printers and the like.

Electrophotographic photoreceptors using a conventional inorganic material, such as selenium, selenium-tellurium alloy, selenium-arsenic alloy, or cadmium sulfide (inorganic photoreceptors), are known as electrophotographic photoreceptors used in these image forming apparatuses. In recent years, electrophotographic photoreceptors using an organic photoconductive material (organic photoreceptors), which are inexpensive and advantageous in terms of productivity and disposability, have started becoming mainstream.

A corona electrifying system using a color discharger has been hitherto used as the electrifying system. In recent years, a contact electrifying system, which has advantages such as low ozone generation and low power, has been put into practice and come into widespread use. In the contact electrifying system, an electroconductive member is used as an electrifying member and is contacted with or moved close to the surface of a photoreceptor, and voltage is applied to the electrifying member to electrify the photoreceptor surface. Systems of applying voltage to the electrifying member include direct current systems of applying only a direct current voltage, and alternating current superimposed systems of applying an alternating current voltage superimposed on direct current voltage. The contact electrifying system is advantageous in terms of miniaturization of apparatuses and reduced generation of gases such as ozone.

As the transfer system, a system of transferring a toner image directly onto a paper sheet has been the mainstream. However, in recent years, a system of using an intermediate transfer medium for transferring a toner image has been actively used since the choice of papers on which the toner image is transferred has expanded.

SUMMARY

According to a first aspect of the invention, there is provided an electrophotographic photoreceptor, having at least an electroconductive substrate, and a photosensitive layer formed on or above the electroconductive substrate, an outermost layer of the photoreceptor being a cured membrane of a composition containing at least one compound (a) having in a single molecule thereof a charge transporting skeleton and a chain polymerizable functional group, and at least one thermopolymerizable or photopolymerizable silicone polymeric radical polymerization initiator (b).

BRIEF DESCRIPTION OF THE DRAWINGS

Exemplary embodiments of the present invention will be described in detail based on the following figures, wherein:

FIG. 3 is a schematic partially sectional view illustrating a different example of the electrophotographic photoreceptor according to an exemplary embodiment of the invention;

FIG. 4 is a schematic structural view illustrating an example of the image forming apparatus according to an exemplary embodiment of the invention.

DETAILED DESCRIPTION

[Electrophotographic Photoreceptor]

Figure 1:
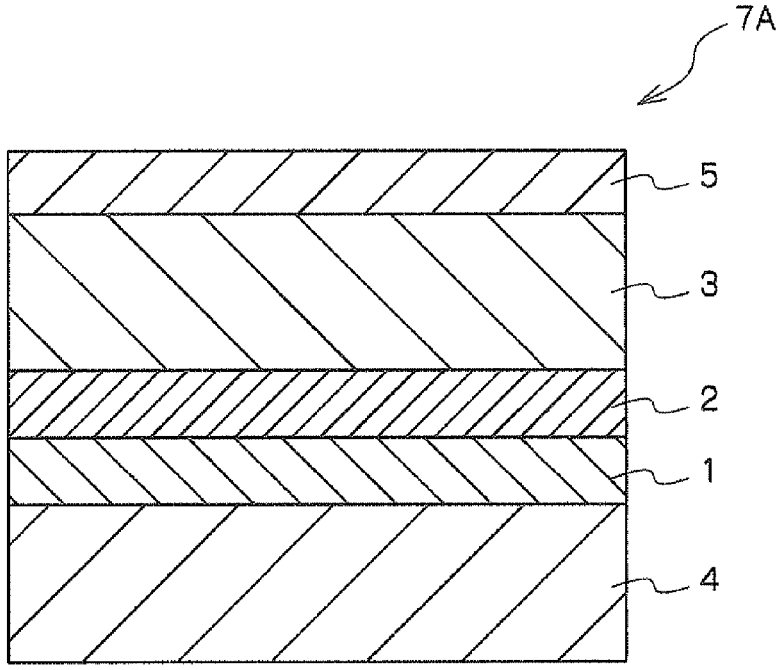
FIG. 1 is a schematic partially sectional view illustrating an example of the electrophotographic photoreceptor according to an exemplary embodiment of the invention.

The electrophotographic photoreceptor according to an exemplary embodiment of the present invention is has at least an electroconductive substrate, and a photosensitive layer formed on or above the electroconductive substrate, an outermost layer of the photoreceptor being a cured membrane of a composition containing at least one compound (a) having in a single molecule thereof a charge transporting skeleton and a chain polymerizable functional group, and at least one thermopolymerizable or photopolymerizable silicone polymeric radical polymerization initiator (b).

Hereinafter, a compound (a) having in a single molecule thereof a charge transporting skeleton and a chain polymerizable functional group may be referred to as a specific charge transporting material (a) as the case may be; and a thermopolymerizable or photopolymerizable silicone polymeric radical polymerization initiator (b) may be referred as a specific silicone polymerization initiator (b) as the case may be.

The electrophotographic photoreceptor according to the present exemplary embodiment has the above-mentioned configuration, whereby the outermost surface thereof has favorable lubricating properties. As a result, the cleaning properties of the electrophotographic photoreceptor are improved. In a process cartridge and an image forming apparatus each having this photoreceptor, image defects resulting from a deterioration in lubricating properties of the outermost surface of the photoreceptor (for example, streaking based on insufficient cleaning) is suppressed.

As described above, the electrophotographic photoreceptor according to the present exemplary embodiment has an outermost layer which is a cured membrane made of a composition containing at least one specific charge transporting material (a) and at least one specific silicone polymerization initiator (b). It is sufficient for the exemplary embodiment that the outermost layer constitutes a topmost layer of the electrophotographic photoreceptor. Thus, the outermost layer may be formed as a layer functioning as a protective layer, or a layer functioning as a charge transporting layer.

When the outermost layer is a layer functioning as a protective layer, this protective layer has, as an underlying layer, a photosensitive layer composed of a charge transporting layer and a charge generating layer, or a monolayered photosensitive layer (charge generating/charge transporting layer).

When the outermost layer is a layer functioning as a protective layer, the electrophotographic photoreceptor may be in a form that the photoreceptor has, on or above an electroconductive substrate, a photosensitive layer and the protective layer as its outermost layer and the protective layer is a cured membrane made of a composition containing at least one specific charge transporting material (a) and at least one specific silicone polymerization initiator (b).

When the outermost layer is a layer functioning as a charge transporting layer, the electrophotographic photoreceptor may be in a form that the photoreceptor has, on or above an electroconductive substrate, a charge generating layer and the charge transporting layer as its outermost layer and the charge transporting layer is a cured membrane made of a composition containing at least one specific charge transporting material (a) and at least one specific silicone polymerization initiator (b).

With reference to the drawings, the electrophotographic photoreceptor according to the present exemplary embodiment wherein its outermost layer is a layer functioning as a protective layer will be described in detail hereinafter. In the drawings, the same reference numbers are attached to the same members or portions corresponding to each other. About the members or portions, overlapping descriptions are omitted.

Figure 2:
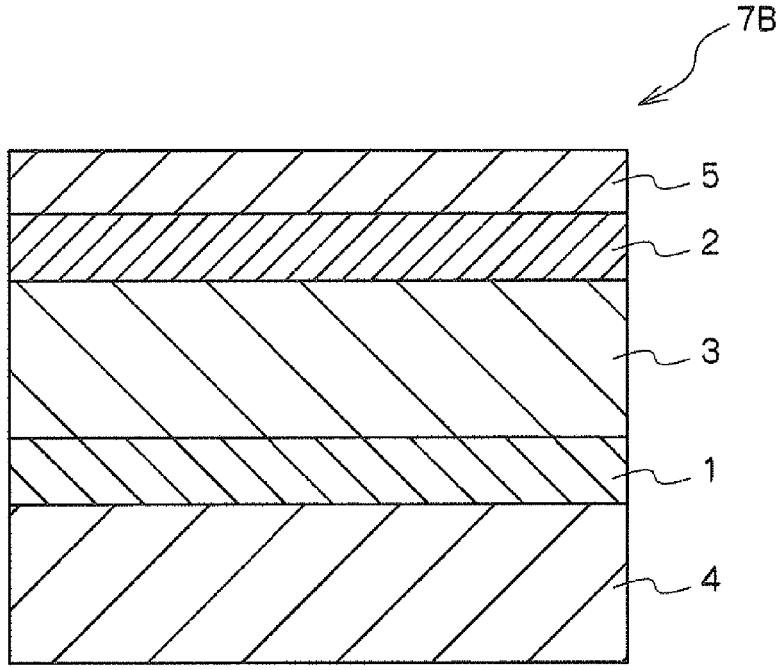
FIG. 2 is a schematic partially sectional view illustrating another example of the electrophotographic photoreceptor according to an exemplary embodiment of the invention.

FIG. 1 is a schematic sectional view illustrating a proper example of the electrophotographic photoreceptor according to the present exemplary embodiment. FIGS. 2 and 3 are a schematic sectional view illustrating each a different example of the electrophotographic photoreceptor according to the present exemplary embodiment.

An electrophotographic photoreceptor illustrated in FIG. 1 is the so-called function-separated photoreceptor (or multilayered photoreceptor), and has a configuration in which an undercoating layer 1 is laid on an electroconductive substrate 4, and the following are successively formed thereon: a charge generating layer 2, a charge transporting layer 3, and a protective layer 5. In the electrophotographic photoreceptor 7A, the charge generating layer 2 and the charge transporting layer 3 constitute a photosensitive layer.

An electrophotographic photoreceptor 7B illustrated in FIG. 2 is a function-separated photoreceptor, the function of which is separated into a function in a charge generating layer 2 and that in a charge transporting layer 3, in the same manner as in the electrophotographic photoreceptor 7A illustrated in FIG. 1. An electrophotographic photoreceptor 7C illustrated in FIG. 3 contains, in a single layer thereof (monolayered photosensitive layer (charge generating/charge transporting layer) 6), a charge generating material and a charge transporting material.

The electrophotographic photoreceptor 7B illustrated in FIG. 2 has a configuration in which an undercoating layer 1 is laid on an electroconductive substrate 4, and the following are successively formed thereon: the charge transporting layer 3, the charge generating layer 2 and a protective layer 5. In the electrophotographic photoreceptor 7B, the charge transporting layer 3 and the charge generating layer 2 constitute a photosensitive layer.

The electrophotographic photoreceptor 7C illustrated in FIG. 3 has a configuration in which an undercoating layer 1 is laid on an electroconductive substrate 4, and the following are successively formed thereon: the monolayered photosensitive layer 6, and a protective layer 5.

In the electrophotographic photoreceptors 7A to 7C illustrated in FIGS. 1 to 3, each of protective layers 5 is an outermost layer, which is arranged farthest from the electroconductive substrate 2. The outermost layer has the above-mentioned predetermined structure.

In the electrophotographic photoreceptors illustrated in FIGS. 1 to 3, the undercoating layer 1 is optional.

Based on the electrophotographic photoreceptor 7A illustrated in FIG. 1 as a typical example, each constituting element will be described below.

<Protective Layer>

First, the protective layer 5 which is an outermost layer in the electrophotographic photoreceptor 7A is described herein.

The protective layer 5 is the outermost layer in the electrophotographic photoreceptor 7A, and is a cured membrane made of a composition containing at least one specific charge transporting material (a) and at least specific silicone polymerization initiator (b). In other words, the protective layer 5 is a cured membrane obtained by curing the composition by thermopolymerization or photopolymerization.

First, the specific charge transporting material (a) is described herein.

The specific charge transporting material (a) used in the protective layer (outermost layer) 5 is a compound having in a single compound thereof a charge transporting skeleton and a chain polymerizable functional group. The compound may be any compound as far as the compound satisfies this structural requirement.

The charge transporting skeleton in the specific charge transporting material (a) is, as the charge transporting skeleton in the reactive charge transporting material (a), for example, a skeleton originating from a nitrogen-containing hole transporting compound such as a triarylamine compound, a benzidine compound or a hydrazone compound. The structure conjugated with the nitrogen atom corresponds to the charge transporting skeleton.

The chain polymerizable functional group in the specific charge transporting material (a) is, for example, an acryloyl group, a methacryloyl group or a styrene group, and is in particular preferably a methacryloyl group. The reason therefor is unclear; however, the reason would be as follows.

Usually, in curing reaction, an acryloyl group, which is high in reactivity, is used in many cases. However, when a highly reactive acryloyl group is used as a substituent in a bulky charge transporting skeleton, an uneven curing reaction is easily caused. As a result, it appears that microscopic (or macroscopic) sea-island structure may easily be formed. Such a sea-island structure hardly causes a problem in fields other than the electronic field. However, when the sea-island structure is present in an electrophotographic photoreceptor, unevenness or wrinkles are easily generated in its outermost layer. Regions different from each other in charge transporting property are macroscopically generated so that an image unevenness and other problems are caused. Such a sea-island structure would be in particular remarkably formed in a case where a plurality of functional groups is attached to a single charge transporting skeleton.

Thus, by use of a specific charge transporting material having a methacryloyl group as the specific charge transporting material (a), the formation of a seal-island structure as described above is restrained. From this matter, it is presumed that the electrophotographic photoreceptor having the outermost layer which is a cured membrane made of a composition containing this desired specific charge transporting material (a) gives good electric characteristics and image characteristics stably.

In the specific charge transporting material (a), it is desired that the material has a structure wherein one or more carbon atoms are interposed between its charge transporting skeleton and its acryloyl group or methacryloyl group. In other words, it is desirable that the specific charge transporting material (a) has a structure having, between its charge transporting skeleton and its acryloyl group or methacryloyl group, a carbon chain containing one or more carbon atoms as a linking group. The linking group is most desirably an alkylene group.

The reason why such the structure is desirable is not necessarily clear; however, the reason would be as follows:

When the acryloyl or methacryloyl group, which has electron withdrawing property, is too close or near to the charge transporting skeleton, the charge density of the charge transporting skeleton is lowered so that the ionization potential rises, whereby the injection of carries into the outermost layer from underlying layers may come not to advance smoothly. Further, it is assumed that when a radical polymerizable substituent such as a methacryloyl group is polymerized, if the structure of radicals generated at the time of the polymerization is easily shifted to the charge transporting skeleton, the generated radicals may deteriorate the charge transportation function thereof, which results in deterioration of the electric characteristics. Furthermore, in a case where the charge transporting skeleton is bulky and this skeleton and the chain polymerizable functional group (acryloyl group or methacryloyl group) are near to each other so as to be rigid, the polymerizable moieties are not easily moved relatively to each other so that the probability that the moieties react with each other may be lowered. This matter would be undesired for the mechanical strength of the outermost layer.

From these matters, it is desired to have the above-mentioned structure, wherein a flexible carbon chain is intervened between the charge transporting skeleton and the acryloyl group or methacryloyl group.

Furthermore, it may be desirable that the specific charge transporting material (a) is a compound (a') having in a single molecule thereof a triphenylamine skeleton and three or more (preferably four or more) methacryloyl groups. This structure has very good advantages that the stability of the compound may be certainly kept in the synthesis thereof, and the compound may be produced in an industrial scale. Additionally, according to the structure, an outermost layer having a high crosslink density and a sufficient mechanical strength may be attained; thus, it is not necessarily essential to add a polyfunctional monomer having no charge transporting performance thereto. Thus, reduction in the electric characteristics owing to the addition of a polyfunctional monomer is suppressed. As a result, the outermost layer may be made thick. As a result, the lifetime of the electrophotographic photoreceptor having this outermost layer is made long, and the photoreceptor is durable even when it is used for a long term.

The method for curing the composition wherein the specific silicone polymerization initiator (b) is used as a polymerization initiator is radical polymerization using light or heat. If the reaction advances too rapidly, unevenness or wrinkles easily occur in the resultant cured membrane. In order to avoid this, thermopolymerization is conducted under the condition of selecting, as the chain polymerizable functional group, a methacryl group, which generates radicals relatively slowly and is lower in reactivity than an acryl group. In this manner, the relaxation of the structure is promoted by heat, so that a cured membrane having a high evenness is stably obtained.

In the present exemplary embodiment, it may be desired that the specific charge transporting material (a) is a compound represented by the following formula (A) since the charge transporting property is very favorable.

(A)

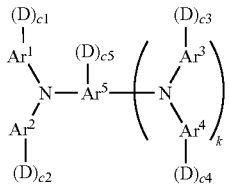

In the formula (A), $Ar^1$ to $Ar^4$ each independently represent a substituted or unsubstituted aryl group, $Ar^5$ represents a substituted or unsubstituted aryl group, or a substituted or unsubstituted arylene group, Ds each represent $—(CH_2)_d—(O—CH_2—CH_2)_e—O—CO—C(CH_3)=CH_2$ wherein d represents an integer of 1 to 5 and e represents 0 or 1, c1 to c5 each independently represent 1 or 2, k represents 0 or 1, and the total number of Ds is 4 or more.

In the formula (A), $Ar^1$ to $Ar^4$ each independently represent a substituted or unsubstituted aryl group. $Ar^1$ to $Ar^4$ may be the same or different.

Examples of the substituent of the substituted aryl group include an alkyl or alkoxy group having 1 to 4 carbon atoms, and a substituted or unsubstituted aryl group having 6 to 10 carbon atoms, excluding D: $—(CH_2)_d—(O—CH_2—CH_2)_e—O—CO—C(CH_3)=CH_2$.

$Ar^1$ to $Ar^4$ may be desirably any one of groups represented by structural formulae (1) to (7) illustrated below. The structural formulae (1) to (7) are each illustrated together with "$-(D)_c$", which collectively represents "$-(D)_{c1}$" to "$-(D)_{c4}$" linked to $Ar^1$ to $Ar^4$, respectively.

(1)

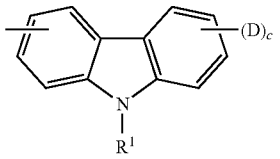

(2)

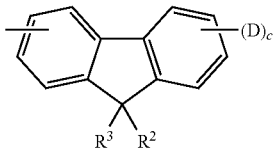

(3)

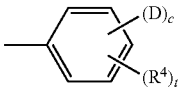

-continued (4)

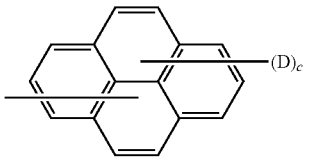

(5)

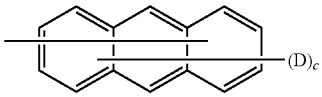

(6)

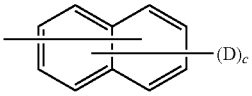

(7)

$$—Ar—(Z')_s—Ar—(D)_c$$

In the structural formulae (1) to (7), $R^1$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and aralkyl groups having 7 to 10 carbon atoms; $R^2$ to $R^4$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and halogen atoms; Ars each represent a substituted or unsubstituted arylene group; Ds each represent $—(CH_2)_d—(O—CH_2—CH_2)_e—O—CO—C(CH_3)=CH_2$ wherein d represents an integer of 1 to 5 and e represents 0 or 1; c represents 1 or 2; s represents 0 or 1; and t represents an integer of 0 to 3.

In the structural formula (7), Ars each represent a group represented by the structural formula (8) or (9):

(8)

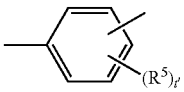

(9)

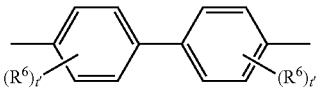

In the structural formulae (8) and (9), $R^5$(s) and $R^6$(s) each independently represent one selected from the group consisting of a hydrogen atom, alkyl groups having 1 to 4 carbon atoms, alkoxy groups having 1 to 4 carbon atoms, a phenyl group substituted with an alkoxy group having 1 to 4 carbon atoms, an unsubstituted phenyl group, aralkyl groups having 7 to 10 carbon atoms, and halogen atoms; and t's each represent an integer of 0 to 3.

In the structural formula (7), Z' represents a bivalent organic lining group, and may be desirably any one of groups represented by structural formulae (10) to (17) illustrated below; and s represents 0 or 1.

(10)

$$—(CH_2)_q—$$

(11)

$$—(CH_2CH_2O)_r—$$

(12)

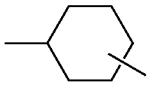

(13)

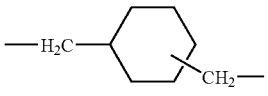

(14)

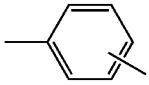

(15)

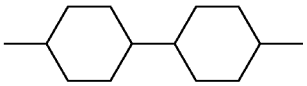

(16)

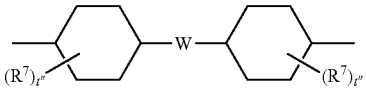

(17)

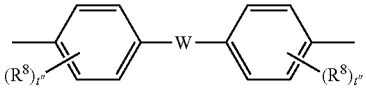

In the structural formulae (10) to (17), $R^7$(s) and $R^8$(s) each independently represent one selected from the group consisting of a hydrogen atom, alkyl groups having 1 to 4 carbon atoms, alkoxy groups having 1 to 4 carbon atoms, a phenyl group substituted with an alkoxy group having 1 to 4 carbon atoms, an unsubstituted phenyl group, aralkyl groups having 7 to 10 carbon atoms, and halogen atoms; Ws each represent a bivalent group; q and r each independently represent an integer of 1 to 10; and t's each represent an integer of 0 to 3.

In the structural formulae (16) and (17), Ws may be each desirably any one of bivalent groups represented by structural formulae (18) to (26) illustrated below. In the structural formula (25), u represents an integer of 0 to 3.

(18)

$$—CH_2—$$

(19)

$$—C(CH_3)_2—$$

(20)

$$—O—$$

(21)

$$—S—$$

(22)

$$—C(CF_3)_2—$$

(23)

$$—Si(CH_3)_2—$$

(24)

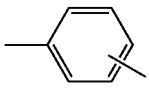

(25)

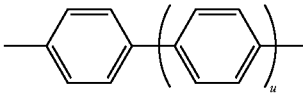

-continued (26)

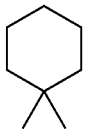

In the formula (A), $Ar^5$ is a substituted or unsubstituted aryl group when k is 0. Examples of this aryl group may be same given as the examples of the aryl group in the description of $Ar^1$ to $Ar^4$. $Ar^5$ is a substituted or unsubstituted arylene group when k is 1. Examples of this arylene group may be arylene groups each obtained by removing, from any one of the aryl group examples given in the description of $Ar^1$ to $Ar^4$, a hydrogen atom at a predetermined position of the aryl group.

The following will illustrate specific examples (compounds A-1 to A-21) of the compound represented by the formula (A). The compound represented by the formula (A) is never limited by these examples.

| No. |
|---|
| A-1 |
| A-2 |
| A-3 |

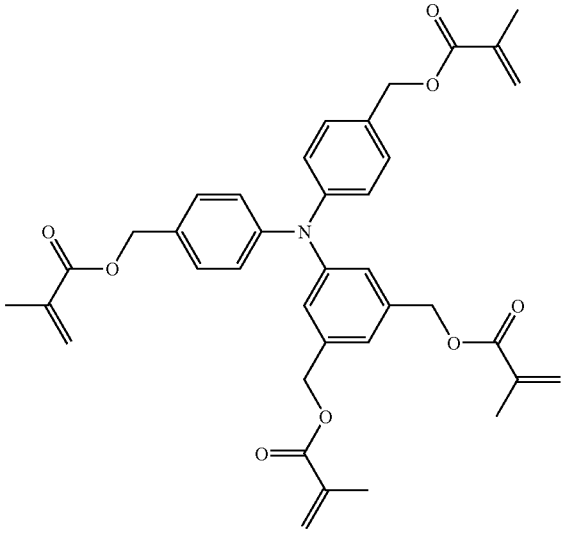

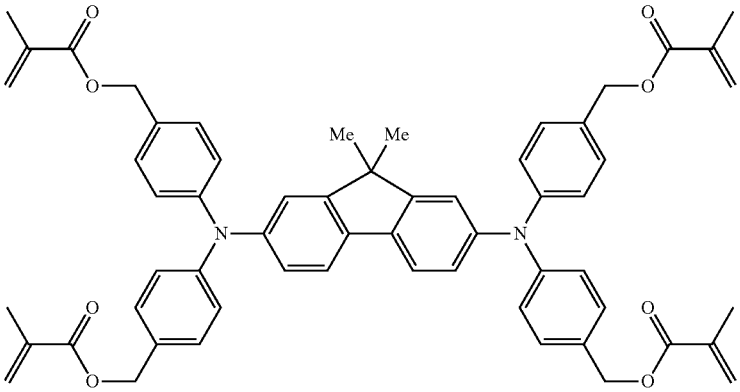

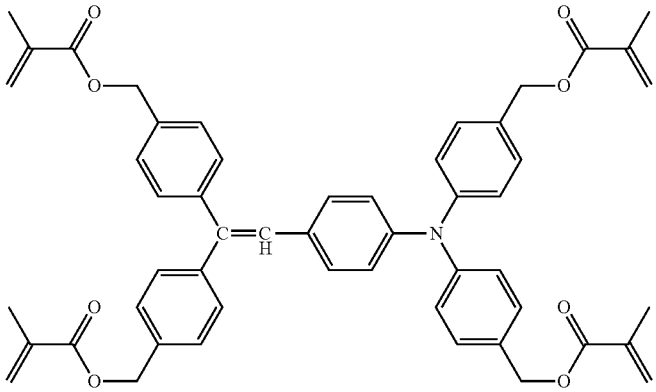

-continued
No.
A-4
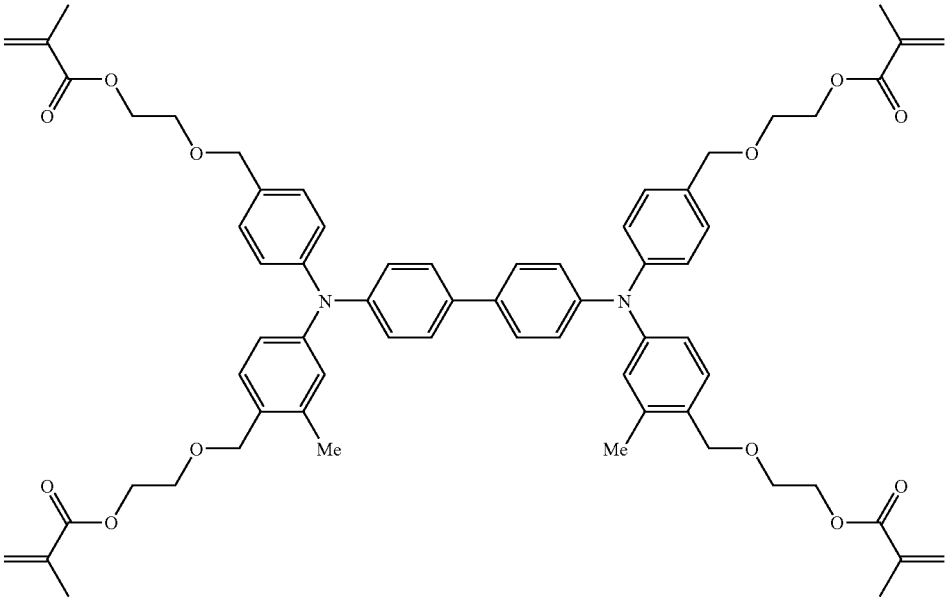
A-5
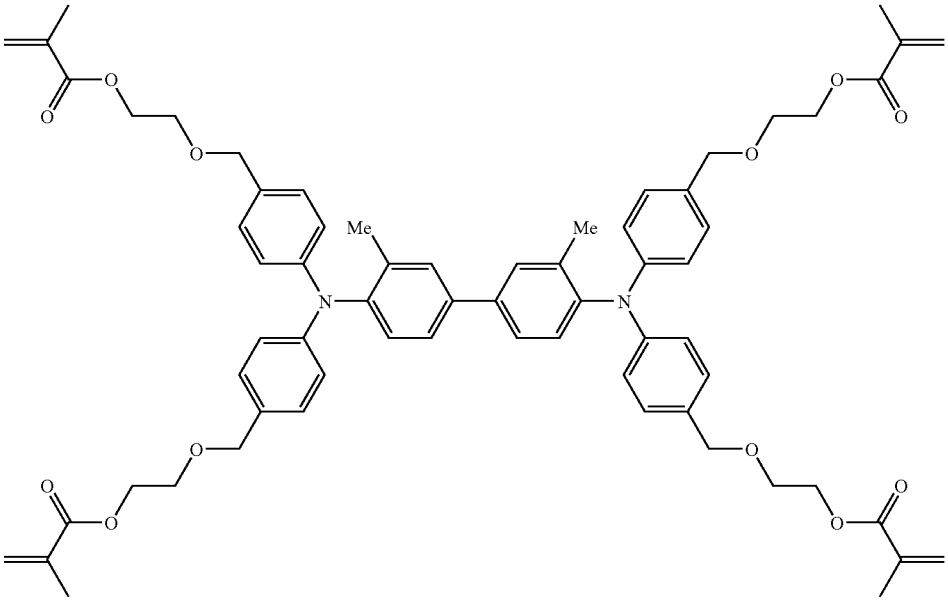

-continued
No.
A-6
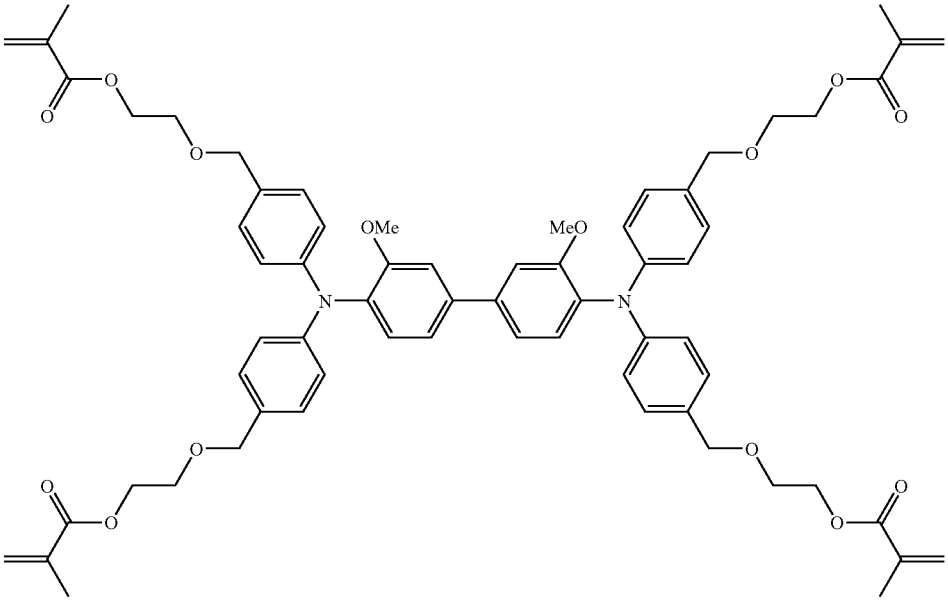
A-7
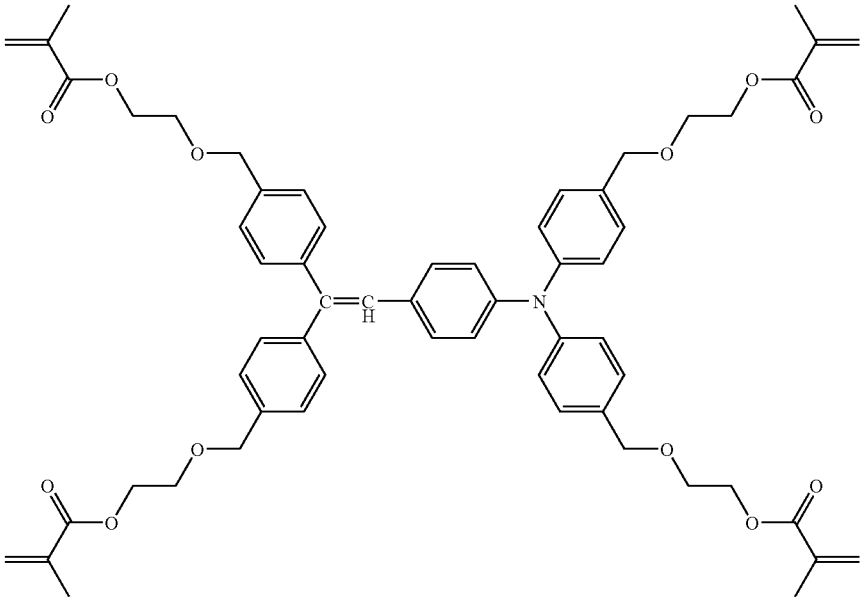

-continued
| No. | |
|---|---|
| A-8 | 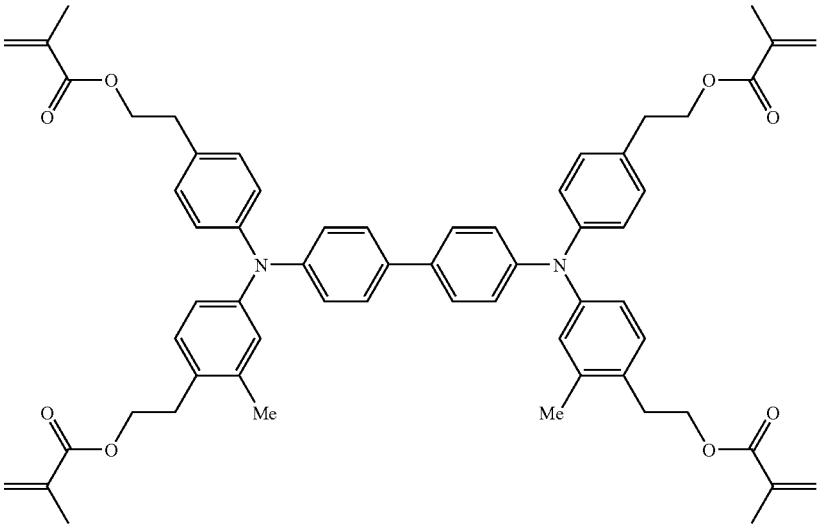 |
| A-9 | 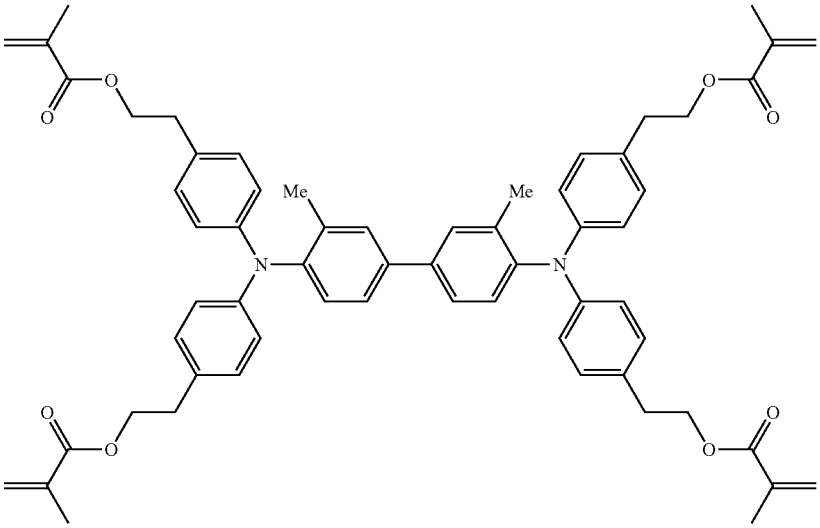 |
| A-10 | 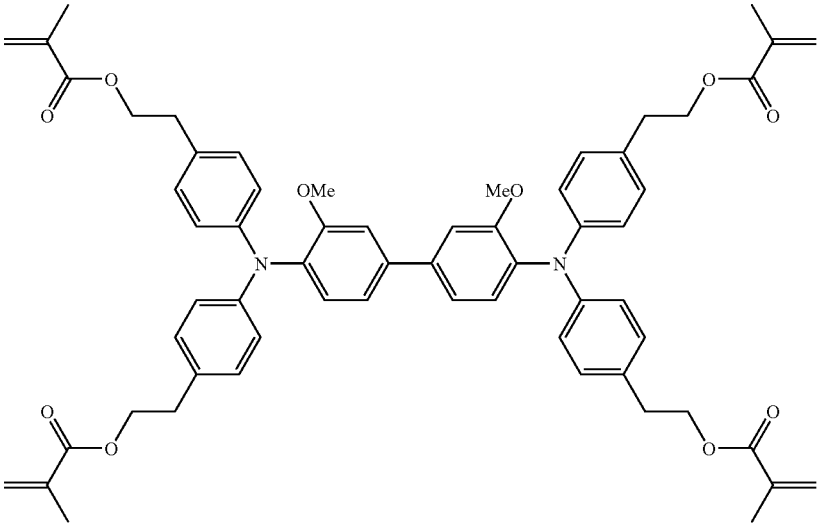 |

-continued
No.
A-11
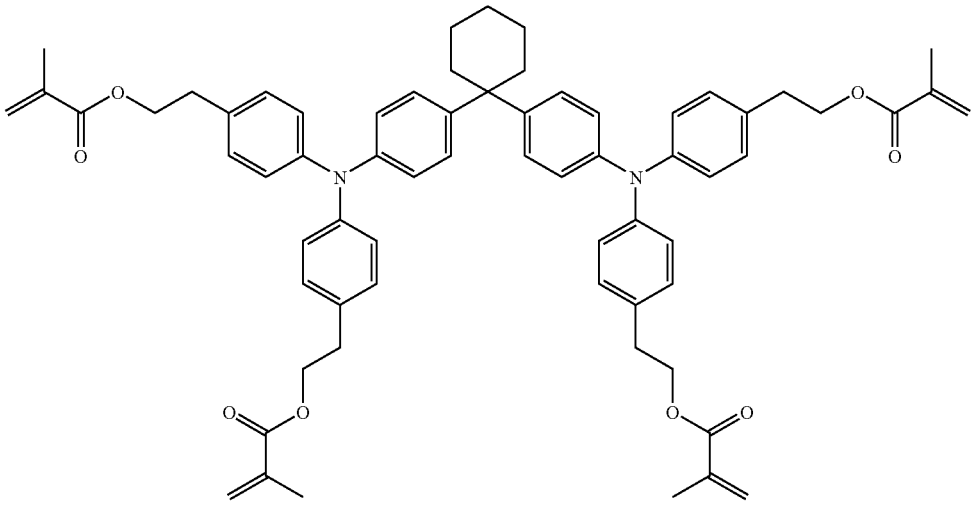
A-12
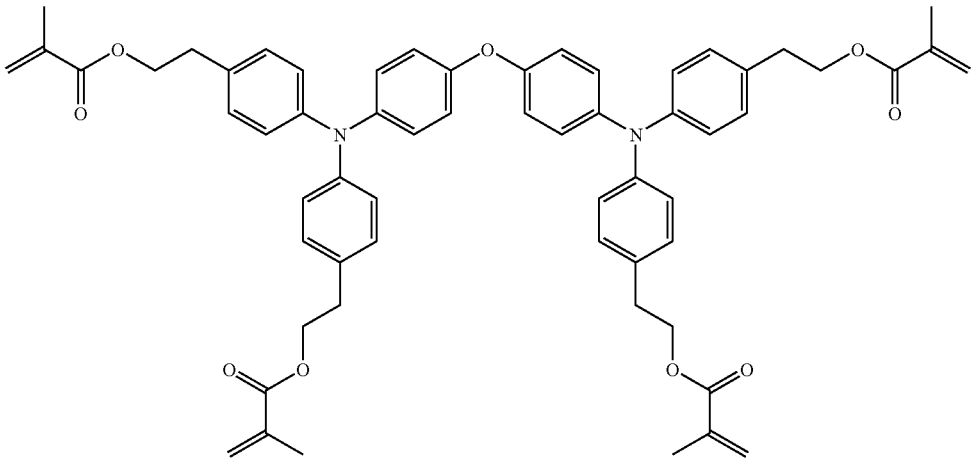
A-13
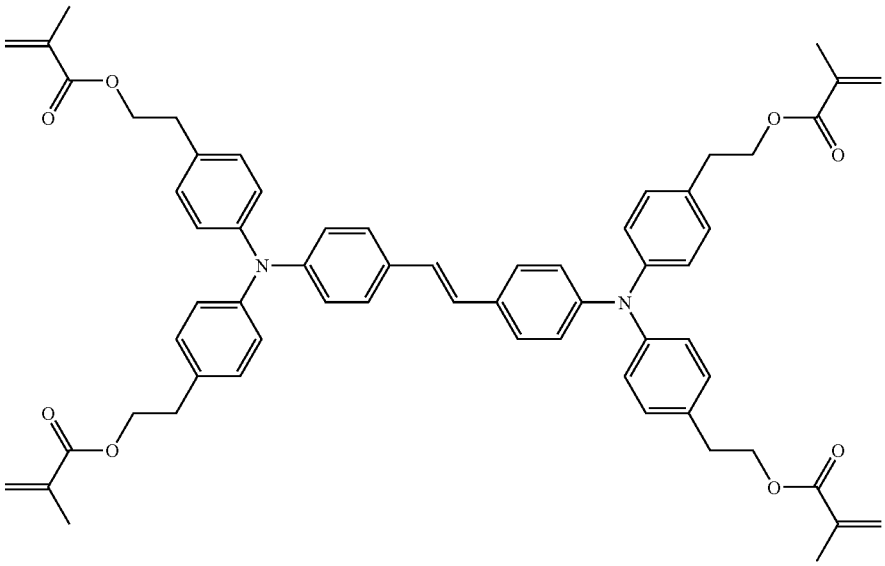

-continued
| No. | |
|---|---|
| A-14 | 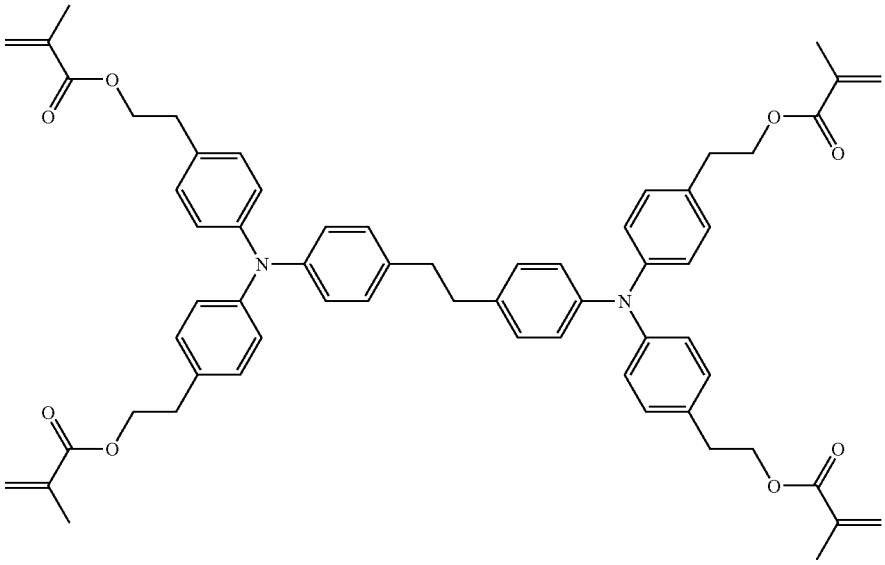 |
| A-15 | 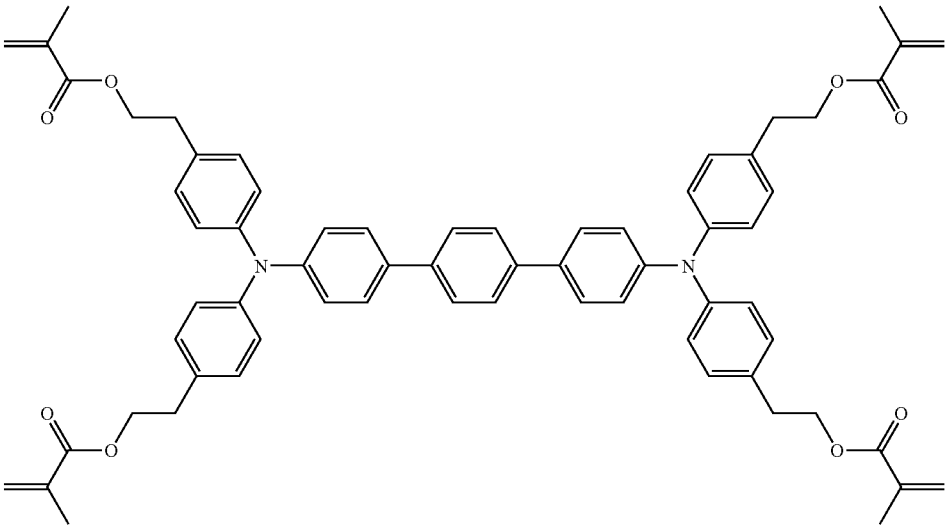 |

-continued
| No. | |
|---|---|
| A-16 | 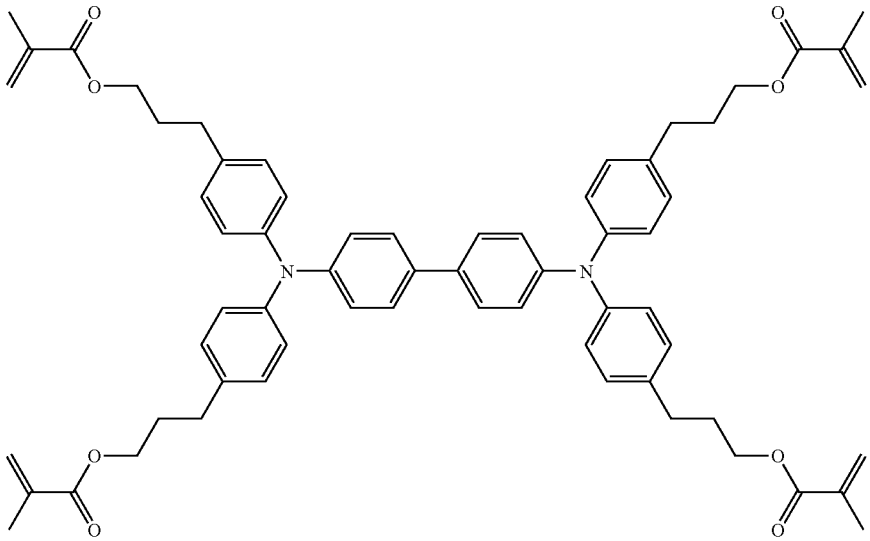 |
| A-17 | 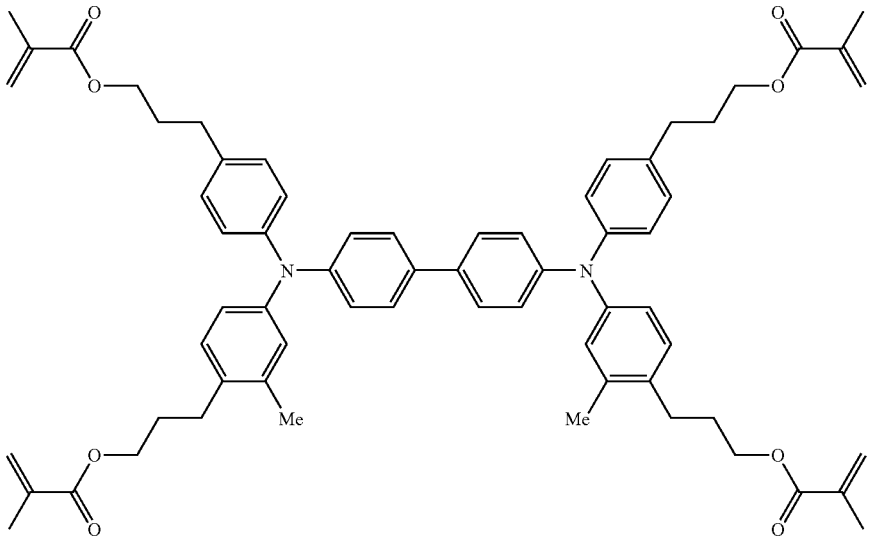 |
| A-18 | 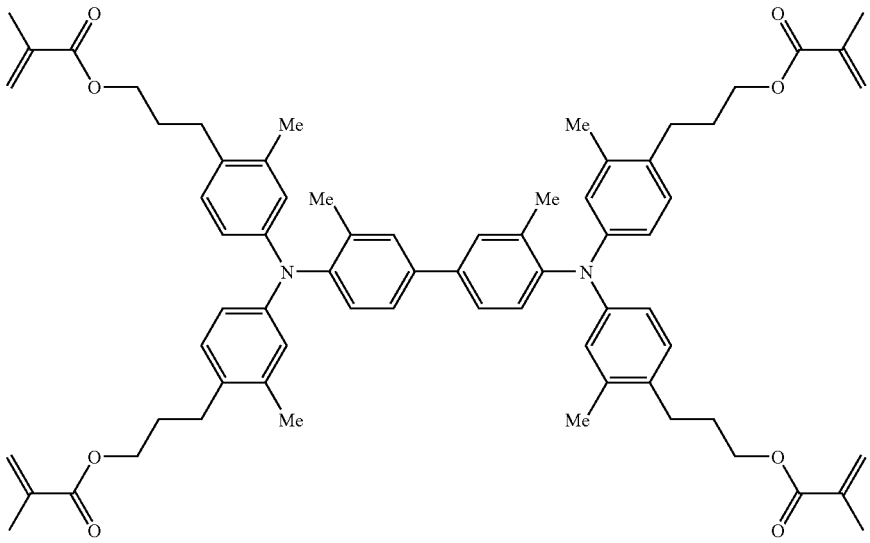 |

-continued
| No. | |
|---|---|
| A-19 | 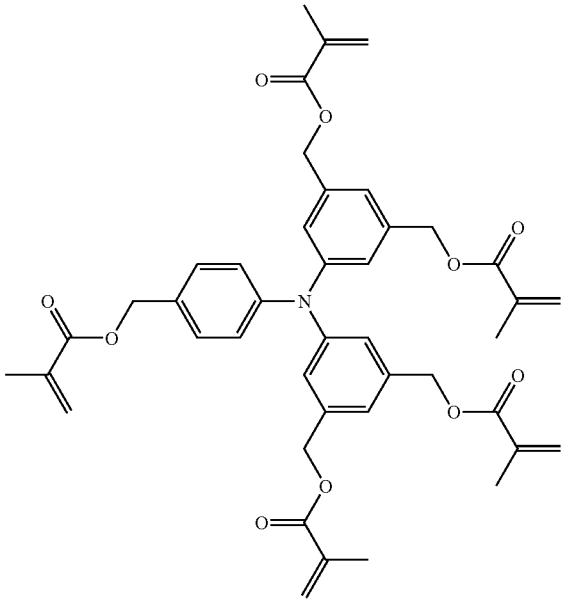 |
| A-20 | 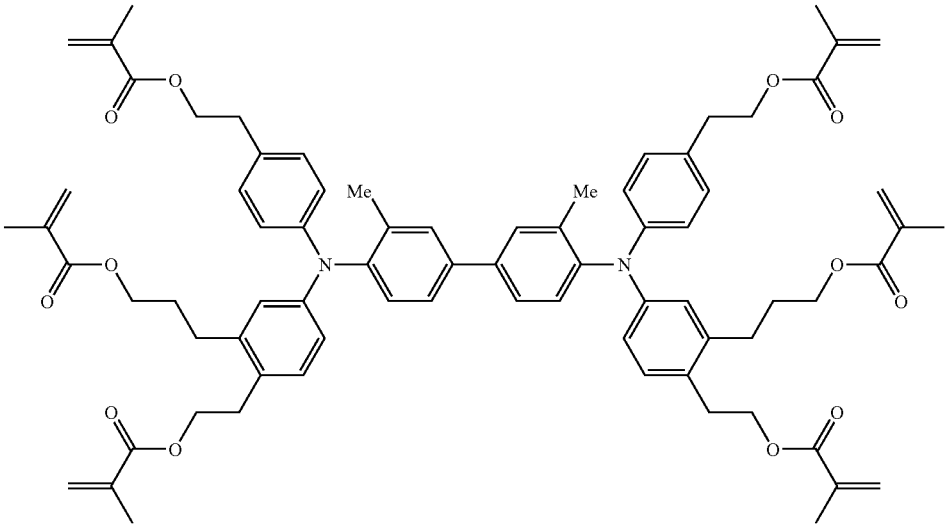 |

-continued

| No. | |
|---|---|
| A-21 | 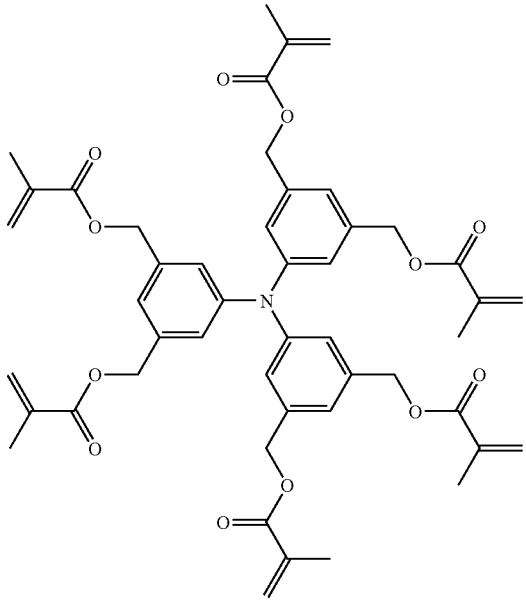 |

The compound represented by the formula (A) is synthesized as follows:

The compound represented by the formula (A) is synthesized by condensing an alcohol which is a precursor thereof with the corresponding methacrylic acid or methacrylic acid halide, or when the precursor alcohol has a benzyl alcohol structure, the compound is synthesized by subjecting the alcohol and a methacrylic acid derivative having a hydroxyl group, such as hydroxyethyl methacrylate, to dehydrating etherification.

A synthesis route of each of the compound A-4 and the compound A-17 used in the exemplary embodiment is shown below, as an example:

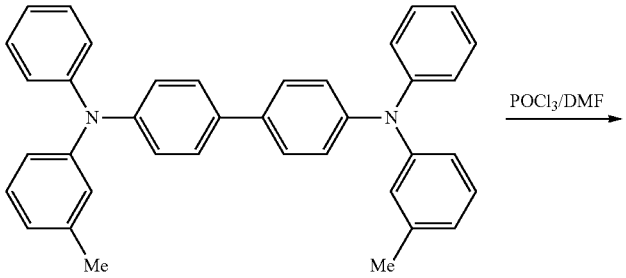

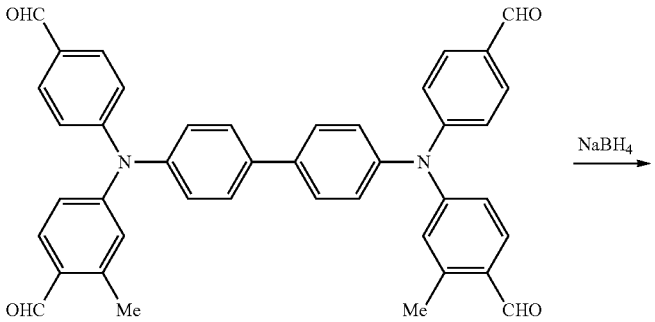

-continued
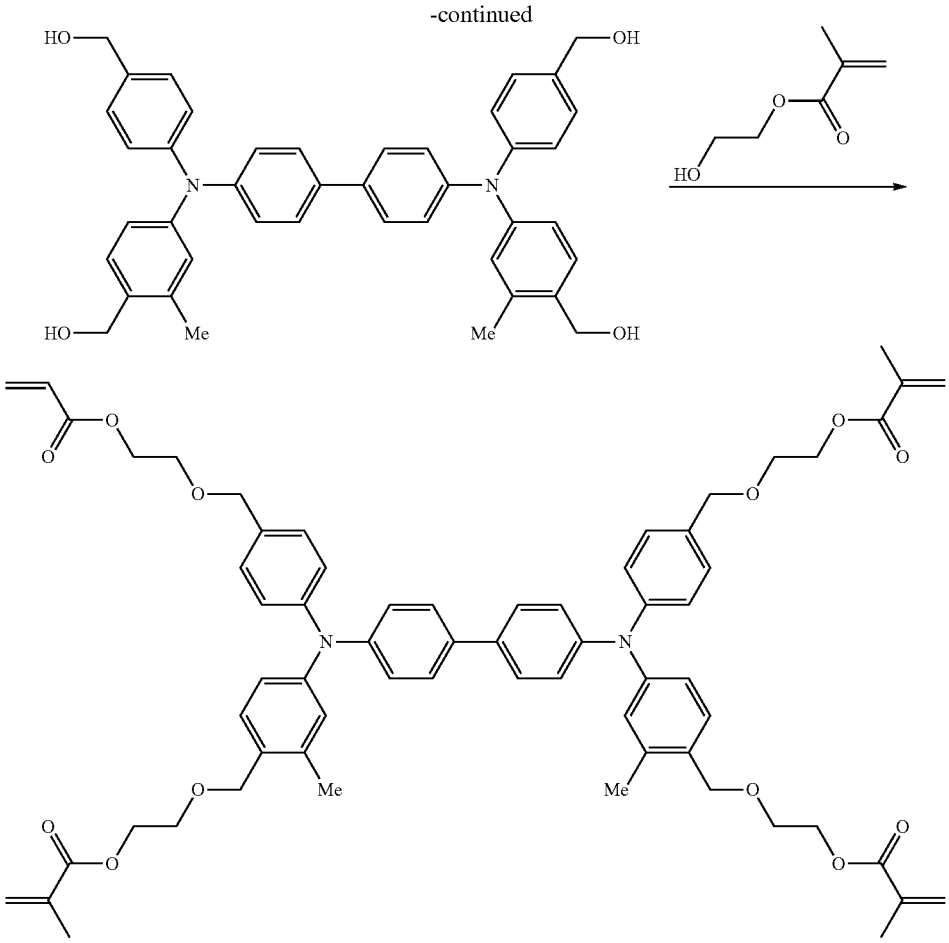
Compound A-4
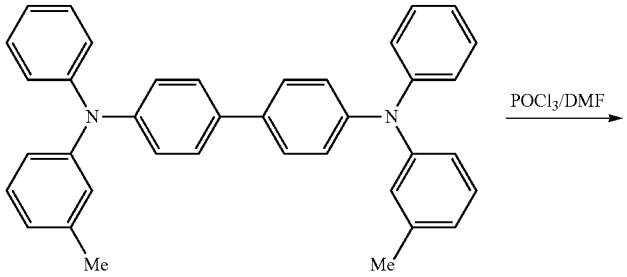
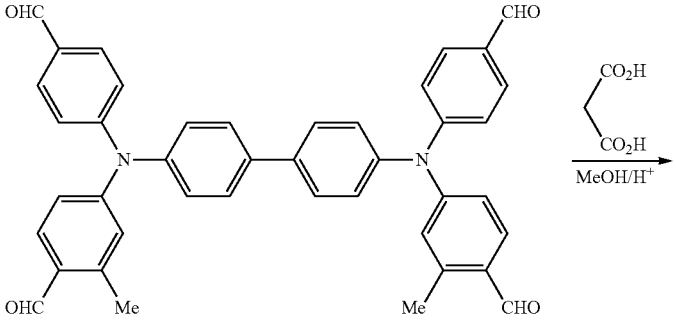

-continued
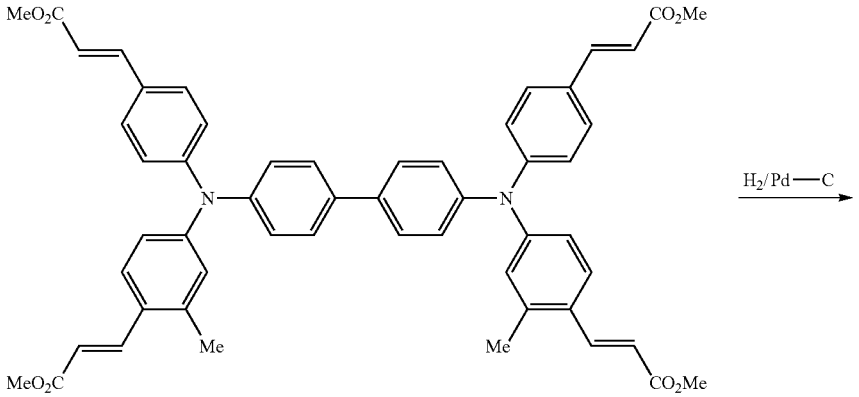
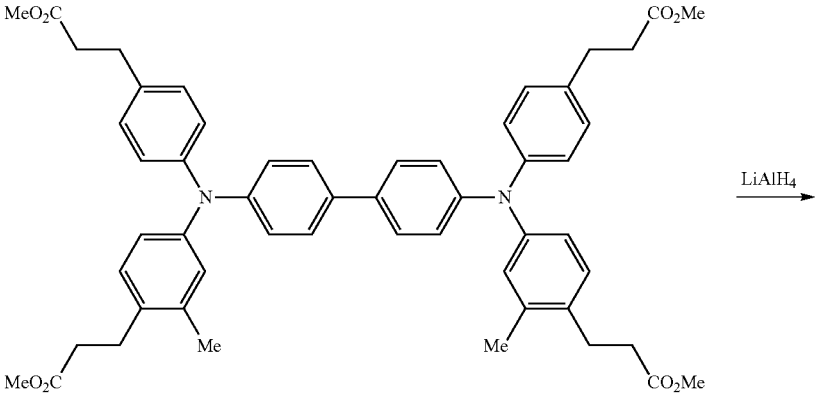
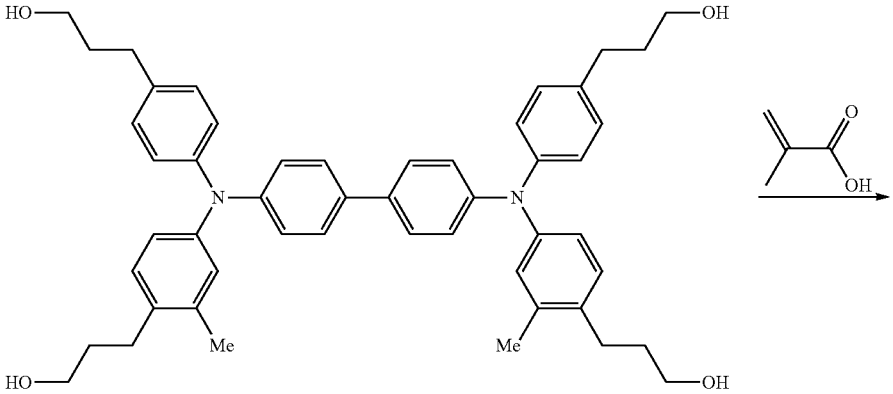

-continued

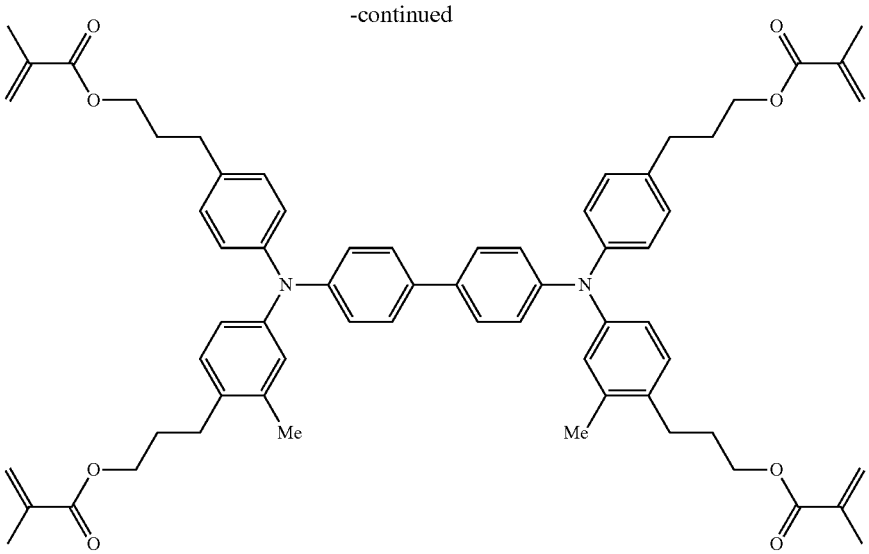

Compound A-17

As an exemplary embodiment of the specific charge transporting material (a), the compounds (a') having, in a single molecule thereof, a triphenylamine skeleton and 4 or more methacryloyl groups are described above. However, the below-described compound other than this compound (hereinafter also referred to as the other reactive charge transporting material (a")) may be also used as the specific charge transporting material (a).

As the other reactive charge transporting material (a"), a compound wherein a chain polymerizable functional group is introduced into a known charge transporting material is used. Examples of the known charge transporting material include triarylamine compounds, benzidine compounds, arylalkane compounds, aryl-substituted ethylene compounds, stylbene compounds, anthracene compounds, and hydrazone compounds, which are each described as a hole transporting compound among charge transporting materials that may each constitute the below-described charge transporting layer 3. Specific examples of the other reactive charge transporting material (a") include compounds described in the JP-A Nos. 5-216249, 2000-206715, 2004-12986, 7-72640, 2004-302450, 2000-206717, 2001-175016, and 2007-86522.

Among the other reactive charge transporting material (a"), a compound having in a single molecule thereof a triphenylamine skeleton and 1 to 3 chain polymerizable functional groups (such as acryloyl groups or methacryloyl groups) may be desirable. In particular, a compound represented by the formula (A) wherein Ds each represent $—(CH_2)_f—(O—CH_2—CH_2)_g—O—CO—C(R)=CH_2$ wherein f represents an integer of 1 to 5, g represents 0 or 1 and R represents a hydrogen atom or a methyl group, and the total number of Ds is from 1 to 3 is desirable. Further, a compound wherein f in D is an integer of 1 to 5 and R in D is a methyl group is desirable.

Specific examples of the other reactive charge transporting material (a") will be described hereinafter.

Specific examples of the compound having in a single molecule thereof a triphenylamine skeleton and a single chain polymerizable functional group (such as an acryloyl group or a methacryloyl group), which is one species of the other reactive charge transporting material (a"), include compounds I-1 and I-12. However, the compound is not limited to these compounds.

| No. | |
|---|---|
| I-1 | 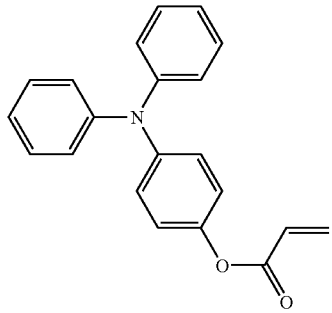 |
| I-2 | 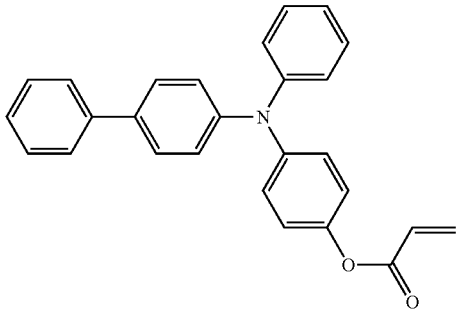 |
| I-3 | 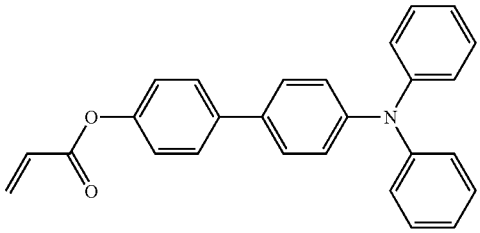 |

-continued
No.
I-4
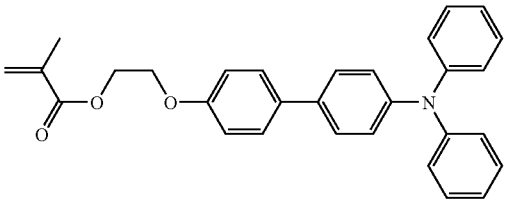
I-5
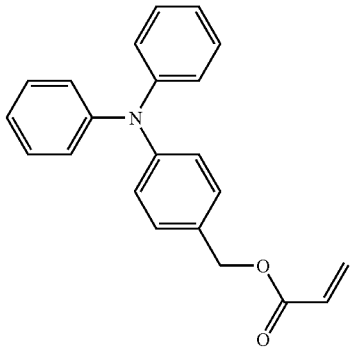
I-6
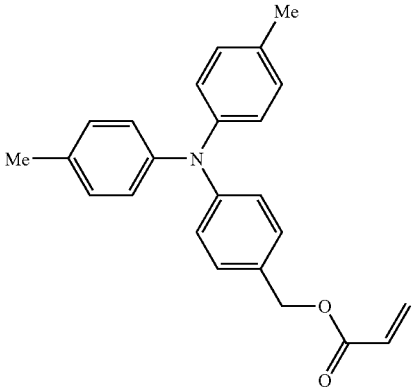
I-7
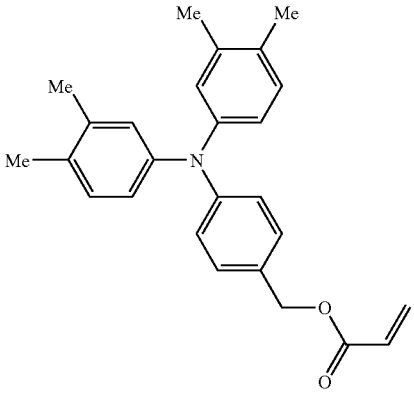
-continued
No.
I-8
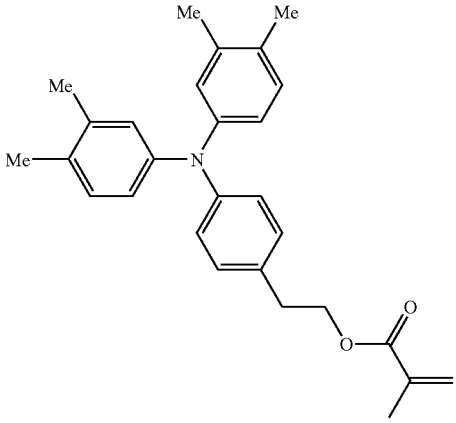
I-9
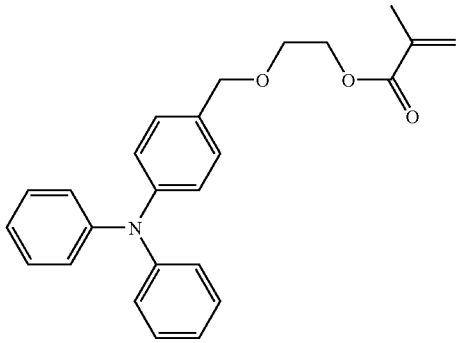
I-10
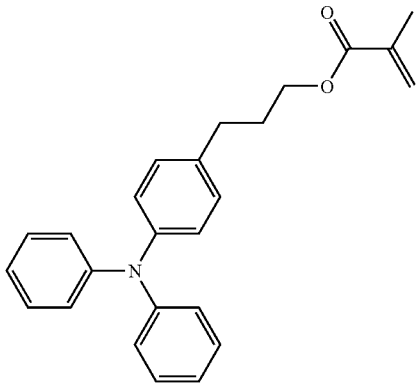

-continued

| No. | |
|---|---|
| I-11 | 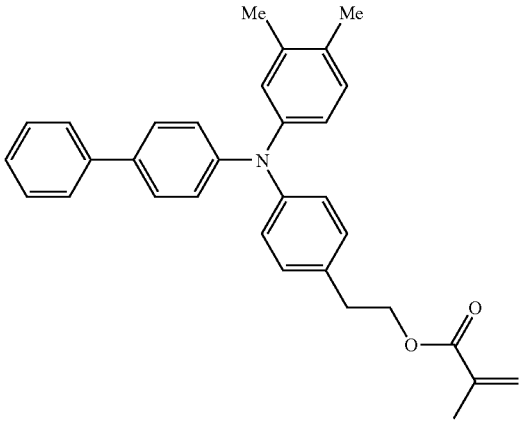 |

-continued

| No. | |
|---|---|
| I-12 | 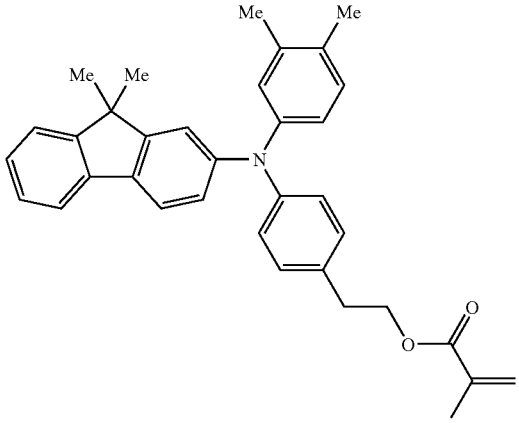 |

Specific examples of the compound having in a single molecule thereof a triphenylamine skeleton and two chain polymerizable functional groups (such as acryloyl groups or methacryloyl groups), which is one species of the other reactive charge transporting material (a"), include compounds II-1 and II-19. However, the compound is not limited to these compounds.

| No. | |
|---|---|
| II-1 | 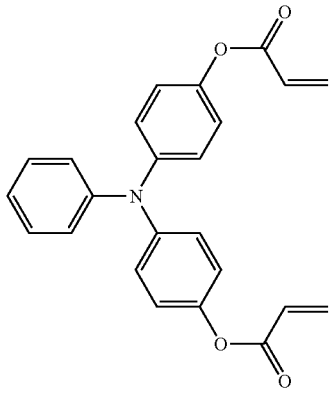 |
| II-2 | 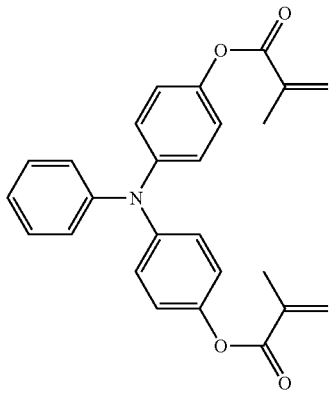 |

-continued
| No. | |
|---|---|
| II-3 | 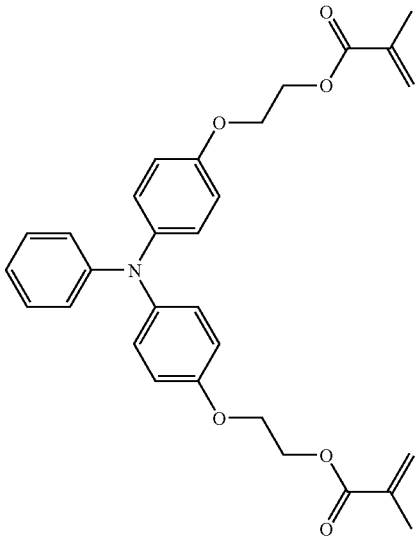 |
| II-4 | 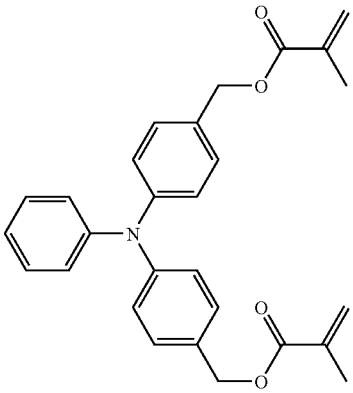 |
| II-5 | 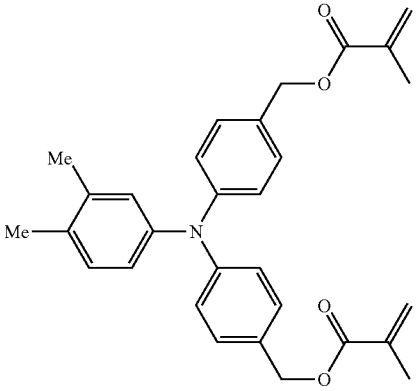 |

-continued
| No. | |
|---|---|
| II-6 | 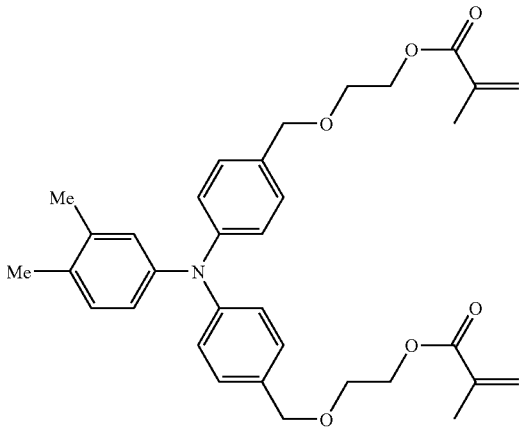 |
| II-7 | 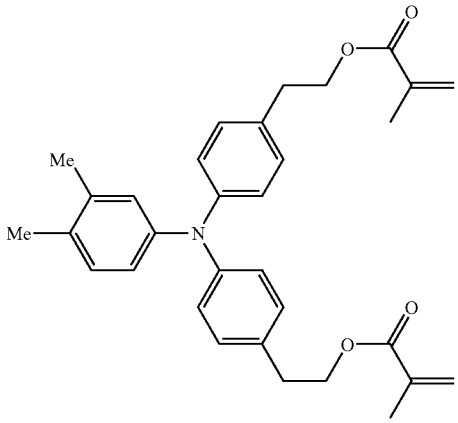 |
| II-8 | 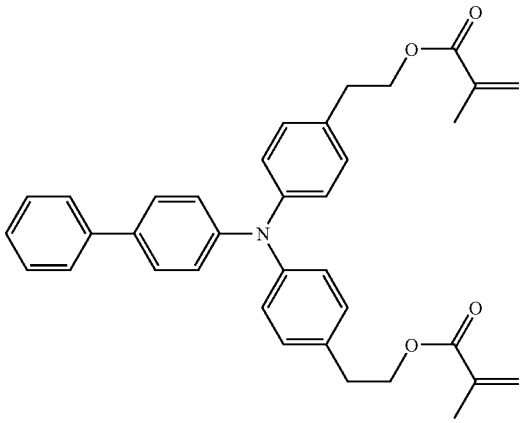 |

-continued
| No. | |
|---|---|
| II-9 | 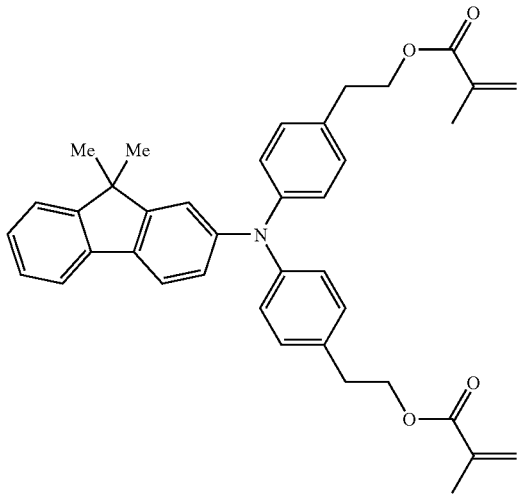 |
| II-10 | 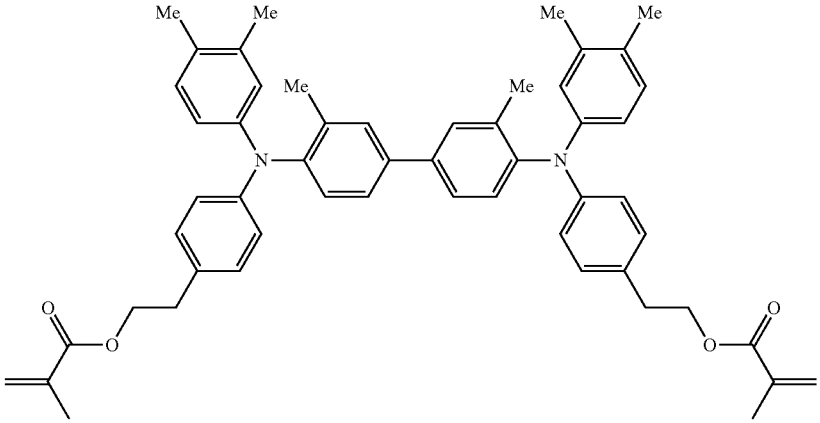 |
| II-11 | 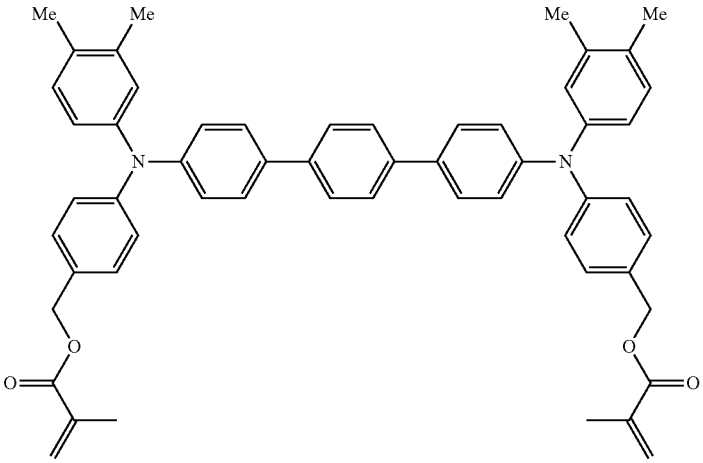 |

-continued
No.
II-12
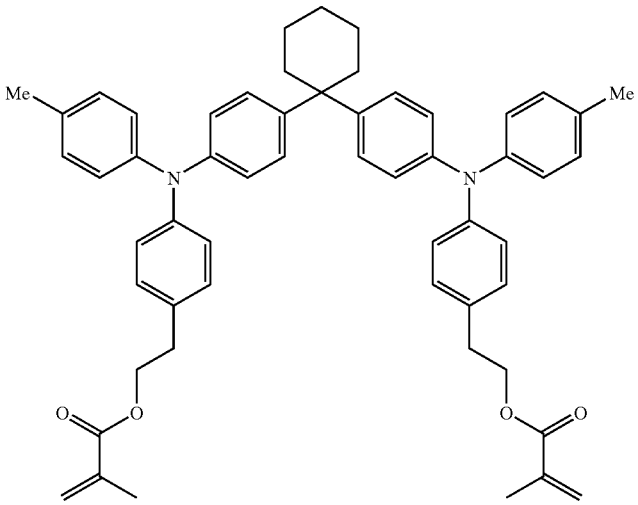
II-13
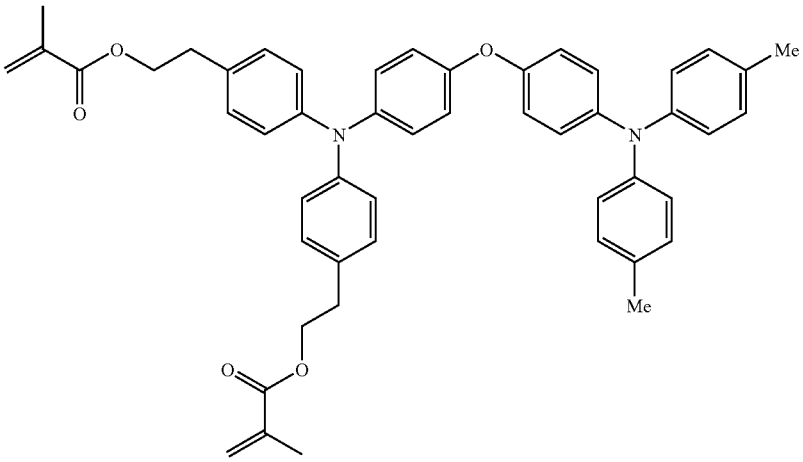
II-14
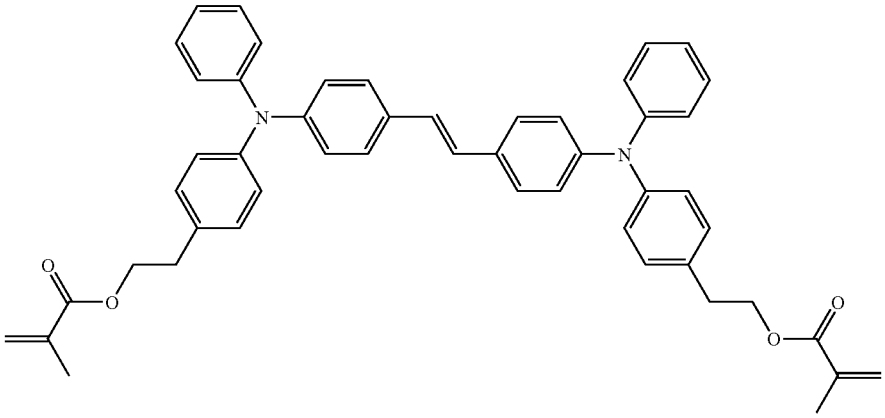

-continued
| No. |
| --- |
| II-15 |
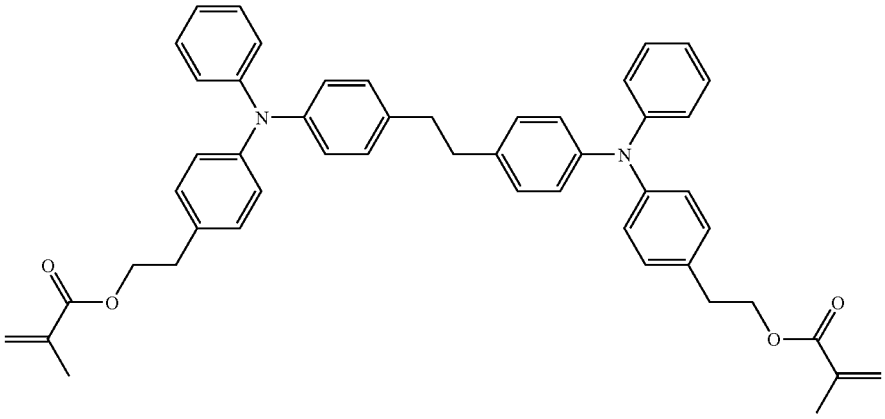
II-16
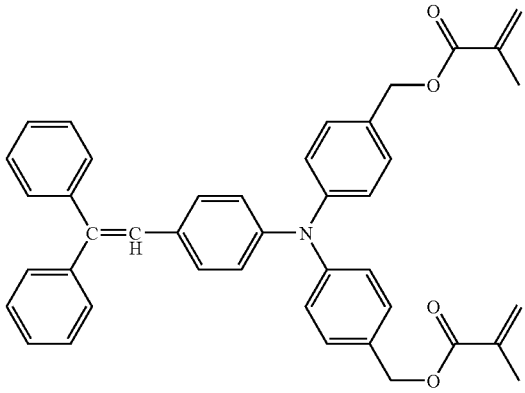
II-17
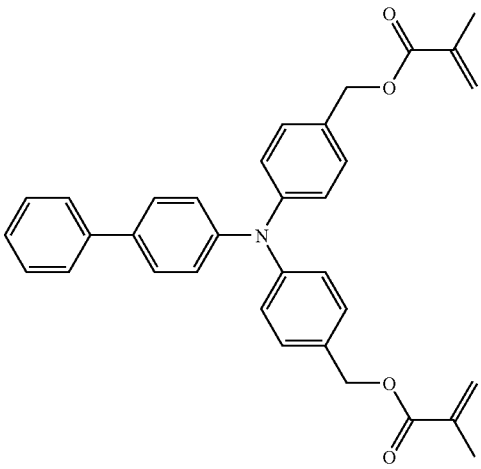

-continued

| No. | |
|---|---|
| II-18 | 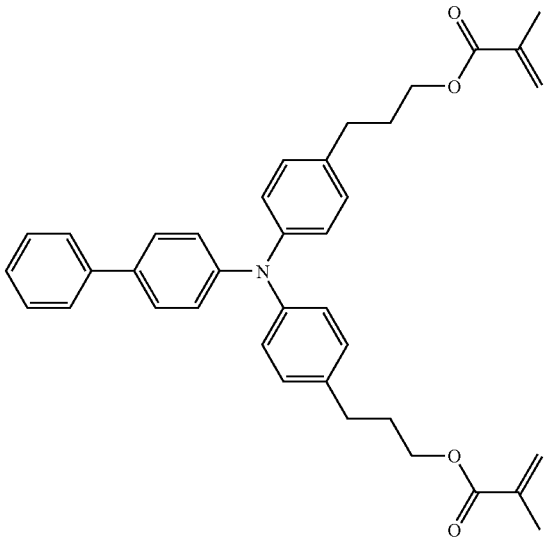 |
| II-19 | 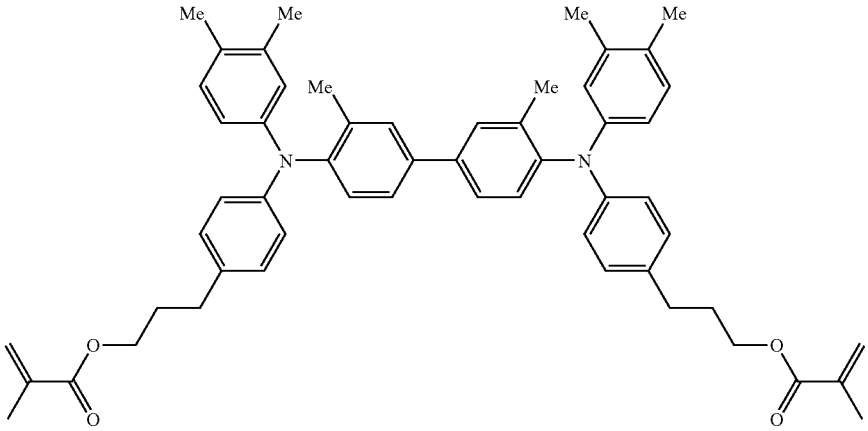 |

Specific examples of the compound having in a single molecule thereof a triphenylamine skeleton and three chain polymerizable functional groups (such as acryloyl groups or methacryloyl groups), which is one species of the other reactive charge transporting material (a"), include compounds III-1 and III-11. However, the compound is not limited to these compounds.

| No. | |
|---|---|
| III-1 | 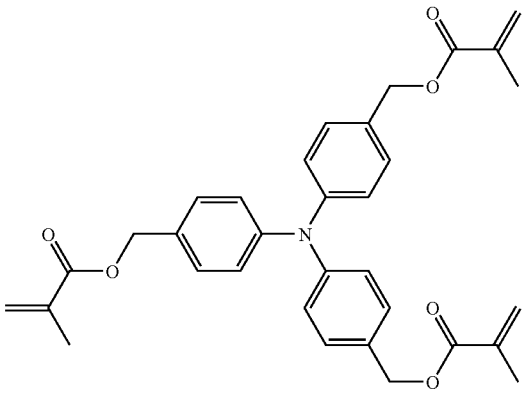 |

-continued
No.
III-2
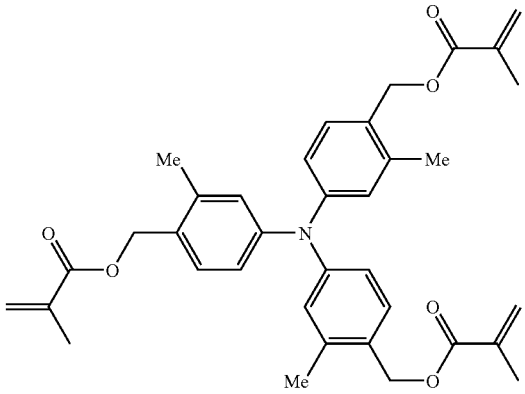
III-3
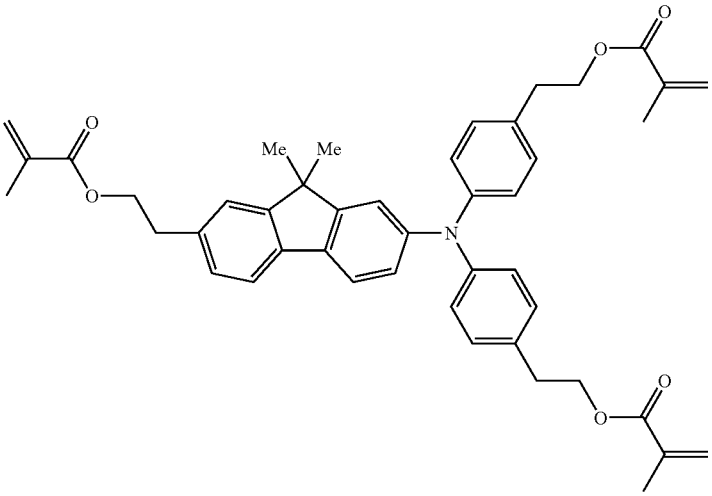
III-4
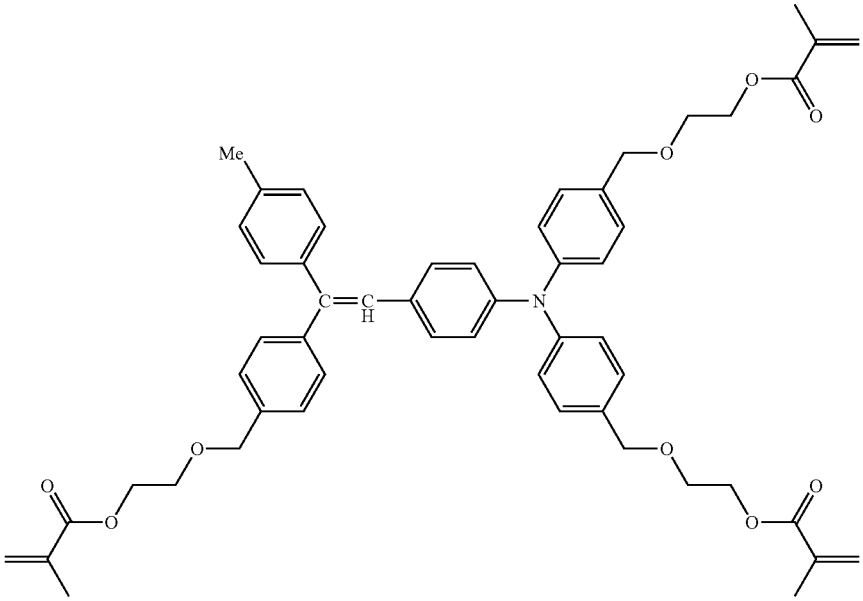

-continued
| No. |
| --- |
| III-5 |
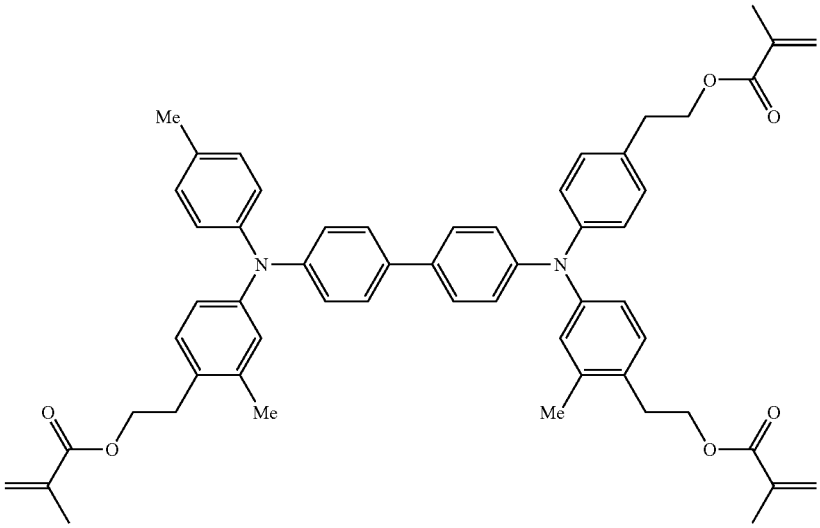
III-6
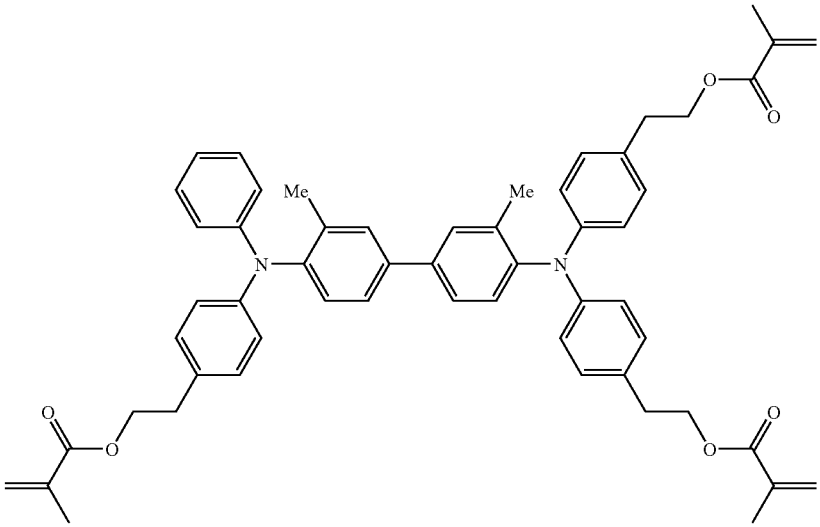
III-7
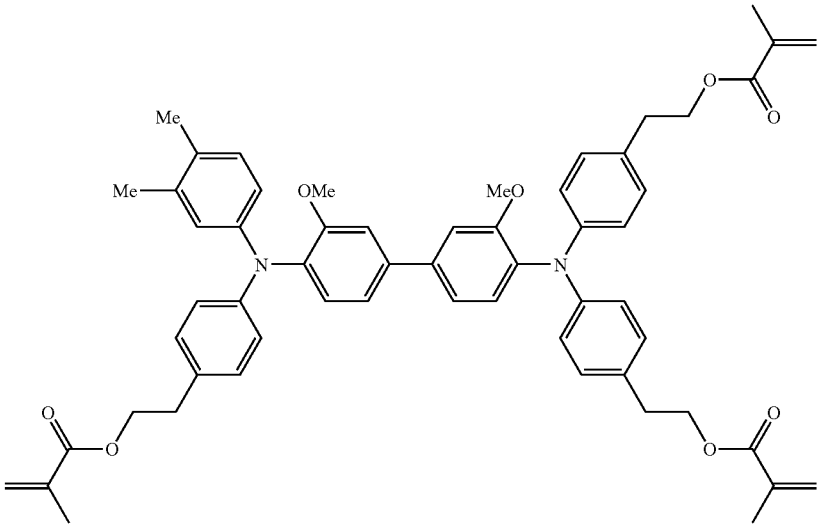

-continued
No.
III-8
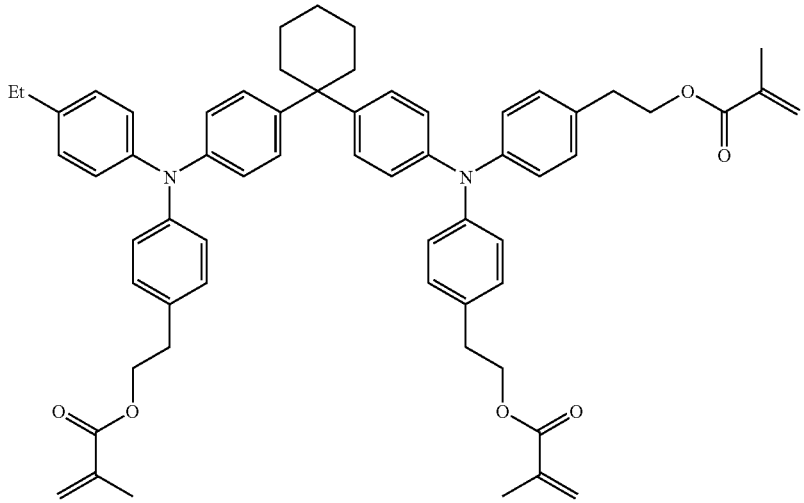
III-9
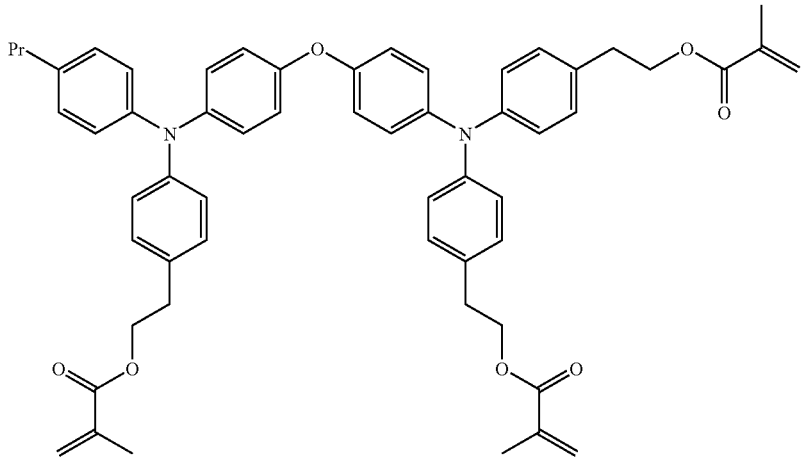
III-10
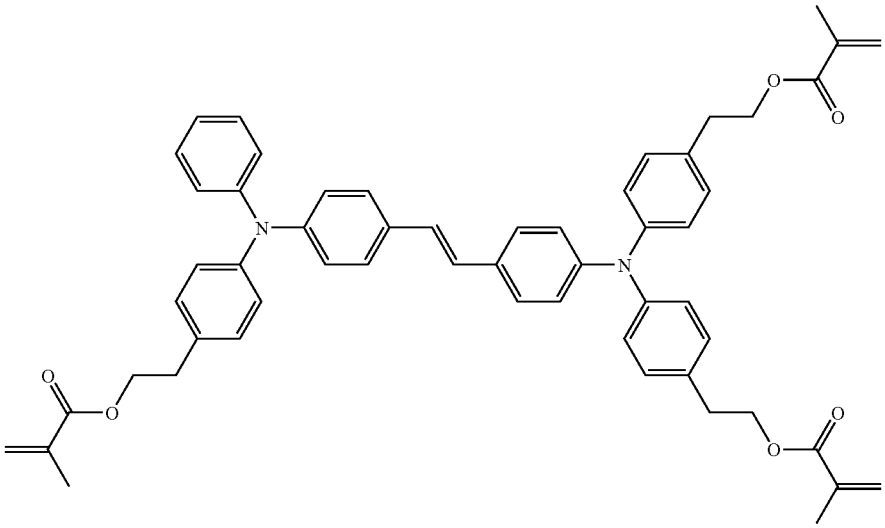

-continued

| No. | |
|---|---|
| III-11 | 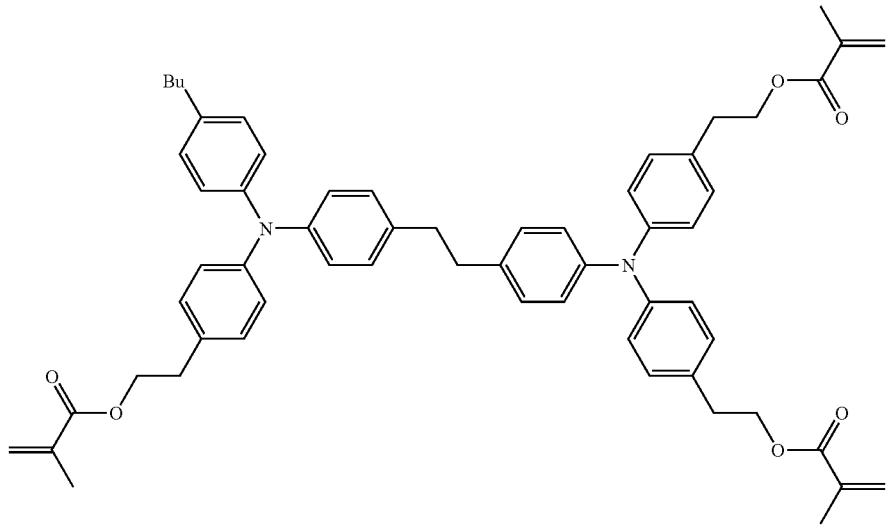 |

The total content by percentage of the specific charge transporting material (a) is preferably from 30 to 100% by weight of the composition used to form the protective layer (outermost layer) 5, more preferably from 40 to 100% by weight thereof, and even more preferably from 50 to 100% by weight thereof.

When the content is in this range, the cured membrane (outermost layer) is excellent in electric characteristics and may be made thick.

The content by percentage of the compound having a charge transporting skeleton and 3 or more chain polymerizable functional groups (such as acryloyl groups or methacryloyl groups), out of examples of the specific charge transporting material (a), is preferably 5% or more by weight of the composition used to form the protective layer (outermost layer) 5, more preferably 10% or more by weight thereof, and even more preferably 15% or more by weight thereof.

In the present exemplary embodiment, a compound having a charge transporting skeleton and 4 or more chain polymerizable functional groups (such as acryloyl groups or methacryloyl groups) and a compound having a charge transporting skeleton and one or two chain polymerizable functional groups (such as acryloyl groups or methacryloyl groups) may be desirably used together as the specific charge transporting material (a). Particularly, a compound represented by the formula (A) and a compound having, in a single molecule thereof, a triphenylamine skeleton and one or two chain polymerizable functional groups (such as acryloyl groups or methacryloyl groups) are desirably used together.

In the present exemplary embodiment, a decline in the amount of charge transporting skeletons present is inhibited so that the crosslinkage density is made lower than in a case where the whole of the specific charge transporting material (a) is made of a compound having 4 or more chain polymerizable functional groups (such as acryloyl groups or methacryloyl groups). Therefore, the strength of the cured membrane (outermost layer) is adjusted while the membrane retains electric characteristics.

When a compound having a charge transporting skeleton and 4 or more chain polymerizable functional groups (such as acryloyl groups or methacryloyl groups) and a compound having a charge transporting skeleton and 1 to 3 chain polymerizable functional groups (such as acryloyl groups or methacryloyl groups) are used together, the former compound, which has a charge transporting skeleton and 4 or more chain polymerizable functional groups (such as acryloyl groups or methacryloyl groups), may preferably be contained in the specific charge transporting material (a) in an amount of 5% or more by weight of the material (a), more preferably 10% or more by weight, and even more preferably 15% or more by weight.

In the cured membrane constituting the protective layer (outermost layer) 5, the specific charge transporting material (a) is used and, if necessary, a known charge transporting material having no reactive group may be used. The term "reactive group" means a radical-polymerizable unsaturated bond.

The known charge transporting material having no reactive groups does not have any reactive group which does not have a function of charge transportation; therefore, for example, when this known charge transporting material is used together, the concentration of the charge transporting component(s) is substantially increased whereby the electric characteristics of the cured membrane (outermost layer) are improved. Additionally, the known charge transporting material having no reactive group may contribute to the adjustment of the strength of the cured membrane (outermost layer). Furthermore, the specific charge transporting material (a) has a charge transporting skeleton; therefore, the material (a) has very good compatibility with the known charge transporting material having no reactive group. Therefore, the material (a) may be doped with a conventional charge transporting material having no reactive group so that the electric characteristics may be greatly improved.

Examples of the known charge transporting material having no reactive group include those recited as examples of the charge transporting materials that may each constitute the below-described charge transporting layer 3. In particular, a material having a triphenylamine skeleton is desired from the viewpoint of, for example, mobility and compatibility.

The known charge transporting material having no reactive group may be used desirably in an amount of 2 to 50% by weight, more preferably from 5 to 45% by weight, and even more preferably from 10 to 40% by weight, of solids in a coating solution respectively.

Next, the specific silicone polymerization initiator (b) will be described.

In order to form the protective layer (outermost layer) 5, a composition containing at least one specific silicone polymerization initiator (b) is used together with the specific charge transporting material (a). The specific silicone polymerization initiator (b) is a thermopolymerizable silicone polymeric radical polymerization initiator, or a photopolymerizable silicone polymeric radical polymerization initiator.

First, the thermopolymerizable silicone polymeric radical polymerization initiator is described herein.

Examples of the initiator include an azo compound having a siloxane skeleton and a peroxide having a siloxane skeleton.

As the thermopolymerizable silicone polymeric radical polymerization initiator, an azo compound having a siloxane skeleton may be desirable in order to improve the surface lubricating property of the electrophotographic photoreceptor. Examples of the azo compound having a siloxane skeleton include an azo compound having a polydimethylsiloxane skeleton, a polydiphenylsiloxane skeleton, or a polymethylphenylsiloxane skeleton.

Among these azo compounds having a siloxane skeleton, azo compounds represented by the following formula (1) are desirable:

(1)

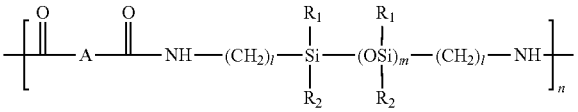

In the formula (1), $R_1$s and $R_2$s each independently represent a linear or branched alkyl group having one or more carbon atoms or a substituted or unsubstituted aryl group; 1 represents an integer of 1 to 10; m represents an integer of 1 to 10; n represents an integer of 1 to 10; and A represents a bivalent organic group having an azo group.

In the formula (1), the alkyl group represented by each of $R_1$s and $R_2$s is preferably an alkyl group having 1 to 8 carbon atoms, more preferably an alkyl group having 1 to 4 carbon atoms. Specific examples thereof include methyl, ethyl, n-propyl, i-propyl, n-butyl, t-butyl, n-hexyl, n-octyl, and 2-ethylhexyl groups.

In the formula (1), the aryl group represented by each of $R_1$s and $R_2$s is preferably an aryl group having 6 to 18 carbon atoms, more preferably an aryl group having having 6 to 12 carbon atoms. Specific examples thereof include phenyl, naphthyl, anthryl, phenanthryl, pyrenyl, triphenylenyl, biphenyl, and terphenyl groups.

The bivalent organic group represented by A, which has an azo group, is, for example, a group derived from an aromatic azo compound, an alicyclic azo compound, or an alkylazo compound. Specific preferred examples thereof include the following bivalent organic groups (1-1) and (1-4), which each have an azo group:

(1-1)

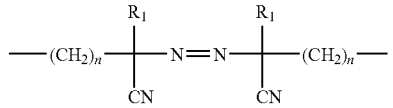

(1-2)

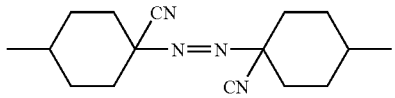

(1-3)

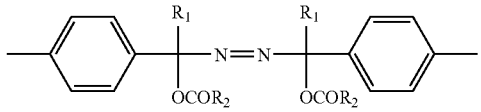

(1-4)

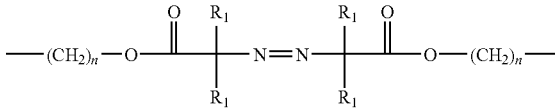

In the bivalent organic groups (1-1) to (1-4), $R_1$s and $R_2$s each represent a linear or branched alkyl group having one or more carbon atoms, or a substituted or unsubstituted aryl group; and n's each represent an integer of 0 to 10.

The azo compound represented by the formula (1) may be preferably an azo compound wherein $R_1$s and $R_2$s each represent a methyl group, 1 is 3, m is 3, n is 4, and A represents an aromatic azo compound, an alicyclic azo compound or an alkylazo compound.

Specific examples of the compound represented by the formula (1) include compounds (z-1) to (z-4) illustrated below. The azo compound represented by the formula (1) is never limited by these examples. In the formulae (z-1) to (z-4), x's each represent an integer of 1 to 10, and n's each represent an integer of 1 to 10.

(z-1)

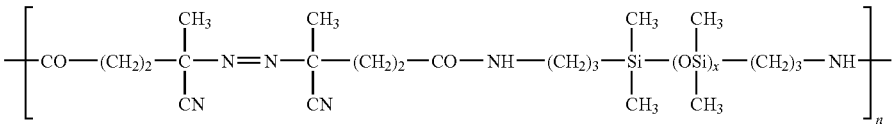

(z-2)

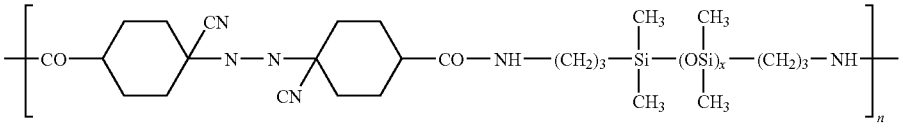

-continued (z-3)

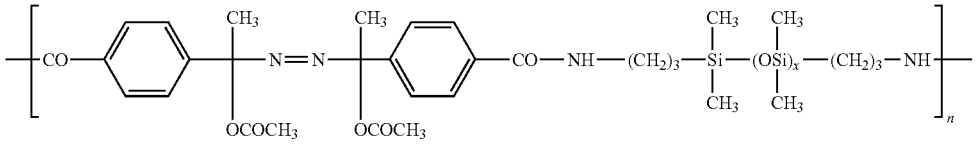

(z-4)

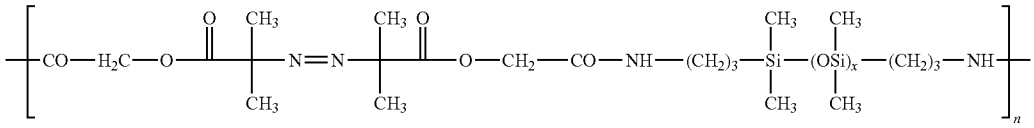

Next, the photopolymerizable silicone polymeric radical polymerization initiator will be described.

The initiator is, for example, an intermolecular cleavable compound having a siloxane skeleton, a hydrogen withdrawing compound having a siloxane skeleton, or an inter-ion-pair electron transferring compound having a siloxane skeleton.

Among these photopolymerizable silicone polymeric radical polymerization initiators, an intermolecular cleavable compound having a siloxane skeleton is desirable to improve the surface lubricating property of the electrophotographic photoreceptor. The intermolecular cleavable compound having a siloxane skeleton is, for example, an intermolecular cleavable compound having a polydimethylsiloxane skeleton, a polydiphenylsiloxane skeleton, or a polymethylphenylsiloxane skeleton.

Among these intermolecular cleavable compounds having a siloxane skeleton, an intermolecular cleavable compound represented by the following formula (2) is desirable:

(2)

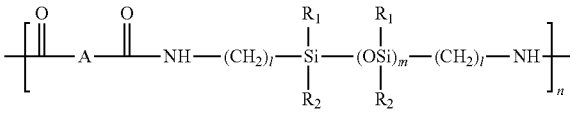

In the formula (2), $R_1$s and $R_2$s each independently represent a linear or branched alkyl group having one or more carbon atoms, or a substituted or unsubstituted aryl group; l represents an integer of 1 to 10; m represents an integer of 1 to 10; n represents an integer of 1 to 10; and A represents an intermolecular cleavable radical-generating moiety.

In the formula (2), the alkyl group represented by each of $R_1$s and $R_2$s is preferably an alkyl group having 1 to 8 carbon atoms, more preferably an alkyl group having 1 to 4 carbon atoms. Specific examples thereof include methyl, ethyl, n-propyl, i-propyl, n-butyl, t-butyl, n-hexyl, n-octyl, and 2-ethylhexyl groups.

In the formula (2), the aryl group represented by each of $R_1$s and $R_2$s is preferably an aryl group having 6 to 18 carbon atoms, more preferably an aryl group having an aryl group having 6 to 12 carbon atoms. Specific examples thereof include phenyl, naphthyl, anthryl, phenanthryl, pyrenyl, triphenylenyl, biphenyl, and terphenyl groups.

In the formula (2), the intermolecular cleavable radical-generating moiety may be a bivalent organic group generated from each of compounds described below. Examples of the compounds, which may each turn to the intermolecular cleavable radical-generating moiety, include benzoin compounds, benzylketal compounds, α-hydroxyacetophenone compounds, α-aminoacetophenone compounds, acylphosphine oxide compounds, titanocene compounds, trichloromethyltriazine compounds, and bisimidazole compounds.

Among these intermolecular cleavable compounds represented by the formula (2), an intermolecular cleavable compound wherein $R_1$s and $R_2$s each represent a methyl group, l is 3, m is 3, n is 4, and A represents a benzoin compound, a benzylketal compound, an α-aminoacetophenone compound, or an acylphosphine oxide compound is preferable.

Specific examples of the intermolecular cleavable compound represented by the formula (2) include compounds (h-1) to (h-4) illustrated below. The intermolecular cleavable compound represented by the formula (2) is never limited by these examples. In the formulae (h-1) to (h-4), x's each represent an integer of 1 to 10, and n's each represent an integer of 1 to 10.

(h-1)

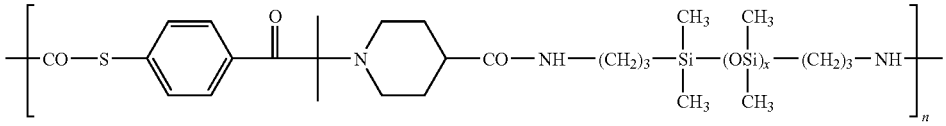

(h-2)

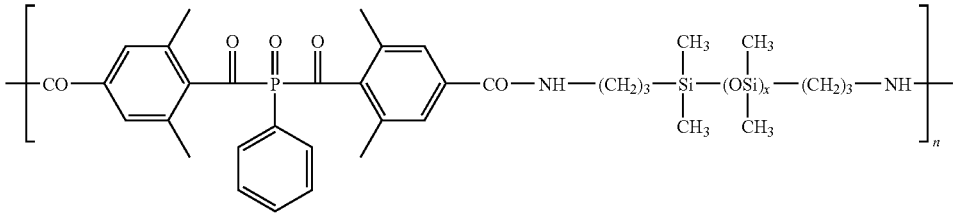

-continued (h-3)

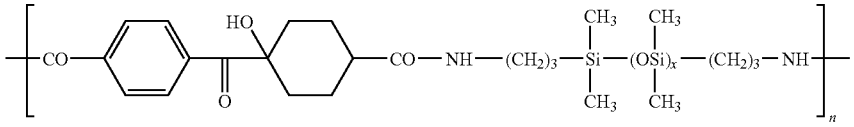

(h-4)

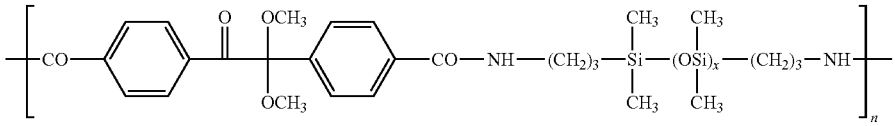

The total content by percentage of the specific silicone polymerization initiator (b) is preferably from 0.1 to 10% by weight of the whole of solids in the composition containing the specific charge transporting material (a), more preferably from 0.2 to 8% by weight thereof, and even more preferably from 0.5 to 5% by weight thereof.

When the thermopolymerizable silicone polymeric radical polymerization initiator is used, the specific silicone polymerization initiator (b) may be used together with a commercially available product of a thermopolymerization initiator, such as an azo initiator or a peroxide initiator, as described below.

Examples of the commercially available product of the thermopolymerization initiator include azo initiator products V-30, V-40, V-59, V601, V65, V-70, VF-096, VAM-110 and VAM-111 (manufactured by Wako Pure Chemical Industries, Ltd.), products OTAZO-15, OTAZO-30, AIBM, AMBN, ADVN and ACVA (manufactured by Ohtsuka Chemical Industrial Co., Ltd.); and products PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PERROYL IB, PERROYL 355, PERROYL L, PERROYL SA, NYPER BW, NYPER BMT-K40/M, PERROYL IPP, PERROYL NPP, PERROYL TCP, PERROYL OPP, PERROYL SBP, PERCUMYL ND, PEROCTA ND, PERHEXYL ND, PERBUTYL ND, PERBUYTL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT and PERBUTYL Z (manufactured by NFO Corp.), KAYAKETAL AM-C55, TRIGONOX 36-C75, RAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGONOX 117 and KAYARENE 6-70 (manufactured by Kayaku Akzo Corp.), and products RUPEROX 610, RUPEROX 188, RUPEROX 844, RUPEROX 259, RUPEROX 10, RUPEROX 701, RUPEROX 11, RUPEROX 26, RUPEROX 80, RUPEROX 7, RUPEROX 270, RUPEROX P, RUPEROX 546, RUPEROX 554, RUPEROX 575, RUPEROX TANPO, RUPEROX 555, RUPEROX 570, RUPEROX TAP, RUPEROX TBIC, RUPEROX TBEC, RUPEROX JW, RUPEROX TAIC, RUPEROX TAEC, RUPEROX DC, RUPEROX 101, RUPEROX F, RUPEROX DT, RUPEROX 130, RUPEROX 220, RUPEROX 230, RUPEROX 233 and RUPEROX 531.

When the photopolymerizable silicone polymeric radical polymerization initiator is used, the specific silicone polymerization initiator (b) may be used together with a commercially available product of an intermolecular cleavable or hydrogen withdrawing photopolymerization initiator, as described below.

Examples of the commercially available product of the intermolecular cleavable polymerization initiator include benzylketal, alkylphenone, aminoalkylphenone, phosphine oxide, titanocene, and oxime compounds. More specifically, examples of the benzylketal compounds include 2,2-dimethoxy-1,2-diphenylethane-1-one. Examples of the alkylphenone compounds include 1-hydroxy-cyclohexyl-phenylketone, and 2-hydroxy-2-methyl-1-phenyl-propane-1-one, 1-[4-(2-hydroxyethoxy)-phenyl]-2-hydroxy-2-methyl-1-propane-1-one, 2-hydroxy-1-{4-[4-(2-hydroxy-2-methylpropionyl)-benzyl]phenyl}-2-methyl-propane-1-one, acetophenone, and 2-phenyl-2-(p-toluenesulfonyloxy)acetophenone. Examples of the aminoalkylphenone compounds include p-dimethylaminoacetophenone, p-dimethylaminopropiophenone, 2-methyl-1-(4-methylthiophenyl)-2-morpholinopropane-1-one, and 2-benzyl-2-dimethylamino-1-(4-morpholinophenyl)-butanone-1,2-(dimethyl)amino-2-[(4-methylphenyl)methyl]-1-[4-(4-morpholinyl)phenyl]-1-butanone. Examples of the phosphine oxide (or phosphinoxide) compounds include 2,4,6-trimethylbenzoyl-diphenyl-phosphine oxide, and bis(2,4,6-trimethylbenzoyl)-phenylphosphine oxide. Examples of the titanocene compounds include bis(η5-2,4-cyclopentadienyl-1-yl)-bis(2,6-difluoro-3-(1H-pyrrole-1-yl)-phenyl)titanium. Examples of the oxime compounds include 1,2-octanedione, 1-[4-(phenylthio)-,2-(o-benzoyloxime)], ethanone, 1-[9-ethyl-6-(2-methylbenzoyl)-9H-carbazole-3-yl], and 1-(o-acetyloxime).

Examples of the commercially available product of the hydrogen withdrawing polymerization initiator include benzophenone, thioxanthone, benzyl, and Michler's ketone compounds. More specifically, examples of the benzophenone compounds include 2-benzoylbenzoic acid, 2-chlorobenzophenone, 4,4'-dichlorobenzophenone, 4-benzoyl-4'-methyldiphenyl sulfide, and p,p'-bisdiethylaminobenzophenone. Examples of the thioxanthone compounds include 2,4-diethylthioxanthene-9-one, 2-chlorothioxanthone, and 2-isopropylthioxanthone. Examples of the benzyl compounds include benzyl, (±)-camphorquinone, and and p-anisyl.

The composition according to the present exemplary embodiment, which contains the specific charge transporting material (a) and the specific silicone polymerization initiator (b), may contain a reactive compound (c) having no charge transporting property. By use of this specific reactive compound (c), the protective layer (outermost layer) 5 certainly keeps good electric characteristics and mechanical strength sufficiently. Therefore, by using together with the reactive compound (c) having no charge transporting property, the mechanical strength of the protective layer (outermost layer) 5 may be adjusted.

The term "having no charge transporting property" means that carrier-transportation is not observed by the time-of-flight method.

This reactive compound may be a monofunctional or polyfunctional polymerizable monomer, oligomer or polymer. The compound is, for example, an acrylate or methacrylate monomer, oligomer or polymer.

Specifically, examples of the monofunctional monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, and o-phenylphenol glycidyl ether acrylate.

Examples of the bifunctional monomer, oligomer or polymer include diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate.

Examples of the trifunctional monomer, oligomer or polymer include trimethylolpropane tri(meth)acrylate, pentaerythritol tri(meth)acrylate, and aliphatic tri(meth)acrylate.

Examples of the tetrafunctional monomer, oligomer or polymer include pentaerythritol tetra(meth)acrylate, ditrimethylolpropane tetra(meth)acrylate, and aliphatic tetra(meth) acrylate.

Examples of the pentafunctional or more-functional monomer, oligomer or polymer include dipentaerythritol penta (meth)acrylate, dipentaerythritol hexa(meth)acrylate and (meth)acrylates having a polyester skeleton, a urethane skeleton or a phosphazene skeleton.

The above-mentioned monomers, oligomers and polymers may be used alone or in the form of a mixture of two or more thereof.

The content by percentage of the monomer, oligomer and/or polymer is 100% or less by weight of the whole of the compounds having charge transporting property (the specific charge transporting material and other charge transporting materials) in the composition containing the specific charge transporting material, desirably 50% or less by weight thereof, and more desirably 30% or less by weight thereof.

A polymer (d) reactive with the specific charge transporting material (a) or a polymer (e) unreactive therewith may be incorporated into the composition containing the specific charge transporting material (a) and the specific silicone polymerization initiator (b) in order to control the particle dispersibility or the viscosity, or in order to improve the discharge gas resistance, the mechanical strength and the injury resistance of the cured membrane (outermost layer), decrease the torque, control the abrasion amount or prolong the pot life.

The protective layer (outermost layer) 5, which is the cured membrane made of the composition containing the specific charge transporting material (a) and the specific silicone polymerization initiator (b), certainly keeps good electric characteristics and mechanical strength sufficiently; thus, various polymers may be used as a binder resin in the layer 5. When the polymer is used, the viscosity of the composition may be improved so that the protective layer (outermost layer) 5 having a very good surface property is formed. Additionally, the gas barrier property, for preventing gas from being incorporated into the outermost layer, is improved, and further the adhesive property onto the underlying layer is also improved.

The polymer (d) reactive with the specific charge transporting material (a) may be any polymer as far as the polymer is a polymer having a radical-polymerizable unsaturated double bond as a reactive group. Examples thereof include the above-mentioned acrylate or methacrylate polymers, and polymers disclosed in JP-A No. 5-216249, paragraphs [0026] to [0059], JP-A No. 5-323630, paragraphs [0027] to [0029], JP-A No. 11-52603, paragraphs [0089] to [0100], JP-A No. 2000-264961, paragraphs [0107] to [0128].

The polymer (e) unreactive with the specific charge transporting material (a) may be any polymer as far as the polymer is a polymer which does not contain any radical-polymerizable unsaturated double bond. Specifically, the polymer (e) may be a polycarbonate resin, polyester resin, polyarylate resin, methacrylic resin, acrylic resin, polyvinyl chloride resin, polyvinylidene chloride resin or polystyrene resin, or some other known resin.

The polymer(s) is/are used in an amount of 10% or less by weight of the whole of the compounds having charge transporting property (the specific charge transporting material (a) and other charge transporting materials) in the composition containing the specific charge transporting material (a), desirably 50% or less by weight thereof, and more desirably 30% or less by weight thereof.

It is allowable to add a coupling agent, a hard coating agent and/or a fluorine-containing compound to the composition containing the specific charge transporting material (a) and the specific silicone polymerization initiator (b) in order to adjust the film-formability, the flexibility, the lubricating property and the adhesive property, or attain some other purpose. As the additive(s), a silane coupling agent and a commercially available silicone hard coating agent that may each be of various types may be used.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane.

Examples of the commercially available hard coating agent include agents KP-85, X-40-9740, and X-8239 (each manufactured by Shin-Etsu Chemical Co., Ltd.), and agents AY42-440, AY42-441, and AY49-208 (each manufactured by Dow Corning Toray Co., Ltd.).

In order to give water repellency and others thereto, a fluorine-containing compound may be added thereto, examples of the compound including (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane. Furthermore, a reactive fluorine-containing compound disclosed in JP-A No. 2001-166510 and others may be mixed therewith.

The silane coupling agent may be used in an arbitrary amount, and the amount of the fluorine-containing compound may be desirably 0.25 times or less the weight of the compounds having no fluorine. If the amount of the compound is more than this amount, a problem may be caused about the formability of the composition into a crosslinked membrane.

A resin which is dissolved in alcohol may be added to the protective layer (outermost layer) 5 in order to improve the discharge gas resistance, the mechanical strength and the injure resistance of the protective layer, decrease the torque, control the abrasion amount, prolong the pot life, and control the particle dispersibility and the viscosity.

In order to prevent a deterioration owing to oxidizing gases, such as ozone, which are generated in a device for electrifying the protective layer (outermost layer) 5, an antioxidant may be desirably added to the protective layer. As the mechanical strength of the surface of any photoreceptor is enhanced and the lifespan of the photoreceptor becomes longer, the photoreceptor contacts oxidizing gases for a longer period. Accordingly, in the exemplary embodiment, a stronger oxidization resistance is required than in the prior art.

The antioxidant is desirably a hindered phenol or hindered amine antioxidant, and may be a known antioxidant such as an organic sulfur antioxidant, a phosphite antioxidant, a dithiocarbamic acid salt antioxidant, a thiourea antioxidant, or a benzimidazole antioxidant. The addition amount of the antioxidant is preferably 20% or less by weight of the whole of solids in the coating solution (composition) for forming the protective layer, and more preferably 10% or less by weight thereof.

Examples of the hindered phenol antioxidant include agents "IRGANOX 1076", "IRGANOX 1010", "IRGANOX 1098", "IRGANOX 245", "IRGANOX 1330", "IRGANOX 3114", and "IRGANOX 1076", and 3,5-di-t-butyl-4-hydroxybiphenyl.

Examples of the hindered amine antioxidant include agents "SANOL LS2626", "SANOL LS765", "SANOL LS770", "SANOL LS744", "TINUVINE 144", "TINUVINE 622LD", "MARK LA57", "MARK LA67", "MARK LA62", "MARK LA68", and "MARK LA63". Examples of the thioether antioxidant include agents "SUMIRIZER TPS", and "SUMIRIZER TP-D". Examples of the phosphite antioxidant include agents "MARK 2112", "MARK PEP-8", "MARK PEP-24G", "MARK PEP-36", "MARK 329K", and "MARK HP-10".

Various particles may be added to the protective layer (outermost layer) 5 to lower the residual potential of the protective layer or improve the strength.

The particles are, for example, silicon-containing particles. The silicon-containing particles contain silicon as a constituent element thereof. Specific examples thereof include colloidal silica particles, and silicone particles. The colloidal silica used as the silicon-containing particles are generally selected from particle species wherein silica having an average particle diameter of 1 to 100 nm, and preferably 10 to 30 nm, is dispersed in an acidic or alkaline aqueous liquid, or an organic solvent such as alcohol, ketone or ester. Generally and commercially available silicon-containing particles may be used.

The content by percentage of solids in the colloidal silica in the protective layer 5 is not particularly limited. However, the content is generally from 0.1 to 50% by weight of the whole of solids in the protective layer 5, and preferably from 0.1 to 30% by weight thereof from the viewpoint of film-formability, electric characteristics and strength.

The silicone particles used in the silicon-containing particles are selected from silicone resin particles, silicone rubbery particles, and silicone surface-treated silica particles. Generally and commercially available silicon-containing particles may be used. The silicone particles are in a spherical form, and the average particle diameter thereof is desirably from 1 to 500 nm, and more preferably from 10 to 100 nm. The silicone particles are chemically inactive small-diameter particles having excellent resin-dispersion property. Furthermore, the content by percentage thereof necessary for obtaining a satisfactory property is low. For these reasons, the surface property of the electrophotographic photoreceptor is improved without hindering the crosslinking reaction. In other words, by the particles cause, the lubricating property and the water repellency of the electrophotographic photoreceptor surface is improved in the state that the particles are uniformly taken in the strong crosslinked structure. Thus, good abrasion resistance and contamination adhesion resistance of the electrophotographic photoreceptor are kept over a long term.

The content by percentage of the silicone particles in the protective layer 5 is preferably from 0.1 to 30% by weight of the whole of solids in the protective layer 5, and more preferably from 0.5 to 10% by weight thereof.

Other examples of the particles include particles of fluorine-containing compounds such as ethylene tetrafluoride, ethylene trifluoride, propylene hexafluoride, vinyl fluoride, or vinylidene fluoride; particles made of a resin obtained by copolymerizing a fluorine resin and a monomer having a hydroxyl group, as described in "8$^{th}$ Polymeric Material Forum Lecture, Proceedings, p. 89"; and particles made of a semiconductive metal oxide such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, or MgO.

For a similar purpose, an oil such as silicone oil may be added to the protective layer (outermost layer) 5. Examples of the silicone oil include ordinary silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbitol-modified polysiloxane, methacrylic modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl-group-containing cyclosiloxanes such as a methylhydrosiloxane mixture, pentamethylcyclopentasiloxane, and phenylhydrocyclosiloxane; and vinyl-group-containing cyclosiloxanes such as pentavinylpentamethylcyclopentasiloxane.

A metal, a metal oxide, carbon black and/or some other material may be added to the protective layer (outermost layer) 5. Examples of the metal include aluminum, zinc, copper, chromium, nickel, silver, and stainless steel. A product wherein such a metal is evaporated onto the surfaces of plastic particles may be added to the layer 5. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used alone or in combination of two or more kinds. When two or more of the oxides are used in combination, they may be simply mixed with each other, or may be made into the form of a solid solution or a melted body. The average particle diameter of the conductive particles is desirably 0.3 μm or less, and more desirably 0.1 μm or less from the viewpoint of the transparency of the protective layer.

The composition containing the specific charge transporting material (a), which is used to form the protective layer 5, may be desirably prepared as a protective film forming coating solution.

This protective layer forming coating solution may contain no solvent. If necessary, the coating solution is prepared, using a single solvent or a mixed solvent, which is made of one or more selected from aromatic solvents such as toluene and xylene; ketone solvents such as methyl ethyl ketone, methyl isobutyl ketone, and cyclohexanone; ester solvents such as ethyl acetate, and butyl acetate; ether solvents such as tetrahydrofuran, and dioxane; cellosolve solvents such as ethylene glycol monomethyl ether; and alcohol solvents such as isopropyl alcohol, and butanol.

When the above-mentioned components are caused to react with each other to obtain the coating solution, the individual components may be merely mixed with each other, so as to dissolve the solid components. The individual components may be heated under the conditions of temperature ranging desirably from room temperature to 100° C., and more preferably from 30 to 80° C. and heating period ranging preferably from 10 minutes to 100 hours, and more preferably from 1 to 50 hours. In this time, ultrasonic waves may be applied to the individual components.

In this way, a partial reaction probably advances in the coating solution, so that the uniformity of the coating solution is enhanced. Thus, a uniform membrane having no coat defects is easily obtained.

The protective film forming coating solution, which is made of the composition containing the specific charge transporting material (a), is applied onto the charge transporting layer 3, the surface of which constitutes a surface to which the coating solution is to be applied, by an ordinary coating method such as blade coating, wire bar coating, spray coating, dip coating, bead coating, air knife coating, or curtain coating.

Thereafter, heat or light is supplied to the resultant coat to cause radical polymerization. In this way, the polymerizable component(s) in the coat is/are polymerized so as to cure the coat.

When the coat is cured by heat, the temperature for the heating may be preferably 50° C. or more. If the heating temperature is less than 50° C., the lifespan of the cured membrane unfavorably becomes short. The heating temperature is in particular preferably from 100 to 170° C. from the viewpoint of the strength, electric characteristics and the surface evenness of the photoreceptor.

When the coat is cured by light, light is irradiated from a known light irradiating device such as a mercury lamp or a metal halide lamp.

The polymerization and curing reaction are conducted in a vacuum, an inert gas atmosphere, or an low-oxygen-concentration environment in order not to inactivate radicals generated by the heat or light. The concentration of oxygen is preferably 10% or less, more preferably 5% or less, even more preferably 2% or less, and most preferably 500 ppm or less.

With reference to the electrophotographic photoreceptor 7A illustrated FIG. 1, a function-separated photosensitive layer has been described above by way of examples thereof. In the case of the monolayered photosensitive layer (charge generating/charge transporting layer) 6 in the electrophotographic photoreceptor 7C illustrated in FIG. 3, the following exemplary embodiment may be desired:

The content by percentage of a charge generating material in the monolayered photosensitive layer 6 is from about 10 to about 85% by weight, and preferably from 20 to 50% by weight. The content by percentage of a charge transporting material therein may be preferably from 5 to 50% by weight. The method for forming the monolayered photosensitive layer (charge generating/charge transporting layer) 6 is the same as the method for forming the charge generating layer 2 or the charge transporting layer 3. The membrane thickness of the monolayered photosensitive layer (charge generating/charge transporting layer) 6 is preferably from about 5 to about 50 μm, and more preferably from 10 to 40 μm.

In the above-mentioned exemplary embodiment, its outermost layer, which is a cured membrane made of a composition containing a specific charge transporting material (a) and a specific silicone polymerization initiator (b), is the protective layer 5. However, in another case where the exemplary embodiment has a layer structure which does not have the protective layer 5, its outermost layer is the charge transporting layer, which is positioned in the outermost surface in the layer structure.

When the outermost layer is the charge transporting layer, the thickness of this layer is preferably from 7 to 70 μm, and more preferably from 10 to 60 μm.

<Electroconductive Substrate>

The electroconductive substrate 4 may be a metallic plate, metallic drum or metallic belt made of aluminum, copper, zinc, stainless steel, chromium, nickel, molybdenum, vanadium, indium, gold, platinum or some other metal, or an alloy containing such a metal. The electroconductive substrate 4 may be a paper piece, a plastic film or a belt on which the following is painted, evaporated or laminated: an electroconductive polymer, an electroconductive compound such as indium oxide, a metal such as aluminum, palladium, or gold, or an alloy containing such a metal.

The term "electroconductive" herein means that the volume resistivity is less than $10^{13}$ Ω·cm.

When the electrophotographic photoreceptor 7A is used as a laser printer, the surface of the electroconductive substrate 4 may be made rough to have a centerline average roughness Ra of 0.04 to 0.5 μm in order to prevent interference fringes generated when a laser ray is irradiated thereto. If the roughness Ra is less than 0.04 μm, the surface becomes close to a mirror plane so that the interference-preventing effect tends to become insufficient. If the roughness Ra is more than 0.5 μm, an image quality tends to becomes rough even when a coat is formed thereon. When an incoherent light ray is used as a light source, it is not particularly necessary to make the surface rough to prevent interference fringes. In this case, defects are prevented from being generated by irregularities in the electroconductive substrate 4 surface; thus, the case is suitable for making the lifespan of the electrophotographic photoreceptor longer.

Desired examples of the method for roughening the surface include wet honing performed by spraying a suspension wherein an abrasive agent is suspended in water onto the support, centerless grinding, wherein the support is brought into contact with a rotating grinding stone under pressure to attain grinding continuously, and anodic oxidation treatment.

An additional desired example of the surface-roughening method is a method of dispersing electroconductive or semi-electroconductive powder into a resin, and making the powder-dispersed product into a layer on the support surface, thereby making the electroconductive substrate 4 rough through the particles dispersed in the layer without roughening the substrate 4 surface directly.

The surface-roughening treatment based on anodic oxidation is a treatment of using aluminum as an anode to conduct anodic oxidation in an electrolytic solution, thereby forming an oxide film on the aluminum surface. Examples of the electrolytic solution include a sulfuric acid solution, and an oxalic acid solution. However, the porous anodic oxide film, which is formed by the anodic oxidation, is chemically active, is easily contaminated, and the resistance thereof is largely varied in accordance with the environment unless the film is subjected to any treatment. Thus, it is desired to conduct a pore-sealing treatment of sealing the fine pores in the anodic oxide film by volume expansion based on hydration reaction in pressured water vapor or boiling water, to which a salt of a metal such as nickel may be added, thereby changing the oxide to a hydrated oxide, which is more stable.

The film thickness of the anodic oxide film may be from 0.3 to 15 μm. If this film thickness is less than 0.3 μm, the barrier property against the injection is poor so that the above-mentioned advantageous effect tends to become insufficient. On the other hand, if the film thickness is more than 15 μm, the residual potential tends to increase when the electrophotographic photoreceptor is repeatedly used.

The electroconductive substrate 4 may be subjected to a treatment with an aqueous acidic solution or boehmite treatment. A treatment with an acidic treating solution containing phosphoric acid, chromic acid, and hydrofluoric acid is conducted as follows: First, an acidic treatment solution is prepared. With respect to the blend ratio among phosphoric acid, chromic acid, and hydrofluoric acid in the acidic treatment solution, the amount of phosphoric acid, that of chromic acid, and that of hydrofluoric acid may be from 10 to 11% by weight, from 3 to 5% by weight, and form 0.5 to 2% by weight, respectively, and the sum total concentration of these acids may be from 13.5 to 18% by weight. The treatment temperature may be from 42 to 48° C. When the treatment temperature is kept at such a high temperature, a thicker coat is more rapidly formed than when the treatment temperature is lower than this range. The thickness of the coat may be from 0.3 to 15 μm. If the thickness is less than 0.3 μm, the barrier property against the injection is poor so that the above-mentioned advantageous effect tends to become insufficient. On the other hand, if the thickness is more than 15 μm, the residual potential tends to increase when the electrophotographic photoreceptor is repeatedly used.

The boehmite treatment is conducted by immersing the electroconductive substrate 4 into pure water of 90 to 100° C. temperature for 5 to 60 minutes, or by bringing the substrate 4 into contact with heated water vapor of 90 to 120° C. for 5 to 60 minutes. The thickness of the coat may be desirably from 0.1 to 5 μm. The resultant may be further subjected to anodic oxidation treatment with an electrolyte solution containing an adipic acid, boric acid, borate (salt), phosphate (salt), phthalate (salt), maleate (salt), benzoate (salt), tartarate (salt) or citrate (salt) having lower coat-solubility than other species.

<Undercoating Layer>

The undercoating layer 1 is, for example, a layer containing inorganic particles in a binder resin.

The inorganic particles may be preferably particles having a powder resistivity (volume resistivity) of $10^2$ Ω·cm to $10^{11}$ Ω·cm since the undercoating layer 1 is preferable to obtain an appropriate resistance to gain leakage resistance and carrier blocking property. If the resistivity of the inorganic particles is lower than the lower limit of the range, a sufficient leakage resistance may not be obtained. If the resistivity is higher than the upper limit thereof, the residual potential may unfavorably rise.

Among these inorganic particles having a resistivity in the range, inorganic particles of electroconductive metal oxides such as tin oxide, titanium oxide, zinc oxide, or zirconium oxide are desirably used, and in particular zinc oxide particles are desirably used.

The inorganic particles may be subjected to surface treatment. Two or more inorganic particle species different from each other in applied surface treatment or in particle diameter may be used in a mixture form.

The volume-average particle diameter of the inorganic particles is preferably from 50 to 2000 nm, and more preferably from 60 to 1000 nm.

The inorganic particles having a specific surface area of 10 $g/m^2$ or more as determined by the BET method may be preferably used. If the specific surface area is less than 10 $m^2/g$, the electric chargeability is easily declined so that good electrophotographic characteristics tend not to be easily obtained.

Furthermore, by incorporating an acceptor compound together with the inorganic particles into the undercoating layer, very good long-term stability of electric characteristics and very good carrier blocking property are given to the layer.

The acceptor compound may be any acceptor compound as far as the undercoating layer gains a desired characteristic. Desired examples thereof include quinone compounds such as chloranil, and bromoanil; tetracycanoquinodimethane compounds; fluorenone compounds such as 2,4,7-trinitrofluorenone, and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenol)-1,3,4-oxadiazole; xanthone compounds; thiophene compounds; diphenoquinone compounds such as 3,3',5,5'-tetra-t-butyldiphenoquinone; and other electron transporting materials. In particular, compounds having an anthraquinone structure are desired. Additional desired examples thereof include hydroxyanthraquinone compounds, aminoanthraquinone compounds, aminohydroxyanthraquinone compounds, and acceptor compounds having an anthraquinone structure. Specific examples thereof include anthraquinone, alizarin, quinizarin, anthrarufin, and purpurin.

The content by percentage of the acceptor compound may be set at will as far as the undercoating layer gains a desired characteristic. The content may be from 0.01 to 20% by weight of the inorganic particles. In order to prevent electric charges from being accumulated therein and prevent the inorganic particles from being aggregated, the content may be from 0.05 to 10% by weight of the inorganic particles. According to the aggregation of the inorganic particles, electroconductive paths are unevenly formed with ease. Additionally, when the photoreceptor is repeatedly used, the characteristic-maintaining performance is easily deteriorated, so that, for example, the residual potential rises. Besides, image quality defects, such as black spots, are easily generated.

The acceptor compound may be added to an undercoating layer forming coating solution, or may be applied onto the surfaces of the inorganic particles to adhere it beforehand.

The method for applying the acceptor compound onto the inorganic particle surfaces may be a wet method or a dry method.

when this surface treatment is conducted by the dry method, the treatment is attained without dispersing the acceptor compound unevenly by stirring the inorganic particles by means of a mixer or the like that gives a large shearing force while dropping the acceptor compound directly thereon or dropping the acceptor compound dissolved in an organic solvent thereon, or spraying the compound or the compound dissolved in an organic solvent thereon together with dry air or nitrogen gas. The addition or spraying is conducted desirably at a temperature of the boiling point or less of the solvent. If the spraying is conducted at a temperature of the boiling point or more of the solvent, the solvent is evaporated before the stirring is attained without dispersing the acceptor compound unevenly, so that the acceptor compound is locally gathered; thus, there is unfavorably generated a drawback that the surface treatment without dispersing the acceptor compound unevenly is not easily attained. After the addition or spraying, the resultant may be subjected to baking at 100° C. or more. The baking is performed at any temperature in any period as far as a desired electrophotographic characteristic is obtained.

In the wet method, the inorganic particles are stirred in a solvent, and dispersed therein by use of ultrasonic waves, a sand mill, an attriter, a ball mill or the like. The acceptor compound is added thereto, and stirred or dispersed, and then the solvent is removed, thereby conducting the treatment without dispersing the acceptor compound unevenly. The method for removing the solvent is filtration, or separation by distillation. After the removal of the solvent, the resultant may be subjected to baking at 100° C. or more. The baking is performed at any temperature in any period as far as a desired electrophotographic characteristic is obtained. In the wet method, water contained in the inorganic particles may be removed before the addition of a surface treatment agent. The method for the removal is, for example, a method of removing the water while the particles are stirred and heated in the solvent used in surface treatment, or a method of removing the water by boiling the water and the solvent azeotropically.

The inorganic particles may be subjected to surface treatment before the acceptor compound is supplied to the particles. The agent for the surface treatment may be any agent as far as the undercoating layer gains a desired characteristic, and may be selected from known materials. Examples of the agent include a silane coupling agent, a titanate based coupling agent, an aluminum based coupling agent, and a surfactant. In particular, a silane coupling agent is desirably used since the agent gives good electrophotographic characteristics. A silane coupling agent having an amino group is desirably used since the agent gives a good blocking property to the undercoating layer 1.

The silane coupling agent having an amino group may be any agent as far as a desired electrophotographic characteristic is obtained. Specific examples thereof include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-γ-aminopropyltrithoxysilane. However, the agent is not limited to these examples.

About the silane coupling agent, two or more species thereof may be used in a mixture form. Examples of a silane coupling agent which may be used together with the silane coupling agent having an amino group include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the agent is not limited to these examples.

The method for the surface treatment using these surface treatment agents may be any known method. It is advisable to use a dry method or wet method. It is allowable to conduct the supply of the acceptor compound and the surface treatment with the surface treatment agent such as a coupling agent, simultaneously.

The content by percentage of the silane coupling agent to the inorganic particles in the undercoating layer 1 may be set to any value as far as a desired electrophotographic characteristic is obtained. The content may be from 0.5 to 10% by weight of the inorganic particles from the viewpoint of an improvement in the dispersibility thereof.

The undercoating layer 1 may contain a binder resin.

The binder resin contained in the undercoating layer 1 may be any binder resin that may form a good film and give a desired property. Examples thereof include known polymeric compounds such as acetal resins (for example, polyvinyl butyral), polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride/vinyl acetate/maleic anhydride resin, silicone resin, silicone-alkyd resin, phenol resin, phenol-formaldehyde resin, melamine resin, and urethane resin; charge transporting resins having a charge transporting group; and electroconductive resins such as polyaniline. Among these resins, resins insoluble in a solvent in a coating solution for forming a layer on the undercoating layer 1 are desired, and particularly phenol resin, phenol-formaldehyde resin, melamine resin, urethane resin, and epoxy resin are desirably used. When two or more of these resins are used in combination, the blend ratio of these resins may be appropriately set.

In a coating solution for forming the undercoating layer, the ratio of the inorganic particles having their surfaces provided with the acceptor compound (acceptor-property-provided metal oxide) to the binder resin, or the ratio of the inorganic particles to the binder resin may be appropriately set as far as a desired electrophotographic characteristic is obtained.

Various additives may be added to the undercoating layer 1 to improve the electric characteristics, the environmental stability, or the image quality.

As the additives, it is possible to use any known materials such as an electron transporting pigment (for example, a condensed polycyclic pigment or an azo pigment), a zirconium chelate compound, a titanium chelate compound, an aluminum chelate compound, a titanium alkoxide compound, an organic titanium compound, or a silane coupling agent. The silane coupling agent is used for the surface treatment of the inorganic particles as described above; however, the agent may be added, as an additive, into the undercoating-layer-forming coating solution.

Specific examples of the silane coupling agent as the additive include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compound include zirconiumbutoxide, zirconiumethyl acetoacetate, zirconiumtriethanolamine, acetylacetonate zirconiumbutoxide, ethyl acetoacetate zirconiumbutoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconiumbutoxide, stearate zirconiumbutoxide, and isostearate zirconiumbutoxide.

Examples of the titanium chelate compound include tetraisoprpyl titanate, tetra-n-butyl titanate, butyl titanate dimer, tetra(2-ethylhexyl)titanate, titanium acetylacetonate, polytitanium acetylacetonate, titaniumoctylene glycolate, an ammonium salt of titanium lactate, titanium lactate, an ethyl ester of titanium lactate, titaniumtriethanol aminate, and polyhydroxytitanium stearate.

Examples of the aluminum chelate compound include aluminum isopropionate, monobutoxyaluminum diisopropionate, aluminum butyrate, ethylacetoacetate aluminum diisopropionate, and aluminum tris(ethylacetoacetate).

These compounds may be used alone, or in the form of a mixture of two or more thereof or in the form of a polycondensate from two or more thereof.

The solvent for forming the undercoating layer-forming coating solution may be selected arbitrarily from known solvents such as alcoholic solvents, aromatic solvents, halogenated hydrocarbon solvents, ketone solvents, ketone alcohol solvents, ether solvents, and ester solvents.

The solvent may be an ordinary organic solvent, specific examples thereof including methanol, ethanol, n-propanol, iso-propanol, n-butanol, benzyl alcohol, methylcellosolve, ethylcellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents may be used alone or in the form of a mixture of two or more thereof. Any solvents may be used as a mixed solvent as far as the mixed solvent is able to dissolve a binder resin.

As the method for dispersing the inorganic particles when the undercoating layer-forming coating solution is prepared, it is possible to use any known methods such as a roll mill, a ball mill, a vibrating ball mill, an attriter, a sand mill, a colloid mill, or a paint shaker.

The coating method used to form the undercoating layer 1 may be an ordinary coating method such as blade coating, wire bar coating, spray coating, dip coating, bead coating, air knife coating or curtain coating.

The undercoating layer-forming coating solution obtained as described above is used to form the undercoating layer 1 on the electroconductive substrate.

The Vickers hardness of the undercoating layer 1 may be 35 or more.

The thickness of the undercoating layer 1 may be set into any value as far as a desired property is obtained. Specifically, the thickness is preferably 15 μm or more, and more preferably from 15 to 50 μm.

If the thickness of the undercoating layer 1 is less than 15 μm, a sufficient leakage property may not be obtained. If the thickness is more than 50 μm, residual potential remains easily when the photoreceptor is used for a long period. As a result, an image density abnormality easily occurs.

In order to prevent occurrence of a moire fringe, the surface roughness (ten-point average roughness) of the undercoating layer 1 is adjusted in the range from ¼n of the wavelength of a radiating laser to be used, wherein n represents the refractive index of the overlaying layer to ½λ.

In order to adjust the surface roughness, particles made of a resin or the like may be added to the undercoating layer. The resin particles may be silicone resin particles, crosslinkable polymethyl methacrylate resin particles, or the like.

The surface of the undercoating layer may be polished to adjust the surface roughness.

The method for the polishing may be buff polishing, sandblast treatment, wet honing, grinding treatment or the like.

The undercoating layer 1 is obtained by drying the undercoating layer-forming coating solution applied onto the electroconductive substrate 4. Usually, the drying is conducted at a temperature permitting the solvent to be evaporated so as to attain film-formation.

<Charge Generating Layer>

The charge generating layer 2 is a layer containing a charge generating material and a binder resin.

Examples of the charge generating material include azo pigments such as bisazo and trisazo pigments, condensed aromatic pigments such as dibromoanthanthrone, perylene pigments, pyrrolopyrrole pigments, phthalocyanine pigments, zinc oxide, and trigonal selenium. Among these materials, metal phthalocyanine pigments and metal-free phthalocyanine pigments are desirably used as the charge generating material so that the photoreceptor can be used for the radiation of a laser ray having a near infrared wavelength. Particularly, gallium hydroxyphthalocyanine disclosed in JP-A Nos. 5-263007 and 5-279591, and others, gallium chlorophthalocyanine disclosed in JP-A No. 5-98181 and others, tin dichlorophthalocyanine disclosed in JP-A Nos. 5-140472 and 5-140473, and others, and titanylphthalocyanine disclosed in JP-A Nos. 4-189873 and 543823 and others are desirably used. In order to cause the photoreceptor to cope with the radiation of a laser ray having a near ultraviolet wavelengths, it is more desired to use, as the charge generating material, a condensed aromatic pigment such as dibromoanthanthrone; a thioindigo pigment, a porphyrazine compound, zinc oxide, trigonal selenium; bisazo pigments disclosed in JP-A Nos. 2004-78147 and 2005-181992; or the like.

The binder resin used in the charge generating layer 2 is selected from a wide range of insulating resins, or may be selected from organic photoconductive polymers such as poly-N-vinylcarbazole, polyvinylanthracene, polyvinylpyrene, and polysilane. Desired examples of the binder resin include polyvinyl butyral resin, polyarylate resin (such as a polycondensate made from a bisphenol and an aromatic bivalent carboxylic acid), polycarbonate resin, polyester resin, phenoxy resin, vinyl chloride/vinyl acetate copolymer, polyamide resin, acrylic resin, polyacrylamide resin, polyvinyl pyridine resin, cellulose resin, urethane resin, epoxy resin, casein, polyvinyl alcohol resin, and polyvinyl pyrrolidone resin. These binder resins may be used alone or in the form of a mixture of two or more thereof. The blend ratio by weight of the charge generating material to the binder resin may be from 10/1 to 1/10. The word "insulating" herein means $10^{13}$ Ω·cm or more in terms of volume resistivity.

The charge generating layer 2 is formed using a charge generating layer-forming coating solution wherein the above-mentioned charge generating material and binder resin are dispersed in a predetermined solvent.

Examples of the solvent used for dispersion include methanol, ethanol, n-propanol, n-butanol, benzyl alcohol, methyl cellosolve, ethylcellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in the form of a mixture of two or more thereof.

The method for dispersing the charge generating material and the binder resin into the solvent may be an ordinary method, such as a ball mill dispersing method, an attriter dispersing method, or a sand mill dispersing method. According to such a method, the crystal form of the charge generating material is prevented from being changed by dispersion.

At the time of the dispersion, it is effective to adjust the average particle diameter of the charge generating material to be 0.5 μm or less, preferably 0.3 μm or less, and more preferably 0.15 μm or less.

When the charge generating layer 2 is formed, an ordinary coating method is used, examples thereof including blade coating, Meyer bar coating, spray coating, dip coating, bead coating, air knife coating and curtain coating.

The film thickness of the thus-obtained charge generating layer 2 is preferably from 0.1 to 5.0 μm, and more preferably from 0.2 to 2.0 μm.

<Charge Transporting Layer>

The charge transporting layer 3 is formed so as to contain a charge transporting material and a binder resin, or a polymeric charge transporting material.

Examples of the charge transporting material include quinone compounds (for example, p-benzoquinone, chloranil, bromanil and anthraquinone), tetracyanoquinodimethane compounds, fluorenone compounds (for example, 2,4,7-trinitrofluorenone), xanthone compounds, benzophenone compounds, cyanovinyl compounds, ethylene compounds, and other electron transporting compounds; and triarylamine compounds, benzidine compounds, arylalkane compounds, aryl-substituted ethylene compounds, stylbene compounds, anthracene compounds, hydrazone compounds, and other hole transporting compounds; however, the charge transporting material is not limited thereto. These charge transporting materials may be used alone or in the form of a mixture of two or more thereof.

From the viewpoint of charge mobility, the charge transporting material is preferably a triarylamine derivative represented by a structural formula (a-1) illustrated below or a benzidine derivative represented by a structural formula (a-2) illustrated below.

(a-1)

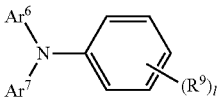

In the structural formula (a-1), $R^9$(s) (each) represent a hydrogen atom or methyl group; 1 represents 1 or 2; $Ar^6$ and $Ar^7$ each independently represent a substituted or unsubstituted aryl group, $—C_6H_4—C(R^{10})=C(R^{11})(R^{12})$, or $—C_6H_4—CH=CH—CH=C(R^{13})R^{14}$ wherein $R^{10}$ to $R^{14}$ each independently represent a hydrogen atom, a substituted or unsubstituted alkyl group, or a substituted or unsubstituted aryl group.

Examples of the substituent of each of the groups include halogen atoms, alkyl groups having 1 to 5 carbon atoms, alkoxy groups having 1 to 5 carbon atoms, and substituted amino groups each substituted with an alkyl group having 1 to 3 carbon atoms.

(a-2)

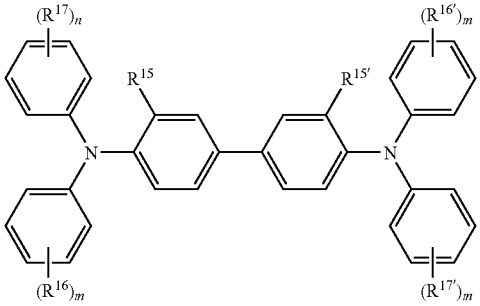

In the structural silicon (a-2), $R^{15}$ and $R^{15'}$ each independently represent a hydrogen atom, a halogen atom, an alkyl group having 1 to 5 carbon atoms, or an alkoxy group having 1 to 5 carbon atoms; $R^{16}$(s), $R^{16'}$(s), $R^{17}$(s) and $R^{17'}$(s) each independently represent a hydrogen atom, a halogen atom, an alkyl group having 1 to 5 carbon atoms, an alkoxy group having 1 to 5 carbon atoms, an amino group substituted with an alkyl group having one or two carbon atoms, a substituted or unsubstituted aryl group, $—C(R^{18})=C(R^{19})(R^{20})$, or $—CH=CH—CH=C(R^{21})(R^{22})$ wherein $R^{18}$ to $R^{22}$ each independently represent a hydrogen atom, a substituted or unsubstituted alkyl group, or a substituted or unsubstituted aryl group; and m and n each independently represent an integer of 0 to 2.

Among triarylamine derivatives each represented by the structural formula (a-1) and benzidine derivatives each represented by the structural formula (a-2), triarylamine derivatives each having "$—C_6H_4—CH=CH—CH=C(R^{13})(R^{14})$", and benzidine derivatives each having $—CH=CH—CH=C(R^{21})(R^{22})$ are particularly preferred from the viewpoints that they are excellent in charge mobility, adhesive property to the protective layer, resistance to the residual image that occurs owing to the remaining hysteresis of a previous images (hereinafter also referred to as a ghost), and others.

Examples of the binder resin used in the charge transporting layer 3 include polycarbonate resin, polyester resin, polyarylate resin, methacrylic resin, acrylic resin, polyvinyl chloride resin, polyvinylidene chloride, polystyrene resin, polyvinyl acetate resin, styrene/butadiene copolymer, vinylidene chloride/acrylonitrile copolymer, vinyl chloride/vinyl acetate copolymer, vinyl chloride/vinyl acetate/maleic anhydride copolymer, silicone resin, silicone alkyd resin, phenol-formaldehyde resin, styrene-alkyd resin, poly-N-vinylcarbazole, and polysilane. Among these resins, polycarbonate resin and polyarylate resin are desired since the resins are excellent in charge transporting property and compatibility with the charge transporting material.

These binder resins may be used alone or in the form of a mixture of two or more thereof. The blend ratio by weight of the charge transporting material to the binder resin may be from 10/1 to 1/5.

The viscosity-average molecular weight of the binder resin used in the charge transporting layer 3 is preferably 50000 or more, and more preferably 55000 or more since the photoreceptor has, on the charge transporting layer 3, the protective layer (outermost layer), which is a cured membrane made of a composition containing a specific charge transporting material (a) and a specific silicone polymerization initiator (b). The binder resin having such a molecular weight is desirably used since the binder resin gives the layer 3 excellent adhesive property and crack resistance when the protective layer (outermost layer) is formed thereon, and others.

The upper limit of the viscosity-average molecular weight of the binder resin used in the charge transporting layer 3 may be 100000 from the viewpoint of the evenness of the coat (the dripping property of the coating solution).

The viscosity-average molecular weight of the binder resins in this exemplary embodiment is a value obtained by measurement using a capillary viscometer.

When the outermost layer is a charge transporting layer, the viscosity-average molecular weight of a binder resin contained in the layer disposed under the layer 3 is desirably in the same range as the range described above for the same reason.

As the charge transporting material, a polymeric charge transporting material may be used. The polymeric charge transporting material may be a known polymeric material which has charge transporting property, such as poly-N-vinylcarbazole or polysilane. Among these materials, polyester polymeric charge transporting materials disclosed in JP-A Nos. 8-176293 and 8-208820, and others are particularly desired since the material has a higher charge transporting property than others. The polymeric charge transporting material may be formed into a film by itself, or may be mixed with the binder resin to form a film.

The charge transporting layer 3 is formed using a charge transporting layer-forming coating solution containing the above-mentioned constituting materials.

As the solvent used for the charge transporting layer-forming coating solution, ordinary organic solvents may be used alone or in the form of mixture of two or more thereof, examples of the solvents including aromatic hydrocarbons such as benzene, toluene, xylene and chlorobenzene, ketones such as acetone and 2-butanone, halogenated aliphatic hydrocarbons such as methylene chloride, chloroform, and ethylene chloride, and cyclic or linear ethers such as tetrahydrofuran and ethyl ether. As the method for dispersing the constituting materials, a known method may be used.

As the method for applying the charge transporting layer-forming coating solution onto the charge generating layer 2, it is possible to use an ordinary coating method such as blade coating, Meyer bar coating, spray coating, dip coating, bead coating, air knife coating, or curtain coating.

The film thickness of the charge transporting layer 3 is preferably from 5 to 50 μm, and more preferably from 10 to 30 μm.

[Image Forming Apparatus/Process Cartridge]

FIG. 4 is a schematic structural view illustrating an image forming apparatus 100 according to an exemplary embodiment of the invention.

The image forming apparatus 100 is provided with a process cartridge 300 having an electrophotographic photoreceptor 7, an exposure device (electrostatic latent image forming unit) 9, a transfer device (transferring unit) 40, and an intermediate transferring medium 50. In the image forming apparatus 100, the unit 9 is arranged at a position where the unit 9 may radiate light onto the electrophotographic photoreceptor 7 through an opening in the process cartridge 300, and the transferring unit 40 is arranged at a position opposite to the photoreceptor 7 by the intermediary of the intermediate transferring medium 50 between the transferring unit 40 and the photoreceptor 7. The intermediate transferring medium 50 is arranged to contact partially the photoreceptor 7.

The process cartridge 300 in FIG. 4 installs, in house, the electrophotographic photoreceptor 7, an electrifier (electrifying unit) 8, a developing device (developing unit) 11, and a cleaner 13 as a unit. The cleaner 13 has a cleaning blade (cleaning member) 131, and the cleaning blade 131 is arranged so as to contact the surface of the photoreceptor 7. The cleaning member may not be the cleaning blade 131, and may be an electroconductive or insulating fibrous member. This may be used alone, or may be used together with a blade.

In FIG. 4, the cleaner 13 has a fibrous member 132 (in a roll form) for supplying a lubricant material 14 onto the surface of the photoreceptor 7, and a fibrous member 133 (in a flat brush form) for assisting cleaning is used; however these members are used as the need arises.

The electrifier 8 is, for example, a contact type electrifier using a conductive or semiconductive electrifying roll, electrifying brush, electrifying film, electrifying rubber blade or electrifying tube, or the like. The electrifier 8 may be a non-contact type roller electrifier, a scorotron or corotron electrifier using corona discharge, or any other known electrifier.

In order to improve the stability of images, a photoreceptor-heating member, which is not illustrated, may be arranged around the electrophotographic photoreceptor 7 to raise the temperature of the photoreceptor 7 to decrease the relative temperature difference.

The exposure device 9 may be an optical instrument for radiating a light ray into a desired image form onto the surface of the photoreceptor 7. The light ray may be a semiconductor laser ray, an LED ray, a liquid crystal shutter ray, or the like. The wavelength(s) of the light source may be a wavelength or wavelengths in the range of the spectral sensitivity wavelengths of the photoreceptor 7. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength near 600 nm, or a blue laser having any emission wavelength in the range of 400 nm to 450 nm may be used. In order to form a color image, it is effective to use a plane-emissive type laser light source capable of attaining a multi-beam output.

The developing device 11 may be an ordinary developing device, which has a function of developing a latent image with a one-component developing agent or two-component developing agent by bringing the developing agent in contact or non-contact with the image. The developing device is not particularly limited as far as the developing device has the function, and is appropriately selected from various developing devices in accordance with the intended use of the developing device. As the developing device, it is possible to use, for example, a known developing device having a function of making one-component developing unit or two-component developing agent adhere onto the photoreceptor 7 using a brush, a roll or the like. Among these developing devices, a developing device provided with a developing roll having a surface on which a developing agent is held is desirable.

A toner used in the developing device 11 will be described hereinafter.

About the toner, the average shape coefficient ($=ML^2/A\times\pi/4\times100$ wherein ML represents the largest length of the toner particles and A represents the projected area of the toner particles) is preferably from 100 to 150, more preferably from 100 to 140. Furthermore, the volume-average particle diameter of the toner is preferably from 2 to 12 μm, more preferably from 3 to 12 μm, and even more preferably from 3 to 9 μm. According to the use of the toner satisfying the average shape coefficient and volume-average particle diameter requirements, a higher developing property, a higher transferring property and a higher-quality image are obtained than the use of other toners.

The toner may be a toner produced by any method as far as the toner satisfies the average shape coefficient and volume-average particle diameter requirements. The toner may be, for example, a toner produced by the following method: a kneading pulverizing method of kneading a binder resin, a colorant, a releasing agent, and optional components such as a charge control agent, and pulverizing these components, and classifying the resultant particles; a method of changing the shape of the particles obtained by the kneading pulverizing method by mechanical impact force or thermal energy; an emulsion polymerization aggregation method of emulsion-polymerizing a polymerizable monomer for obtaining a binder resin, mixing the produced liquid dispersion and a liquid dispersion containing a colorant, a releasing agent, and optionally a charge control agent and others with each other, aggregating the mixture, and heating/melt-bonding the aggregated particles to obtain toner particles; a suspension polymerization method of suspending a polymerizable monomer for obtaining a binder resin, a colorant, a releasing agent, and optionally a solution of a charge control agent and others into an aqueous solvent and polymerizing the monomer; or a dissolution suspension method of suspending a solution of a binder resin, a colorant, a releasing agent, and an optionally a charge control agent and others into an aqueous solution to produce particles.

It is allowable to use some other known method, such as a production method of using the toner obtained by a method as described above as a core, causing aggregated particles to adhere onto (the particles of) the core, and then heating/melt-bonding the core particles and the shell particles whereby a core-shell structure is formed. Among these methods for producing the toner the suspension polymerization method, or the emulsion polymerization aggregation method or the dissolution suspension method, wherein the toner is produced in an aqueous solvent is particularly preferable from the viewpoints of controlling a shape or a particle diameter distribution.

Mother particles of the toner are composed of a binder resin, a colorant, a releasing agent, and optional components such as silica, a charge control agent.

The binder resin used in the mother particles of the toner may be a homopolymer or a copolymer made from a styrene compound such as styrene or chlorostyrene; a monoolefin such as ethylene, propylene, butylene or isoprene; a vinyl ester such as vinyl acetate, vinyl propionate, vinyl benzoate or vinyl butyrate; an α-methylene aliphatic monocarboxylic acid ester such as methyl acrylate, ethyl acrylate, butyl acrylate, dodecyl acrylate, octyl acrylate, phenyl acrylate, methyl methacrylate, ethyl methacrylate, butyl methacrylate or dodecyl methacrylate; a vinyl ether such as vinyl methyl ether, vinyl ethyl ether or vinyl butyl ether; a vinyl ketone such as vinyl methyl ketone, vinyl hexyl ketone, vinyl isopropenyl ketone; and/or the like. The binder resin may be a polyester resin obtained by copolymerizing a dicarboxylic acid and a diol.

Particularly typical examples of the binder resin include polystyrene, styrene/alkyl acrylate copolymer, styrene/alkyl methacrylate copolymer, styrene/acrylonitrile copolymer, styrene/butadiene copolymer, styrene/maleic anhydride copolymer, polyethylene, polypropylene, polyester, polyurethane, epoxy resin, silicone resin, polyamide, modified rosin, and paraffin wax.

Typical examples of the colorant include magnetic powder of magnetite or ferrite, carbon black, aniline blue, chalcoil blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Typical examples of the releasing agent include low molecular weight polyethylene, low molecular weight polypropylene, Fischer Tropsch wax, montanoic wax, carnauba wax, rice wax, and candelilla wax.

The charge control agent may be a known charge control agent, such as an azo metal complex compound, a metal complex compound of salicylic acid, or a resin type charge control agent having a polar group. When the toner is produced by a wet process, materials slightly soluble in water may be used in order to control the ion strength and decrease contaminations in waste water. The toner may be a magnetic toner in which a magnetic material is contained, or a nonmagnetic toner in which no magnetic material is contained.

The toner used in the developing device 11 is produced by mixing mother particles of the toner and the external additives with a Henschel mixer, a V blender or the like. When the mother particles of the toner are produced by a wet process, the external additives may be externally added in a wet manner.

Slipping particles may be added to the toner used in the developing device 11. Examples of the material of the slipping particles include solid lubricants such as graphite, molybdenum disulfide, talc, aliphatic acids, and aliphatic acid metal salts; low molecular weight polyolefins such as polypropylene, polyethylene, and polybutene; silicones having a softening point when heated; aliphatic amides such as oleic amide, erucic amide, ricinoleic amide, and stearic amide; plant waxes such as carnauba wax, rice wax, candelilla wax, Japan wax (Japan tallow), and jojoba oil; animal waxes such as beeswax; mineral or petroleum waxes such as montanoic wax, ozocerite, cerasin, paraffin wax, microcrystalline wax, and Fischer-Tropsch wax; and modified products of these materials. These may be used alone or in combination of two or more thereof. A volume-average particle diameter thereof may be from 0.1 to 10 μm. The particles having any one of the above-mentioned chemical structures may be pulverized into uniform particle diameters. The addition amount thereof to the toner is preferably from 0.05 to 2.0% by weight, and more preferably from 0.1 to 1.5% by weight.

Inorganic particles, organic particles or hybrid particles composed of inorganic particles adhered onto organic particles may be added to the toner used in the developing device 11 in order to remove adhering substances or deteriorated substances on the surface of the electrophotographic photoreceptor, or to attain some other purpose.

Proper examples of the material of the inorganic particles include various inorganic oxides, nitrides and carbides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The inorganic particles may be treated with a titanium coupling agent such as tetrabutyl titanate, tetraoctyl titanate, isopropyltriisostearoyl titanate, isopropyltridecylbenzenesulfonyl titanate, or bis(dioctylpyrophosphate)oxyacetate titanate; or a silane coupling agent such as γ-(2-aminoethyl)aminopropyltrimethoxysilane, γ-(2-aminoethyl)aminopropylmethyldimethoxysilane, γ-methacryloxypropyltrimethoxysilane, a hydrochloride of N-β-(N-vinylbenzylaminoethyl)-γ-aminopropyltrimethoxysilane, hexamethyldisilazane, methyltrimethoxysilane, butyltrimethoxysilane, isobuytltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane. The inorganic particles may be subjected to hydrophobicity-imparting treatment with silicone oil, or a higher aliphatic acid metal salt such as aluminum stearate, zinc stearate or calcium stearate.

Examples of the material of the organic particles include fluoride carbon wherein fluorine is bonded to graphite, polytetrafluoroethylene resin (PTFE), perfluoroalkoxy/fluorine resin (PFA), tetrafluoroethylene/hexafluoropropylene copolymer (FEP), ethylene/tetrafluoroethylene copolymer (ETFE), polychlorotrifluoroethylene (PCTFE), polyvinylidene fluoride (PVDF), and polyvinyl fluoride (PVF).

The volume-average particle diameter of the particles is preferably from 5 to 1000 nm, more preferably from 5 to 800 nm, and even more preferably from 5 to 700 nm. If the volume-average particle diameter is less than the lower limit, the particles tend to have a poor polishing capability. On the other hand, if the particle diameter is more than the upper limit, the particles tend to injure the electrophotographic photoreceptor surface easily. The total addition amount of the organic or inorganic particles and the slipping particles may be 0.6% or more by weight.

It is possible to use, as other inorganic oxides added to the toner, a small-size inorganic oxide having a particle diameter of 40 nm or less for controlling the powder fluidity, the charging characteristic, and the like, and further a larger-size inorganic oxide for decreasing the adhesive force and controlling the charging characteristic. Particles of these inorganic oxides may be known particles. In order to control the charging characteristic precisely, silica and titanium oxide may be used together. When the small-size inorganic particles are surface-treated, the dispersibility is enhanced so that an effect of raising the powder fluidity is improved. In order to remove electric discharge products, a carbonate such as calcium carbonate or magnesium carbonate, or an inorganic mineral such as hydrotalcite may be added.

When the toner is a color toner for electrophotography, the toner is used in the form of a mixture with a carrier. Examples of the carrier include iron powder, glass beads, ferrite powder, nickel powder, and a product wherein the surface of such a carrier is coated with a resin. The blend ratio of the toner to the carrier may be set appropriately.

The transfer unit 40 may be a known transferring electrifier, for example, a contact type transferring electrifier using a belt, a roll, a film, a rubber blade or the like, or a scorotron transferring electrifier or corotron transferring electrifier using corona discharge.

The intermediate transferring medium 50 may be a belt (intermediate transferring belt) made of polyimide, polyamideimide, polycarbonate, polyarylate, polyester or a rubber, to each of which semi-conductivity is given. The form of the intermediate transferring medium 50 may be a drum form as well as the belt form.

The image forming apparatus 100 may have, for example, an optical charge eraser for optically erasing a charge on the photoreceptor 7 besides the above-mentioned individual units.

Figure 5:
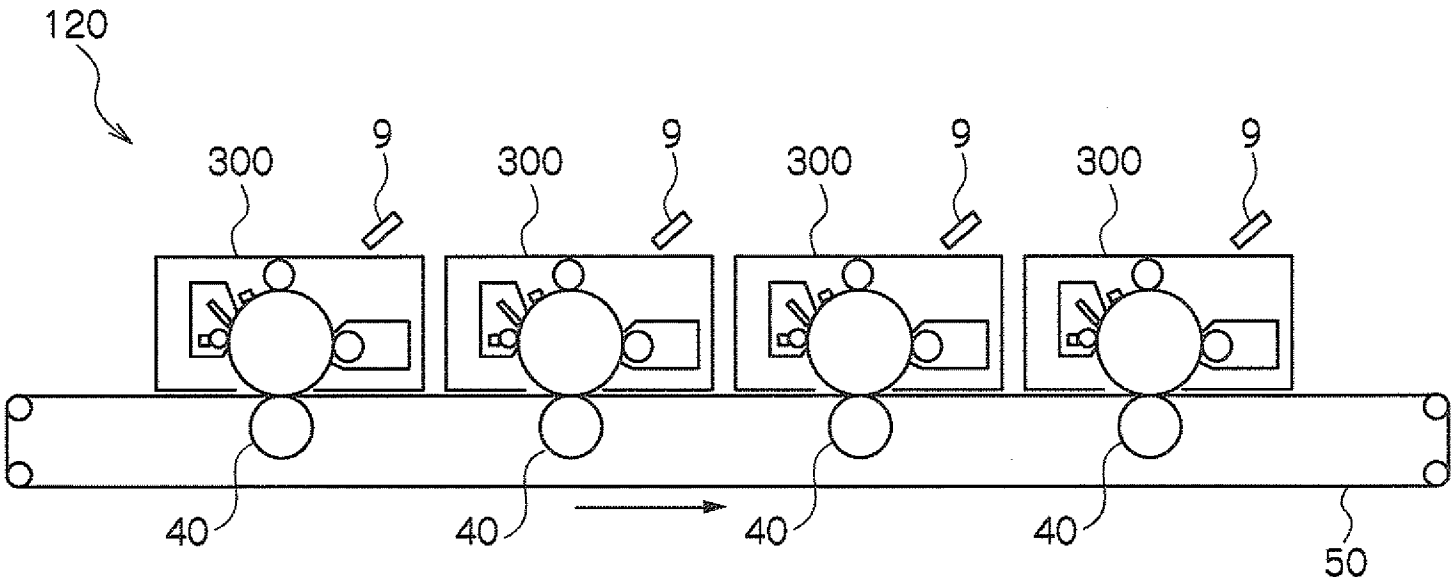
FIG. 5 is a schematic structural view illustrating a different example of the image forming apparatus according to an exemplary embodiment of the invention.

FIG. 5 is a schematic sectional view illustrating an image forming apparatus 120 according to another exemplary embodiment of the invention.

The image forming apparatus 120 is a full color image forming apparatus, in a tandem manner, on which four process cartridges are mounted.

In the image forming apparatus 120, the four process cartridges 300 are arranged in parallel with each other on an intermediate transferring medium 50, and one electrophotographic photoreceptor is used per color. The image forming apparatus 120 has the same structure as the image forming apparatus 100 except that the apparatus 120 is in a tandem manner.

When electrophotographic photoreceptors of the invention are used in an image forming apparatus in a tandem manner, electric characteristics of four photoreceptors are stabilized. As a result, an image of quality excellent in color balance is obtained over a long term.

In the image forming apparatus (or process cartridges) according to the exemplary embodiment, it is possible that each developing device (developing unit) has a developing roller, which is a developing agent holder that is shifted (rotated) in a direction opposite to the shift (rotation) direction of the corresponding electrophotographic photoreceptor. The developing roller has a cylindrical developing sleeve for holding, on the surface thereof, a developing agent thereon. The developing unit may have a regulating member for regulating the amount of the developing agent to be supplied to the developing sleeve. When the developing roller of the developing unit is shifted (rotated) in the direction opposite to the rotation direction of the electrophotographic photoreceptor, the electrophotographic photoreceptor surface is rubbed with the toner remaining between the developing roller and the photoreceptor. When the toner remaining on the photoreceptor is cleaned, the surface of the photoreceptor is strongly rubbed, for example, by increasing the pushing pressure of a blade or the like for enhancing the cleaning with respect to the toner particles, the shapes of which are close to spheres.

As a result of such rubbing, any electrophotographic photoreceptor known in the conventional art is strongly damaged so that abrasion, scratches, filming of the toner, and the like are generated, causing deterioration of images. However, by rendering the surface of each of the electrophotographic photoreceptors of the present exemplary embodiment as a surface which is made into a thick membrane made of a crosslinked product of a specific charge transporting material (a) as defined in the invention (material that has a large number of reactive functional groups and is incorporated at a high concentration so as to give a high crosslinkage density cured membrane), and which has high lubricity and very favorable electric characteristics, a high image quality may be maintained over a long term. This is thought to be because the deposition of electric discharge products is restrained over the long-term.

In order to restrain the deposition of the electric discharge products over a longer period in the image forming apparatus of the present exemplary embodiment, the interval between each of the developing sleeves and the corresponding photoreceptor is preferably set in the range of 200 to 600 μm, and more preferably 300 to 500 μm. For the same purpose, the interval between the developing sleeve and the corresponding regulating blade, which is a regulating member for regulating the developing agent amount, is preferably set in the range of 300 to 1000 μm, and more preferably 400 to 750 μm.

In order to restrain the deposition of electric discharge products over a longer period, the absolute value of the shift speed of each of the developing roll surfaces is preferably made 1.5 to 2.5 times (more preferably 1.7 to 2.0 times) that of the shift speed (process speed) of the corresponding photoreceptor surface.

It is also possible in the image forming apparatus (process cartridges) according to the present exemplary embodiment that each of the developing devices (developing units) is a unit having a developing agent holder having a magnetic body so as to develop an electrostatic latent image with a two-component developing agent containing a magnetic carrier and a toner. According to this configuration, cleaner color image quality may be obtained than according to a configuration in which a one-component developing agent, in particular, a nonmagnetic one-component developing agent, is used. As a result, higher image quality and a longer lifespan may be realized at a higher level.

EXAMPLES

The invention will be more specifically described by way of the following examples; however, the invention is not limited thereto.

Examples A

Examples A1

Formation of Undercoating Layer

One hundred parts by weight of zinc oxide (manufactured by Tayca Co., average particle diameter: 70 nm, specific surface area: 15 $m^2/g$) are mixed with 500 parts by weight of tetrahydrofuran, while stirring. Then, 1.3 parts by weight of a silane coupling agent (trade name: KBM503, manufactured by Shin-Etsu Chemical Co., Ltd.) are added, and the mixture is stirred for 2 hours. Thereafter, toluene is removed therefrom by distillation under reduced pressure, and the residue is subjected to a baking treatment at 120° C. for 3 hours to obtain zinc oxide surface-treated with the silane coupling agent.

One hundred ten parts by weight of the zinc oxide surface-treated with the silane coupling agent are mixed with 500 parts by weight of tetrahydrofuran, while stirring. Then, a solution wherein 0.6 parts by weight of alizarin is dissolved in 50 parts by weight of tetrahydrofuran is added, and stirred at 50° C. for 5 hours. Thereafter, alizarin-applied zinc oxide is separated by filtration under reduced pressure. The zinc oxide is further dried at 60° C. under reduced pressure to give dried alizarin-imparted zinc oxide.

The following (1) and (2) are mixed to form a mixture: (1) 38 parts by weight of a solution wherein 60 parts by weight of the alizarin-imparted zinc oxide, 13.5 parts by weight of a curing agent (a blocked isocyanate, trade name: SUMIDUR3175, manufactured by Sumitomo Bayer Urethane Co.), and 15 parts by weight of a butyral resin (trade name: S-LEC BM-1, manufactured by Sekisui Chemical Co., Ltd.) are added to 85 parts by weight of methyl ethyl ketone; and (2) 25 parts by weight of methyl ethyl ketone. The resultant mixture is dispersed using a sand mill with glass beads of 1 mm diameter for 2 hours to obtain a liquid dispersion.

To the resultant liquid dispersion, 0.005 parts by weight of dioctyltin dilaurate as a catalyst and 40 parts by weight of silicone resin particles (trade name: TOSPEARL 145, manufactured by GE Toshiba Silicones Co., Ltd.) are added to obtain a undercoating layer-forming coating solution. This coating solution is applied onto a cylindrical aluminum substrate having a diameter of 30 mm, a length of 404 mm and a thickness of 1 mm according to a dip coating, and then dried and cured at 170° C. for 40 minutes to obtain a 18 μm thick undercoating layer.

(Formation of Charge Generating Layer)

A mixture composed of 15 parts by weight of gallium hydroxyphthalocyanine having diffraction peaks at least at positions where its Bragg angles (2θ±0.2°) are 7.3°, 16.0°, 24.9°, and 28.0° in an X-ray diffraction spectrum obtained by use of a Cukα characteristic X-ray, as a charge generating material, 10 parts by weight of a vinyl chloride/vinyl acetate copolymer (trade name: VMCH, manufactured by Nippon Unicar Co., Ltd.) as a binder resin, and 200 parts by weight of n-butyl acetate is dispersed over 4 hours using a sand mill with glass beads of 1 mm diameter. To the resultant liquid dispersion, 175 parts by weight of n-butyl acetate and 180 parts by weight of methyl ethyl ketone are added, and then stirred to obtain a charge generating layer-forming coating solution. This coating solution is applied onto the undercoating layer according to a dip coating, and then dried at normal temperature (25° C.) to form a charge generating layer having a 0.2 μm thick film.

(Formation of Charge Transporting Layer)

To 300 parts by weight of tetrahydrofuran (THF) and 100 parts by weight of toluene, 45 parts by weight of N,N'-diphenyl-N,N'-bis(3-methylphenyl)-(1,1')-biphenyl-4,4'-diamine and 55 parts by weight of bisphenol Z polycarbonate (viscosity-average molecular weight: 50000) are added, and dissolved to obtain a charge transporting layer-forming coating solution. This coating solution is applied onto the charge generating layer, and then dried at 130° C. for 45 minutes to form a 20 μm thick charge transporting layer.

(Formation of Protective Layer)

Into 60 parts by weight of isopropanol (IPA) and 140 parts by weight of 2-butanol 132 parts by weight of the charge transporting material represented by the formula (II-18) and 33 parts by weight of ethoxylated bisphenol A diacrylate (trade name: ABE-300, manufactured by Shin-Nakamura Chemical Co., Ltd.) as an acrylic monomer are dissolved. Into this solution, 3 parts by weight of the azo compound (thermopolymerizable silicone polymeric radical polymerization initiator) represented by the formula (z-1) are dissolved to obtain a protective layer-forming coating solution. This coating solution is applied onto the charge transporting layer, and heated at 140° C. in an atmosphere having an oxygen concentration of about 500 ppm for 45 minutes to form a 6 μm thick protective layer.

Thus, an electrophotographic photoreceptor is obtained.

[Evaluation]

—Image Quality Evaluation—

The electrophotographic photoreceptor produced as described above is mounted to a remodeled machine of a copying machine (trade name: DOCUCENTRE COLOR f450, manufactured by Fuji Xerox Co., Ltd.). In an environment of 10° C. and 15% relative humidity, 100000 sheets of images each having area coverage of 5% are continuously formed onto. Thereafter, in the same environment, an image evaluation test is conducted. In the test, occurrence of density variation and streaking are evaluated. At the time of the image evaluation test, the surface of the photoreceptor is also observed. The evaluation results are shown in Table 2.

In the test, P PAPER SHEETS (size: A4, transverse feed) manufactured by Fuji Xerox Co., Ltd. are used.

(Evaluation of Density Variation)

Occurrence of density variation is evaluated with the naked eye, using halftone images (density: 30%).

A: Good

B: Partial variation occurs.

C: Variation occurs which is problematic in terms of image quality.

(Evaluation of Streaking)

Occurrence of streaking is evaluated with the naked eye, using halftone images (density: 30%).

A: Good

B: Partial streaking occurs.

C: Streaking occurs which is problematic in terms of image quality.

—Surface Observation—

The surface state is judged in accordance with whether or not the photoreceptor surface is scratched and whether or not adhering substances adhere onto the surface.

A: Neither scratches nor adhering substances are found even when the surface is observed with a magnification power of 20.

B: Scratches or adhering substances are slightly found when the surface is observed with a magnification power of 20.

C: Scratches or adhering substances are found with the naked eye.

Examples A2 to A6, and Comparative Examples A1 and A2

Each photoreceptor is produced and evaluated in the same way as in Example A1 except that a protective layer is formed by changing individual materials and composition thereof in accordance with Table 1 described below. The evaluation results are shown in Table 2.

Example A7

First, in the same way as in Example A1, a process for forming members from an undercoating layer to a charge generating layer is performed. Thereafter, a charge transporting layer is formed as described below to produce a photoreceptor, and then the photoreceptor is evaluated. The evaluation results are shown in Table 2.

(Formation of Charge Transporting Layer)

To 40 parts by weight of tetrahydrofuran (THF) and 40 parts by weight of toluene, 132 parts by weight of the charge transporting material represented by the formula (II-18) and 33 parts by weight of ethoxylated bisphenol A diacrylate (trade name: ABE-300, manufactured by Shin-nakamura Shin-Nakamura Chemical Co., Ltd.) as an acrylic monomer are added and dissolved. Into this solution 3 parts by weight of the azo compound (silicone polymeric radical polymerization initiator) represented by the formula (z-1) are dissolved to obtain a charge transporting layer-forming coating solution. This coating solution is applied onto the charge generating layer, and is heated at 140° C. in an atmosphere having an oxygen concentration of about 500 ppm for 45 minutes to form a 20 μm thick charge transporting layer.

Example A8

First, in the same way as in Example A1, a process for forming members from an undercoating layer to a charge generating layer is performed. Thereafter, a charge transporting layer is formed as described below to produce a photoreceptor, and then the photoreceptor is evaluated. The evaluation results are shown in Table 2.

(Formation of Charge Transporting Layer)

A photoreceptor is produced and evaluated in the same way as in Example A7 except that the charge transporting material represented by the formula (II-18) in the formation of the charge transporting layer in Example A7 is changed to the charge transporting material represented by the formula (A-17). The evaluation results are shown in Table 2.

TABLE 2

| | Example A1 | Example A2 | Example A3 | Example A4 | Example A5 |
|---|---|---|---|---|---|
| Density variation | A | A | A | A | A |
| Streaking | A | A | A | A | A |
| Surface observation | B | A | A | A | A |

| | Example A6 | Example A7 | Example A8 | Comparative Example A1 | Comparative Example A2 |
|---|---|---|---|---|---|
| Density variation | A | A | A | B | B |
| Streaking | A | A | A | C | C |
| Surface observation | A | B | A | C | B |

In Examples A1 to A8, higher quality images are obtained, wherein density variation and streaking is restrained, compared to Comparative Examples A1 and A2 each using AIBN as a non-silicone polymerization initiator in the image evaluation test. In Comparative Examples A1 and A2, surface defects occur owing to poor lubricity and film-formability of their photoreceptor surface, so that their cleaning blade cracks due to long-term printing. Thus, cleaning failure occurs. As a result, a streaking trouble arises in the image evaluation test.

Examples B

Example B1

The same undercoating layer, charge generating layer and charge transporting layer as those of Example A1 are formed.

(Formation of Protective Layer)

In 60 parts by weight of isopropanol (IPA) and 140 parts by weight of 2-butanol, 132 parts by weight of the charge trans-

TABLE 1

| | Example A1 | Example A2 | Example A3 | Example A4 | Example A5 |
|---|---|---|---|---|---|
| Charge transporting layer | II-18 | II-18 | II-19 | II-19 | II-17 |
| Parts by weight | 132 | 160 | 132 | 160 | 132 |
| Acrylic monomer | ABE 300 manufactured by Shin-Nakamura Chemical Co., Ltd. | — | THE 330 manufactured by Nippon Kayaku Co., Ltd. | — | ABE 300 manufactured by Shin-Nakamura Chemical Co., Ltd. |
| Parts by weight | 33 | 0 | 33 | 0 | 33 |
| Polymerization initiator | z-1 | z-2 | z-1 | z-3 | z-4 |
| Parts by weight | 3 | 3 | 3 | 3 | 3 |

| | Example A6 | Example A7 | Example A8 | Comparative Example A1 | Comparative Example A2 |
|---|---|---|---|---|---|
| Charge transporting layer | A-17 | II-18 | A-17 | II-18 | A-17 |
| Parts by weight | 160 | 132 | 132 | 132 | 132 |
| Acrylic monomer | — | ABE 300 manufactured by Shin-Nakamura Chemical Co., Ltd. | ABE 300 manufactured by Shin-Nakamura Chemical Co., Ltd. | ABE 300 manufactured by Shin-Nakamura Chemical Co., Ltd. | ABE 300 manufactured by Shin-Nakamura Chemical Co., Ltd. |
| Parts by weight | 0 | 33 | 33 | 33 | 33 |
| Polymerization initiator | z-4 | z-1 | z-1 | AIBN manufactured by Wako Pure Chemical Industries, Ltd. | AIBN manufactured by Wako Pure Chemical Industries, Ltd. |
| Parts by weight | 3 | 3 | 3 | 0 | 0 |

porting material represented by the formula (II-18) and 33 parts by weight of ethoxylated bisphenol A diacrylate (trade name: ABE-300, manufactured by Shin-Nakamura Chemical Co., Ltd.) as an acrylic monomer are dissolved to prepare a solution. In this solution, 3 parts by weight of the intermolecular cleavable compound (photopolymerizable silicone polymeric radical polymerization initiator) represented by the formula (h-3) are dissolved to obtain a protective layer-forming coating solution. This coating solution is applied onto the charge transporting layer, and then a metal halide lamp (manufactured by Ushio Inc.) is used to radiate UV rays thereto at an illuminance of 700 mW/cm$^2$ (standard wavelength: 365 nm) for a radiation period of 60 seconds. After the radiation, the layers are heated at 140° C. for 40 minutes to form a 6 μm thick protective layer.

By the method described above, an electrophotographic photoreceptor is obtained.

[Evaluation]

—Image Quality Evaluation—

The electrophotographic photoreceptor produced as described above is mounted to a remodeled machine of a copying machine (trade name: DOCUCENTRE COLOR f450, manufactured by Fuji Xerox Co., Ltd.). In an environment of 10° C. and 15% relative humidity, 100000 sheets of images each having area coverage of 5% are continuously formed. Thereafter, in the same environment, an image evaluation test is conducted. In the test, occurrence of density variation and streaking is evaluated in accordance with the same evaluation criteria as in Examples A. The evaluation results are shown in Table 4.

In the test, P PAPER SHEETS (size: A4, transverse feed) manufactured by Fuji Xerox Co., Ltd. are used.

Examples B2 to B6, and Comparative Examples B1 and B2

Each photoreceptor is produced and evaluated in the same way as in Example B1 except that a protective layer is formed by changing individual materials and composition thereof in accordance with Table 3 described below. The evaluation results are shown in Table 4.

Example B7

First, in the same way as in Example B1, a process for forming members from an undercoating layer to a charge generating layer is performed. Thereafter, a charge transporting layer is formed as described below to produce a photoreceptor, and then the photoreceptor is evaluated. The evaluation results are shown in Table 4.

(Formation of Charge Transporting Layer)

In 40 parts by weight of tetrahydrofuran (THF) and 40 parts by weight of toluene, 132 parts by weight of the charge transporting material represented by the formula (II-18) and 33 parts by weight of ethoxylated bisphenol A diacrylate (trade name: ABE-300, manufactured by Shin-Nakamura Chemical Co., Ltd.) as an acrylic monomer are dissolved to prepare a solution. In this solution 3 parts by weight of the intermolecular cleavable compound (photopolymerizable silicone polymeric radical polymerization initiator) represented by the formula (h-3) are dissolved to obtain a charge-transporting-layer-forming coating solution. This coating solution is applied onto the charge generating layer, and then a metal halide lamp (manufactured by Ushio Inc.) is used to radiate UV rays thereto at an illuminance of 700 mW/cm$^2$ (standard wavelength: 365 nm) for a radiation period of 60 seconds. After the radiation, the layers are heated at 140° C. for 40 minutes to form a 20 μm thick charge transporting layer.

Example B8

First, in the same way as in Example B 1, a process for forming members from an undercoating layer to a charge generating layer is performed. Thereafter, a charge transporting layer is formed as described below to produce a photoreceptor, and then the photoreceptor is evaluated. The evaluation results are shown in Table 4.

(Formation of Charge Transporting Layer)

A photoreceptor is produced and evaluated in the same way as in Example B7 except that the charge transporting material represented by the formula (II-18) in the formation of the charge transporting layer in Example B7 is changed to the charge transporting material represented by the formula (A-17). The evaluation results are shown in Table 4.

TABLE 3

| | Example B1 | Example B2 | Example B3 | Example B4 | Example B5 |
|---|---|---|---|---|---|
| Charge transporting layer | II-18 | II-18 | II-19 | II-19 | A-17 |
| Parts by weight | 132 | 160 | 132 | 160 | 132 |
| Acrylic monomer | ABE 300 manufactured by Shin-Nakamura Chemical Co., Ltd. | — | THE 330 manufactured by Nippon Kayaku Co., Ltd. | — | ABE 300 manufactured by Shin-Nakamura Chemical Co., Ltd. |
| Parts by weight | 33 | 0 | 33 | 0 | 33 |
| Polymerization initiator | h-3 | h-2 | h-3 | h-1 | h-4 |
| Parts by weight | 3 | 3 | 3 | 3 | 3 |

| | Example B6 | Example B7 | Example B8 | Comparative Example B1 | Comparative Example B2 |
|---|---|---|---|---|---|
| Charge transporting layer | A-17 | II-18 | A-17 | II-18 | A-17 |
| Parts by weight | 160 | 132 | 132 | 132 | 132 |
| Acrylic monomer | — | ABE 300 manufactured by Shin-Nakamura Chemical Co., Ltd. | ABE 300 manufactured by Shin-Nakamura Chemical Co., Ltd. | ABE 300 manufactured by Shin-Nakamura Chemical Co., Ltd. | ABE 300 manufactured by Shin-Nakamura Chemical Co., Ltd. |

TABLE 3-continued

| | | | | | |
|---|---|---|---|---|---|
| Parts by weight | 0 | 33 | 33 | 33 | 33 |
| Polymerization initiator | h-4 | h-3 | h-3 | Iregacure 184 manufactured by Ciba Co. | Iregacure 184 manufactured by Ciba Co. |
| Parts by weight | 3 | 3 | 3 | 3 | 3 |

TABLE 4

| | Example B1 | Example B2 | Example B3 | Example B4 | Example B5 |
|---|---|---|---|---|---|
| Density variation | A | A | A | A | A |
| Streaking | A | A | A | A | A |

| | Example B6 | Example B7 | Example B8 | Comparative Example B1 | Comparative Example B2 |
|---|---|---|---|---|---|
| Density variation | A | A | A | B | B |
| Streaking | A | A | A | C | C |

In Examples B1 to B8, higher quality images are obtained, wherein density variation and streaking are suppressed in the image evaluation test after 100,000 sheets of printing compared to the Comparative Examples which use the non-silicone polymerization initiator Irgacure 184. In Comparative Examples B1 and B2, the lubricity of the photoreceptor surface layer is deteriorated so that the cleaning property is deteriorated. Thus, as a result of long-term use of the cleaning blade, the elasticity of which is deteriorated or the tip of which is worn away by the printing test over the long-term, streaking trouble arises owing to the cleaning failure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor, comprising an electroconductive substrate and a photosensitive layer formed on or above the electroconductive substrate, an outermost layer of the photoreceptor being a cured membrane obtained by curing by thermopolymerization or photopolymerization a composition comprising:

at least one compound (a) having in a single molecule thereof a charge transporting skeleton and a chain polymerizable functional group, and at least one thermopolymerizable or photopolymerizable silicone polymeric radical polymerization initiator (b) that comprises:

an azo compound represented by any one of the following formulae (z-1) to (z-4), or an intermolecular cleavable compound represented by the following formula (2):

formula (z-1) being represented by:

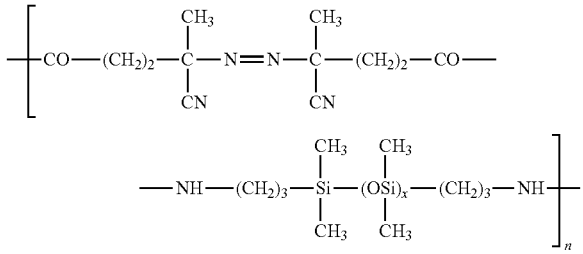

wherein x represents 3, and n represents an integer of 1 to 10;

formula (z-2) being represented by:

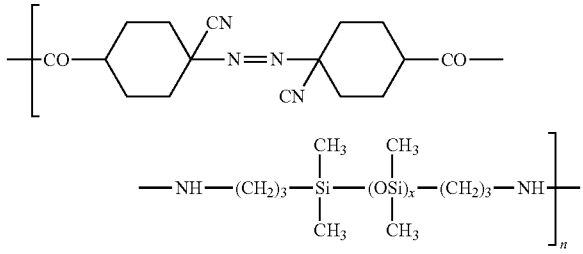

wherein x represents an integer of 1 to 10, and n represents an integer of 1 to 10;

formula (z-3) being represented by:

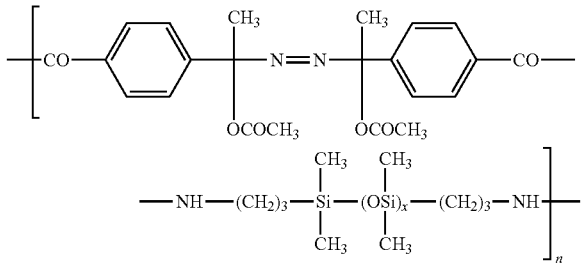

wherein x represents an integer of 1 to 10, and n represents an integer of 1 to 10; and formula (z-4) being represented by:

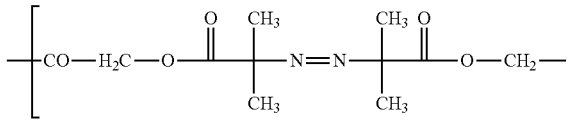

-continued

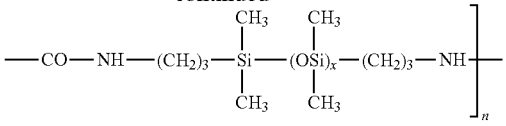

wherein x represents an integer of 1 to 10, and n represents an integer of 1 to 10; and (2)

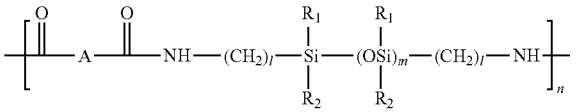

wherein, in the formula (2) each $R_1$ and $R_2$ independently represents a linear or branched alkyl group having one or more carbon atoms, or a substituted or unsubstituted aryl group; 1 represents an integer of 1 to 10; m represents an integer of 1 to 10; n represents an integer of 1 to 10; and A represents an intermolecular cleavable radical-generating moiety.

2. The electrophotographic photoreceptor of claim 1, wherein the intermolecular cleavable compound represented by the formula (2) is an intermolecular cleavable compound wherein each $R_1$ and $R_2$ represents a methyl group, 1 is 3, m is 3, n is 4, and A represents a benzoin compound, a benzylketal compound, an α-aminoacetophenone compound, or an acylphosphine oxide compound.

3. The electrophotographic photoreceptor of claim 1, wherein the charge transporting skeleton is a skeleton originating from a triarylamine compound, a benzidine compound or a hydrazone compound.

4. The electrophotographic photoreceptor of claim 1, wherein the chain polymerizable functional group is at least one member selected from the group consisting of an acryloyl group, a methacryloyl group and a styrene group.

5. The electrophotographic photoreceptor of claim 1, wherein the compound (a) has the charge transporting skeleton and an acryloyl group or a methacryloyl group, and further a structure having, between its charge transporting skeleton and its acryloyl group or methacryloyl group, one or more carbon atoms.

6. The electrophotographic photoreceptor of claim 1, wherein the compound (a) has a structure having, in a single molecule thereof, a triphenylamine skeleton and three or more methacryloyl groups.

7. The electrophotographic photoreceptor of claim 1, wherein the compound (a) is a compound represented by the following formula (A):

(A)

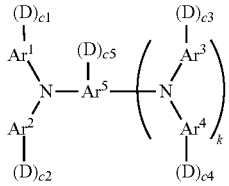

wherein, in the formula (A), $Ar^1$ to $Ar^4$ each independently represent a substituted or unsubstituted aryl group, $Ar^5$ represents a substituted or unsubstituted aryl group, or a substituted or unsubstituted arylene group, each D represents $—(CH_2)_d—(O—CH_2—CH_2)_e—O—CO—C(CH_3)=CH_2$ wherein d represents an integer of 1 to 5 and e represents 0 or 1, c1 to c5 each independently represent 1 or 2, k represents 0 or 1, and the total number of Ds is 4 or more.

8. A process cartridge, comprising:

the electrophotographic photoreceptor of claim 1; and at least one selected from the group consisting of an electrifier for electrifying the electrophotographic photoreceptor, a developing unit for developing an electrostatic latent image formed on the electrophotographic photoreceptor with a toner, and a toner remover for removing toner remaining on the surface of the electrophotographic photoreceptor, wherein the process cartridge can be freely attached to an image forming apparatus and detached therefrom.

9. An image forming apparatus, comprising:

the electrophotographic photoreceptor of claim 1, an electrifier for electrifying the electrophotographic photoreceptor, an electrostatic latent image-forming unit for forming an electrostatic latent image on the electrified electrophotographic photoreceptor, a developing unit for developing the electrostatic latent image formed on the electrophotographic photoreceptor with a toner to form a toner image, and a transferring unit for transferring the toner image to a transfer medium.

10. The electrophotographic photoreceptor of claim 1, wherein, in formula (2), the intermolecular cleavable radical-generating moiety represented by A is a bivalent organic group generated from benzoin compounds, benzylketal compounds, α-hydroxyacetophenone compounds, α-aminoacetophenone compounds, acylphosphine oxide compounds, titanocene compounds, trichloromethyltriazine compounds, or bisimidazole compounds.

* * * * *